US012765644B1

(12) United States Patent
Blakely et al.

(10) Patent No.: US 12,765,644 B1
(45) Date of Patent: Oct. 20, 2026

(54) FOOTWEAR ARTICLES AND METHODS OF MAKING THE SAME

(71) Applicant: Blakely Ventures, LLC, Atlanta, GA (US)

(72) Inventors: Sara Blakely, Atlanta, GA (US); Jadideah D. Yarbrough, Atlanta, GA (US); Sylma Colon-Otten, Atlanta, GA (US)

(73) Assignee: Blakely Ventures, LLC, Atlanta, GA (US)

( * ) Notice: Subject to any disclaimer, the term of this patent is extended or adjusted under 35 U.S.C. 154(b) by 0 days.

(21) Appl. No.: 17/808,831

(22) Filed: Jun. 24, 2022

Related U.S. Application Data

(60) Provisional application No. 63/214,597, filed on Jun. 24, 2021.

(51) Int. Cl.
*A43D 3/02* (2006.01)
*A43D 3/04* (2006.01)

(52) U.S. Cl.
CPC ..... *A43D 3/023* (2013.01); *A43D 3/024* (2013.01); *A43D 3/025* (2013.01); *A43D 3/04* (2013.01)

(58) Field of Classification Search
CPC ..... A43D 3/023; A43D 3/024; A43D 3/025; A43D 3/04
See application file for complete search history.

(56) References Cited

U.S. PATENT DOCUMENTS 1,791,948 A * 2/1931 Bliss ..... A43D 1/06 33/3 A
1,960,418 A 5/1934 Schaller
2,043,649 A * 6/1936 Bliss ..... A43D 1/06 33/3 A
D105,727 S 8/1937 Stuart
2,139,885 A 12/1938 De Gironimo
2,200,579 A 5/1940 Marshall
2,426,810 A * 9/1947 Ayers ..... A43D 3/024 12/135 R (Continued)

FOREIGN PATENT DOCUMENTS

| | | |
|---|---|---|
| BX | 35575-006 | 12/2007 |
| CA | 11238 | 11/1936 |
| CN | 1394763 | 2/2003 |
| CN | 103150099 | 6/2013 |
| CN | 303686775 S | 6/2016 |

(Continued)

OTHER PUBLICATIONS

Y. Luximon, A. Luximon, Sizing and grading of shoe lasts, 2013, Handbook of Footwear Design and Manufacture, Woodhead Publishing Series in Textiles, 2013, pp. 197-215, https://www.sciencedirect.com/science/article/pii/B9780857095398500103 (Year: 2013).*

(Continued)

*Primary Examiner* — Megan E Lynch

(74) *Attorney, Agent, or Firm* — Scale LLP; Christopher S. Geyer

(57) ABSTRACT

Disclosed herein is a footwear last for a predetermined size comprising: a) a hindfoot section wherein a distal bottom portion of the hindfoot section defines a heel seat; b) a forefoot section, wherein the forefoot section has a distal portion and a proximal portion; and c) a midfoot section, wherein the midfoot section connects the hindfoot section and forefoot section. Further disclosed herein are footwear articles and methods of manufacturing the same.

9 Claims, 24 Drawing Sheets

(56) References Cited

U.S. PATENT DOCUMENTS

| | | | | |
|---|---|---|---|---|
| 2,465,817 | A | 3/1949 | Perugia | |
| 2,900,743 | A | 8/1959 | Beth | |
| 3,039,207 | A | 6/1962 | Harry | |
| 3,170,249 | A | 2/1965 | Taicher | |
| 3,187,358 | A * | 6/1965 | Roske | A43D 3/022 12/141 |
| 4,183,156 | A | 1/1980 | Rudy | |
| 4,219,945 | A | 9/1980 | Rudy | |
| 4,266,350 | A | 5/1981 | Laux | |
| 4,412,364 | A * | 11/1983 | Orea Mateo | A43D 1/04 12/146 L |
| 4,523,345 | A * | 6/1985 | Orea Mateo | A43D 3/027 12/135 R |
| D282,121 | S | 1/1986 | Kamali | |
| 4,594,783 | A * | 6/1986 | Chaumel | A43D 3/021 33/6 |
| 4,694,590 | A | 9/1987 | Greenawalt | |
| 4,760,655 | A | 8/1988 | Mauch | |
| 4,936,029 | A | 6/1990 | Rudy | |
| 4,955,148 | A | 9/1990 | Padilla | |
| 5,042,176 | A | 8/1991 | Rudy | |
| D347,099 | S | 5/1994 | Nelson | |
| 5,373,650 | A | 12/1994 | Dananberg et al. | |
| D355,524 | S | 2/1995 | Hatfield | |
| D374,553 | S | 10/1996 | Throneburg | |
| 5,713,141 | A | 2/1998 | Mitchell et al. | |
| 5,752,330 | A | 5/1998 | Snabb | |
| 5,782,015 | A | 7/1998 | Dananberg | |
| 5,784,811 | A | 7/1998 | Mauch | |
| 5,952,065 | A | 9/1999 | Mitchell et al. | |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,170,176 | B1 | 1/2001 | Clough | |
| 6,203,868 | B1 | 3/2001 | Bonk et al. | |
| 6,219,941 | B1 | 4/2001 | Kukoff | |
| 6,247,250 | B1 | 6/2001 | Hauser | |
| 6,321,465 | B1 | 11/2001 | Bonk et al. | |
| 6,604,301 | B1 | 8/2003 | Manoli | |
| 6,698,050 | B1 * | 3/2004 | Frye | A43B 7/1435 12/133 B |
| 6,745,498 | B2 | 6/2004 | LaDuca | |
| 7,062,866 | B2 | 6/2006 | Bussler | |
| 7,140,125 | B2 | 11/2006 | Singleton et al. | |
| 7,347,011 | B2 | 3/2008 | Dua et al. | |
| 7,594,346 | B2 | 9/2009 | Dananberg | |
| 7,665,229 | B2 | 2/2010 | Kilgore et al. | |
| 7,735,240 | B2 | 6/2010 | Lee | |
| 7,814,688 | B2 | 10/2010 | Dananberg | |
| D634,106 | S | 3/2011 | Davidson | |
| D634,921 | S | 3/2011 | Davidson | |
| 7,941,941 | B2 | 5/2011 | Hazenberg et al. | |
| D661,070 | S | 6/2012 | Valle et al. | |
| 8,246,881 | B2 | 8/2012 | Maranan et al. | |
| D672,540 | S | 12/2012 | Lagerfeld | |
| 8,414,811 | B1 | 4/2013 | De Santis et al. | |
| 8,421,822 | B2 | 4/2013 | Odland et al. | |
| 8,516,717 | B2 | 8/2013 | Bonilla-Espada | |
| 8,563,020 | B2 | 10/2013 | Uhlmann et al. | |
| D715,524 | S | 10/2014 | Silverman | |
| D716,536 | S | 11/2014 | Silverman | |
| D740,006 | S | 10/2015 | Silverman | |
| D751,800 | S | 3/2016 | Silverman | |
| D753,379 | S | 4/2016 | Silverman | |
| D753,380 | S | 4/2016 | Silverman | |
| D756,089 | S | 5/2016 | Silverman | |
| 9,510,647 | B1 | 12/2016 | Singh et al. | |
| 9,538,812 | B2 | 1/2017 | Torrance et al. | |
| 9,554,621 | B2 | 1/2017 | Truelsen | |
| 9,717,304 | B2 | 8/2017 | Bernhard | |
| 10,165,821 | B2 | 1/2019 | Truelsen | |
| 10,244,813 | B2 | 4/2019 | Mitchell | |
| 10,271,612 | B2 | 4/2019 | Zake | |
| 10,390,587 | B2 | 8/2019 | Hughes et al. | |
| 10,524,532 | B2 | 1/2020 | Alan et al. | |
| 10,624,416 | B2 | 4/2020 | Mitchell | |
| 10,721,992 | B2 | 7/2020 | Bernhard et al. | |
| 10,932,528 | B2 | 3/2021 | Bruce et al. | |
| 11,311,075 | B2 | 4/2022 | Dong et al. | |
| 2003/0009915 | A1 | 1/2003 | Bacon | |
| 2003/0110662 | A1 | 6/2003 | Gilman et al. | |
| 2005/0108897 | A1 | 5/2005 | Aveni | |
| 2006/0090377 | A1 | 5/2006 | Segalin | |
| 2006/0101670 | A1 | 5/2006 | Bucalo | |
| 2006/0123663 | A1 | 6/2006 | Swensen | |
| 2006/0185197 | A1 | 8/2006 | Rhenter | |
| 2008/0222918 | A1 | 9/2008 | Hesse | |
| 2009/0183390 | A1 | 7/2009 | Miller et al. | |
| 2011/0203135 | A1 | 8/2011 | DelCielo | |
| 2012/0117818 | A1 | 5/2012 | Slowik | |
| 2012/0210605 | A1 | 8/2012 | Riley | |
| 2012/0324758 | A1 | 12/2012 | Tang | |
| 2013/0326914 | A1 | 12/2013 | Lopez | |
| 2014/0259759 | A1 | 9/2014 | Sulak et al. | |
| 2014/0336012 | A1 | 11/2014 | Gourineni | |
| 2015/0027002 | A1 | 1/2015 | Elliott | |
| 2015/0107031 | A1 * | 4/2015 | Bizzo | A43D 3/029 12/145 |
| 2016/0021971 | A1 | 1/2016 | Carver | |
| 2017/0318899 | A1 | 11/2017 | Hendrix et al. | |
| 2017/0332733 | A1 | 11/2017 | Cluckers et al. | |
| 2018/0020772 | A1 | 1/2018 | Mitchell | |
| 2019/0082777 | A1 | 3/2019 | Adami et al. | |
| 2019/0133250 | A1 | 5/2019 | D'Alessandro | |
| 2019/0365029 | A1 | 12/2019 | Cross et al. | |
| 2020/0015547 | A1 | 1/2020 | Kay | |
| 2020/0178649 | A1 | 6/2020 | Singleton | |
| 2020/0275742 | A1 * | 9/2020 | Kim | A43D 1/027 |

FOREIGN PATENT DOCUMENTS

| | | | |
|---|---|---|---|
| CN | 205492761 | | 8/2016 |
| CN | 304052795 | | 2/2017 |
| CN | 304084620 | | 3/2017 |
| CN | 304092115 | | 4/2017 |
| CN | 304098778 | | 4/2017 |
| CN | 304204773 | | 7/2017 |
| CN | 304478657 | | 1/2018 |
| CN | 207784417 | | 8/2018 |
| CN | 109717543 | | 5/2019 |
| CN | 111280605 | | 6/2020 |
| CN | 306000217 | S | 8/2020 |
| CN | 306247049 | | 12/2020 |
| DE | 517308 | C | 2/1931 |
| DE | 830911 | C | 2/1952 |
| DE | 102004031094 | | 1/2006 |
| EP | 3672439 | | 5/2022 |
| FR | 995273 | A | 11/1951 |
| FR | 1336776 | A | 9/1963 |
| GB | 276429 | | 8/1927 |
| GB | 369265 | A | 3/1932 |
| GB | 451550 | A | 8/1936 |
| GB | 2544606 | A | 5/2017 |
| HU | 88466-0001 | | 7/2000 |
| JP | 2020110631 | | 7/2020 |
| JP | 3228641 | U | 11/2020 |
| KR | 300592006.0000 | | 3/2011 |
| KR | 300594353.0000 | | 3/2011 |
| KR | 300647007.0000 | | 5/2012 |
| KR | 300677638.0000 | | 1/2013 |
| KR | 300760919.0000 | | 9/2014 |
| KR | 300891610.0000 | | 1/2017 |
| KR | 301025195.0000 | | 9/2019 |
| RU | 00084309 | | 2/2013 |
| WO | 1998/014083 | | 4/1998 |
| WO | 2013190832 | | 12/2013 |
| WO | 2020/207549 | | 10/2020 |

OTHER PUBLICATIONS

Y. Luximon, A. Luximon, Shoe-last design innovation for better shoe fitting, 2009, Computers in Industry vol. 60, Issue 8, Oct. 2009,

(56) References Cited

OTHER PUBLICATIONS pp. 621-628, https://www.sciencedirect.com/science/article/pii/S0166361509001365#bib4 (Year: 2009).*
Sam, Women's Shoe Lasts, Nov. 19, 2019, Podohub.com, https://podohub.com/womens-shoe-lasts/ (Year: 2019).*
https://podohub.com/shop/shoe-lasts/womens-shoe-lasts/milan-womens-high-heel-shoe-last/ (Year: 2019).*
Sam, Shoe Last Size Charts, Mar. 12, 2021, Podohub.com, https://podohub.com/shoe-last-size-charts/ (Year: 2021).*
Board-Lasted vs. Strobel Constructions. Understanding the Differences. Aug. 2, 2021.https://www.stories.koio.co/blog/board-vs-strobel-constructions.
Branthwaite, Helen, Nachiappan Chockalingam, and Andrew Greenhalgh. "The effect of shoe toe box shape and vol. on forefoot interdigital and plantar pressures in healthy females." Journal of foot and ankle research 6.1 (2013), 6:28.
Cong, Y, et al., Regional plantar foot pressure distributions on high-heeled shoes-shank curve effects. Acta Mech. Sin. (2011) 27(6):1091-1097. DOI 10.1007/s10409-011-0525-x.
Corey Buhay, What soles are made of: Your guide to footwear tech lingo https://www.outsidebusinessjournal.com/issues/education/What-soles-are-made-of-your-guide-to-footwear-tech-lingo/ Sep. 30, 2015.
Ebbeling, Christine J., Joseph Hamill, and Jill A. Crussemeyer. "Lower extremity mechanics and energy cost of walking in high-heeled shoes." Journal of Orthopaedic & Sports Physical Therapy 19.4 (1994): 190-196.
Goonetilleke S. Ravindra, The Science of Footwear. 2012. Book.
High-Heeled Shoes Definition (apparelsearch.com) Oct. 20, 2006. https://www.apparelsearch.com/definitions/footwear/high_heeled_shoes.htm.
Lecom Health. The Real Harm in High Heels https://lecomhealth.com/the-real-harm-in-high-heels/.
Liana Satenstein, The Fusion Heel-Sneaker Might Be Coming to a Closet Near You. Oct. 2, 2019.
Markham Heid , These Are the Healthiest Shoes to Wear, According to Scientists. May 30, 2018. https://time.com/5294580/healthy-shoes-footwear/.
Melvin, J.M.A, The Effects of Heel Height, Shoe Volume and Upper Stiffness on Shoe Comfort and Plantar Pressure. Thesis. Feb. 2015. 362 pages.
Michoński, Jakub, et al. "Decreased vertical trunk inclination angle and pelvic inclination as the result of mid-high-heeled footwear on static posture parameters in asymptomatic young adult women." International journal of environmental research and public health 16.22 (2019): 4556.
Shakoor, et al., Effects of Common Footwear on joint loading in Osteoarthritis of the knee. Arthritis Care & Res. 62.7. 2010, pp. 917-923. https://onlinelibrary.wiley.com/doi/full/10.1002/acr.20165.
Shaping a sensation: The On Speedboard. https://www.on-running.com/en-us/articles/shaping-a-sensation-the-on-speedboard.
Shoe Last [Definitive Guide in 2022], Aug. 28, 2019. What is a Shoe Last? Shoe Last [Definitive Guide in 2022] (shoemakingcoursesonline.com).
Speksnijder M. Caroline, et al., The higher the heel the higher the forefoot-pressure in ten healthy women. The Foot 15 (2005) 17-21.
Kletina, S., Stacked Heel: How to Make Heels. Dec. 3, 2018 How To Make Heels and Heel Height Calculation (shoemakingcoursesonline.com).
Sterling Last Corporation 1932-1982, Booklet. Aug. 25, 182. 36 pages.
Witana, C.P et al., Footbedshapes for enhanced footwear comfort, Ergonomics, 2009, 1-12. DOI: 10.1080/00140130802419503.
Yu Jia, Development of A Computational Foot Model for Biomechanical Evaluation of High-Heeled Shoe Designs. Jan. 2009. Thesis. 215 pages.
Miaomiao Xu, et al., Foot Morphology in Chinese School Children Varies by Sex and Age. Med Sci Monit, 2018; 24: 4536-4546.
Ameersing Luximon, et al., Shoe-last design innovation for better shoe fitting. Computers in Industry 60 (2009) 621-628.
Matt LaBarge, Metatarsalgia. Get Relief from Metatarsalgia, posted on-line 2016. https://www.happyfeet.com/blog/metatarsalgia/.
European Union Registered Community Design No. 001543158-0001 to Segev Davidson ("Davidson III") Filing date Oct. 6, 2009.
European Union Registered Community Design No. 001698549-0002 to Tod's S.P.A. ("Tod's I") Filing date Apr. 22, 2010.
European Union Registered Community Design No. 001543265-0001 to Segev Davidson ("Davidson IV") Filing date Oct. 6, 2009.
European Union Registered Community Design No. EU002052753-0006 to Tod's S.P.A. ("Tod's II") Filing date May 6, 2012.
European Union Registered Community Design No. EU002180224-0004 to Shoe.com GmbH & Co. KG ("Shoe.com I") Filing date Jul. 2, 2013.
European Union Registered Community Design No. 002073791-0002 to Candice Cooper AG ("Candice Cooper") Filing date Jul. 2, 2013.
European Union Registered Community Design No. 001863986-0003 to Karl Lagerfeld ("Lagerfeld II") Filing date May 16, 2011.
European Union Registered Community Design No. 002671016-0046 to Gabor ShoeAktiengesellschaft ("Gabor Shoes") Filing date Mar. 27, 2015.
European Union Registered Community Design No. 001807215-0079 to Kennel & Schmenger Schuhfabrik GmbH ("Kennel") Filing date Jan. 18, 2011.
International Registration No. DM/077 689 Filing date 14.11.2011.
International Registration No. DM/081 401 Filing date 24.07.2013.
Denim look high heel sneakers are new for 2017 URL: http://highheelsdaily.com/2017/01/22/denim-look-high-heel-sneakers-are-new-for-2017/ Accessed Date: Jan. 12, 2020.
Finally, a high heel sneaker that isn't a fake nike URL: http://highheelsdaily.com/2013/05/25/finally-a-high-heel-sneaker-that-isnt-a-fake-nike/ Accessed Date: Jan. 12, 2020.
Nike high heels shoes—real or fake? URL: https://visualhunt.com/nike-high-heels-shoes-real-or-fake Published Date: May 5, 2020.
HC high heel sneakers black and white low top stiletto 4.5 inch heel regular width URL: https://www.etsy.com/listing/565184484/hc-highheel-sneakers-black-and-white Accessed Date: Jan. 12, 2020.
Sneaker high heels from Adidas URL: http://highheelsdaily.com/2012/05/18/sneaker-high-heels-from-adidas/ Accessed Date: Jan. 12, 2020.
Anatomy/construction of high heel shoes URL: https://in.pinterest.com/pin/701435710689762239/ Accessed Date: Jan. 29, 2021.
European Union Registered Community Design No. 001097943-0001 to Starkop Sp. z.o.o. Filing date Apr. 14, 2009.
European Union Registered Community Design No. 006334330-0001 to Thi Hong Lam Pham Filing date Jul. 6, 2021.
European Union Registered Community Design No. 000028444-0001 to Studio Dick Boons BV Filing date Aug. 19, 2003.
International Registration No. DM/079 060 Filing date Feb. 21, 2013.
International Registration No. DM/81401-005 Filing date Aug. 9, 2013.
International Registration No. DM/77689-001 Filing date May 18, 2012.
International Registration No. DM/75026-002 Filing date Mar. 31, 2011.
International Registration No. DM/74187-005 Filing date Aug. 31, 2010.
Ladies ultra high heel round toe shoe lasts URL: https://www.alibaba.com/product-detail/Ladies-ultra-high-heel-round-toe_62265652953.html?spm=a2700.7724857.0.0.6f5f56d0oSSVIP Accessed Date: Aug. 2, 2022.
Pair of Plastic Shoe Lasts for Woman High Heel Pumps Shoemaking URL: https://www.amazon.com/Plastic-Lasts-Woman-Pumps-Shoemaking/dp/B0793MJ51Z Published Date: Jan. 17, 2018.
What is a Shoe Last? URL: https://www.sneakerfactory.net/2020/07/what-is-a-shoe-last/ Published Date: Jul. 4, 2020.
Cowboy boot shoe last template URL: https://www.instagram.com/p/CghwKylJj4L/ Accessed Date: Aug. 2, 2022.
Women's high heel shoe lasts URL: https://901shoemakers.com/products/shoe-last-high-heel Accessed Date: Aug. 2, 2022.

(56) References Cited

OTHER PUBLICATIONS

102mm Block High Heel Component for Shoemaking https://www.etsy.com/in-en/listing/646895797/102mm-block-high-heel-component—for Published Date: Jul. 4, 2022.
Shoemaking lasts—high heels URL: https://icanmakeshoes.com/products/shoemaking-lasts-high-heels Accessed Date: Aug. 2, 2022.
Footwear News, "Gait-Tech's New Insole Innovation Aims to Help Make High Heels More Comfortable," Jan. 3, 2023. URL: https://footwearnews.com/2023/business/retail/gait-tech-high-heel-comfort-innovation-1203386517/#recipient_hashed=87d6d40ce67d0fbb43f2822be8e1b740962bd2ab6d117d61b45a4e15b77d9d1d&recipient_salt=fa1dfc83e9c58ede3f3d10abc41ca22273c9d5d146adc2217c9be5aba18eb1fc Accessed Date: Jan. 26, 2023.
Office Action issued in connection with U.S. Appl. No. 17/808,847, dated Feb. 28, 2023 (12 pages).
Office Action issued in connection with U.S. Appl. No. 17/808,847, dated Oct. 7, 2022 (12 pages).
Non-Final Office Action issued on Aug. 18, 2023, in U.S. Appl. No. 18/308,298.

* cited by examiner

FOOTWEAR ARTICLES AND METHODS OF MAKING THE SAME

CROSS-REFERENCE TO RELATED APPLICATIONS

This application claims the benefit of U.S. Provisional Application No. 63/214,597 filed Jun. 24, 2021, the content of which is incorporated herein by reference in its entirety.

TECHNICAL FIELD

This application relates generally to a footwear article and methods of making the same.

BACKGROUND

High-heel shoes have been considered fashionable and highly sought after for several centuries. However, most of the common high-heel shoes are generally uncomfortable, especially if worn for prolonged periods. Additionally, wearing high-heel shoes can cause a change in the body balance, shifting the center of gravity of the body towards the ball of the foot and adding additional stress and pressure on this particular part of the body. This body shift also results in the weight of the body being distributed unevenly, putting additional stress on small bones of the foot and ligaments, potentially causing inflammation and long-term issues that can affect the day-to-day performance of the wearer. For example, some recent studies show that even a 1-inch heel can put 22% more pressure on the ball of the foot, whereas a 3-inch heel can inflict a 76% increase in pressure. High-heel shoes can also increase the load on various joints.

Another issue is that to prevent ankle inversion and increase general shoe stability, most common high-heel shoes have relatively stiff soles that contribute to the loadings on the joints, especially the knee joints.

In addition, the common high-heel shoe design usually has a narrow toe box to provide an additional aesthetic view of a narrow foot. However, this narrow toe box squeezes foot bones, is uncomfortable, and can cause various conditions, such as calluses, bunions, ingrown toenails, plantar fasciitis, neuroma, and the like.

Athletic shoes, on the other hand, have been very popular both for sports activities and everyday life due to the comfort these shoes can provide to the foot for a prolonged period of time. Athletic shoes can also be categorized based on their specific utility. For example, various athletic shoe categories include running, tennis, basketball, golf, cleats, and the like. The united feature of all conventional athletic shoes includes two primary elements: an upper structure and a sole structure. The sole structure of athletic shoes is usually configured, depending on the specific application, to reduce ground reaction forces during walking, running, playing sports, etc., and improve stability to the foot.

Additionally, the conventional athletic shoe construction allows even weight distribution along the shoe and does not introduce additional stress on metatarsal bones and phalanges or any tissue surrounding the foot bones. Athletic shoes are generally wider, allowing a free movement of the toes during physical activity and ensuring that the toes are not squeezed. While athletic shoes provide the desired comfort, they do not offer height or work with all types of the desired fashion.

Despite all the negative attributes of the high-heel shoe, the aesthetics and height gains provided by such a shoe still attract many shoe wearers. Thus, new shoe constructions that can provide a nexus between a high-heel shoe's fashionable and aesthetic appeal and the comfort of an athletic shoe are needed. Similarly, new manufacturing methods for such trendsetting and fashionable hybrid shoes are also needed. These needs and other needs are at least partially satisfied by the present disclosure.

SUMMARY

The present disclosure is directed to a footwear last for a predetermined size comprising: a) a hindfoot section wherein a distal bottom portion of the hindfoot section defines a heel seat; b) a forefoot section, wherein the forefoot section has a distal portion and a proximal portion; and c) a midfoot section, wherein the midfoot section connects the hindfoot section and forefoot section, wherein a length $l_1$ from a heel point ($H_o$) of the hindfoot section to a footwear last ball break point measured along a footwear last bottom center line curve is at least about 3% longer than a length $l_1'$ from a heel point ($H_o'$) of the hindfoot section to a footwear last ball break point measured along a footwear last bottom center line curve of a standard footwear last having a size substantially identical to the predetermined size, and a substantially identical heel height; wherein a height measured from a heel point ($H_o$) to a ground plane defines a heel height $a_1$ of a footwear article and wherein $a_1$ is at least 50 mm; and wherein arch height $a_2$ at a mid-instep as measured relative to the ground plane is at least about 5% higher than a height $a_2'$ at mid-instep as measured relative to the ground plane of the standard footwear last a size substantially identical to the predetermined size and a heel height.

Also disclosed herein is a footwear article comprising a) a lasting board; b) an upper; c) an outsole; and d) a heel having a heel height of at least 50 mm, wherein the lasting board and the upper are formed onto any of the disclosed herein footwear lasts.

In still further aspects, disclosed herein is a hybrid shoe having a heel height of at least 50 mm and defined by a) a toe box having a first width: b) a heel portion defining a heel seat having a second width; and c) a midportion connecting the toe box and the heel portions, wherein a ratio between the first width and the second width is greater than about 1.5 to about 1.8 for a standard width shoe; wherein the toe box is configured to resemble an athletic shoe and wherein the heel portion comprises a heel counter insert and is configured to resemble a standard high-heel shoe heel portion; wherein the shoe comprises a lasting board that is more rigid than a lasting board of a standard athletic shoe; and wherein the hybrid shoe further comprises a fastening member configured to hold a wearer's foot in place.

Also disclosed herein are stylish hybrid shoes comprising a front portion and a back portion. In such aspects, the front portion of the shoe provides comfort similar to the athletic shoe, while the back portion of the shoe provides the fashionable look and aesthetics of a high-heel shoe. In some aspects, this disclosure also provides a new shoe construction that can minimize the negatives of the high-heel shoe while keeping its appealing features. In yet other aspects, this disclosure also provides a new shoe construction that provides a performance of the athletic shoe while adding the fashion and height gains of the high-heel shoe.

Additional advantages will be set forth in part in the following description and in part will be understandable from the description or can be learned by practice of the aspects described below. The advantages described below will be realized and attained by means of the articles, systems, methods, and combinations thereof. It is to be understood that both the foregoing general description and the following detailed description are exemplary and explanatory only and are not restrictive of the invention.

BRIEF DESCRIPTION OF DRAWINGS

FIG. 1B shows a bottom portion of the hybrid shoe in one aspect.

FIG. 5A depicts a close-up and more detailed description of an exemplary heel counter in one aspect. FIG. 5B depicts a close-up and more detailed description of an exemplary back portion of the disclosed herein hybrid shoe in one aspect.

FIG. 6A shows a construction of an exemplary insole board in one aspect. FIG. 6B shows a construction of an exemplary insole board in another aspect. FIG. 6C shows a more detailed construction of an exemplary insole board in another aspect.

Figure 1A:
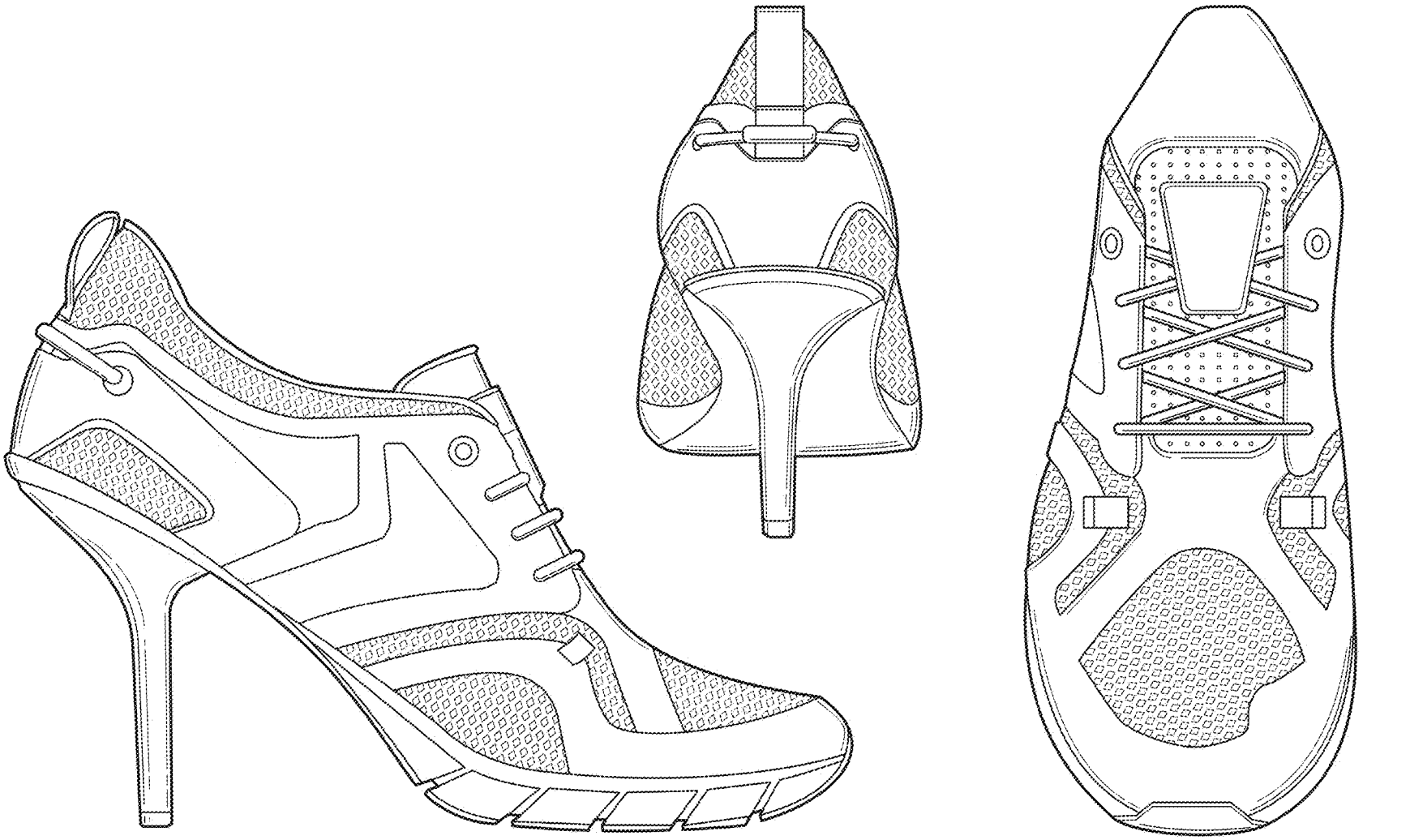
FIG. 1A-1B depict an exemplary design of the disclosed herein hybrid shoe in one aspect.

The accompanying figures, which are incorporated in and constitute a part of this specification, illustrate several aspects described below.

DETAILED DESCRIPTION

The present invention can be understood more readily by reference to the following detailed description, examples, and drawings, and their previous and following description. However, before the present articles, systems, and/or methods are disclosed and described, it is to be understood that this invention is not limited to the specific or exemplary aspects of articles, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. To this end, those skilled in the relevant art will recognize and appreciate that many changes can be made to the various aspects of the invention described herein while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Definitions

As used herein, the terms "optional" or "optionally" mean that the subsequently described event or circumstance can or cannot occur and that the description includes instances where said event or circumstance occurs and instances where it does not.

It is appreciated that certain features of the disclosure, which are, for clarity, described in the context of separate aspects, can also be provided in combination in a single aspect. Conversely, various features of the disclosure, which are, for brevity, described in the context of a single aspect, can also be provided separately or in any suitable subcombination.

As used in the description, the singular forms "a," "an," and "the" include plural referents unless the context clearly dictates otherwise. Thus, for example, a reference to "a sole" includes two or more such soles, reference to "a shoe" includes two or more such shoes and the like.

It is also to be understood that the terminology used herein is for the purpose of describing particular aspects only and is not intended to be limiting. As used in the specification, the term "comprising" can include the aspects "consisting of" and "consisting essentially of." Unless defined otherwise, all technical and scientific terms used herein have the same meaning as commonly understood by one of ordinary skill in the art to which this invention belongs. In this specification, reference will be made to a number of terms that shall be defined herein.

For the terms "for example" and "such as," and grammatical equivalences thereof, the phrase "and without limitation" is understood to follow unless explicitly stated otherwise. It is further understood that these phrases are used for explanatory purposes only. It is further understood that the term "exemplary" as used herein means "an example of" and is not intended to convey an indication of a preferred or ideal aspect.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values, including the recited values, may be used. Further, ranges can be expressed herein as from "about" one particular value and/or to "about" another particular value. When such a range is expressed, another aspect includes from the one particular value and/or to the other particular value.

Similarly, when values are expressed as approximations, by use of the antecedent "about," it will be understood that the particular value forms another aspect. It will be further understood that the endpoints of each of the ranges are significant both in relation to the other endpoint and independently of the other endpoint. Unless stated otherwise, the term "about" means within 5% (e.g., within 2% or 1%) of the particular value modified by the term "about."

The term "or" means "and/or." Recitation of ranges of values is merely intended to serve as a shorthand method of referring individually to each separate value falling within the range, unless otherwise indicated herein, and each separate value is incorporated into the specification as if it were individually recited herein. The endpoints of all ranges are included within the range and independently combinable. All methods described herein can be performed in a suitable order unless otherwise indicated herein or otherwise clearly contradicted by context.

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, 6 and any whole and partial increments therebetween. This applies regardless of the breadth of the range.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on").

It will be understood that, although the terms "first," "second," etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

As used herein, the term "substantially" means that the subsequently described event or circumstance completely occurs or that the subsequently described event or circumstance generally, typically, or approximately occurs.

Still further, the term "substantially" can in some aspects refer to at least about 80%, at least about 85%, at least about 90%, at least about 91%, at least about 92%, at least about 93%, at least about 94%, at least about 95%, at least about 96%, at least about 97%, at least about 98%, at least about 99%, or 100% of the stated property, component, composition, or other condition for which substantially is used to characterize or otherwise quantify an amount.

In other aspects, as used herein, the term "substantially free," when used in the context of a composition or component of a composition that is substantially absent, is intended to refer to an amount that is then about 1% by weight, e.g., less than about 0.5% by weight, less than about 0.1% by weight, less than about 0.05% by weight, or less than about 0.01% by weight of the stated material, based on the total weight of the composition.

As used herein, the term or phrase "effective," "effective amount," or "conditions effective to" refers to such amount or condition that is capable of performing the function or property for which an effective amount or condition is expressed. As will be pointed out below, the exact amount or particular condition required will vary from one aspect to another, depending on recognized variables such as the materials employed and the processing conditions observed. Thus, it is not always possible to specify an exact "effective amount" or "condition effective to." However, it should be understood that an appropriate, effective amount will be readily determined by one of ordinary skill in the art using only routine experimentation.

As used herein, the terms "insole board" and "lasting board" can be used interchangeably and are related to a core component of shoe construction, as described below. In still further aspects, the insole board or lasting board can be referred to as a skeleton of the shoe that all other shoe components are built around. It is understood that the terms "insole board" and "lasting board" as used herein are different from the term "insole" that can be optionally present and positioned on the outermost surface of the "insole board" or "lasting board" to provide additional comfort. It is understood that in the aspects where the insole is present, it can be removable or permanent depending on the specific shoe design. In still further aspects, the insole can be removed and replaced by a different insole depending on the desired application or comfort of the wearer. In yet other aspects, whether the insole is removable or permanently attached, an additional insole can also be added if desired for improved comfort or to compensate for any orthopedic issues of the wearer. In still further aspects, the insole can comprise one or more layers, as disclosed below.

In certain aspects, the outermost layer of the insole that is in intimate contact with the wearer's foot can be referred to as a "footsock." In yet other aspects, and again as disclosed below, the insole can comprise additional layers, inserts, paddings, and the like to improve comfort and adjust or compensate for a wearer's posture and/or gait.

In still further aspects, the term "shoe" refers to any known footwear article and encompasses boots, sandals, mules, or any other known in the art shoes.

In still further aspects, the term "athletic shoe" generally refers to a footwear used for the purpose of performance in sport. Athletic shoes are generally built to ensure that no injury is inflicted during the sport or any other athletic activity. In certain aspects, it is understood that the athletic shoe can be defined as closed-toe footwear consisting of a heel counter, padded tongue, lacing system, insole, and injection or vulcanized performance outsole. In certain aspects, the athletic footwear can be Strobel lasted along the entire length of the shoe or cemented. It is also understood that in most aspects, the heel counter of the athletic shoe can also be padded and generally is less rigid than a high-heel shoe.

While aspects of the present invention can be described and claimed in a particular statutory class, such as the system statutory class, this is for convenience only and one of ordinary skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is in no way intended that an order be inferred in any respect. This holds for any possible non-express basis for interpretation, including matters of logic with respect to arrangement of steps or operational flow, plain meaning derived from grammatical organization or punctuation, or the number or type of aspects described in the specification.

The Present Invention May be Understood More Readily by Reference to the following detailed description of various aspects of the invention and the examples included therein and to the Figures and their previous and following description.

Footwear Last

In one aspect disclosed herein is a footwear last that allows the manufacturing of high-heel footwear articles that combine comfort and desired fashionable attributes without negatively affecting the wearer's health.

Figure 11A:
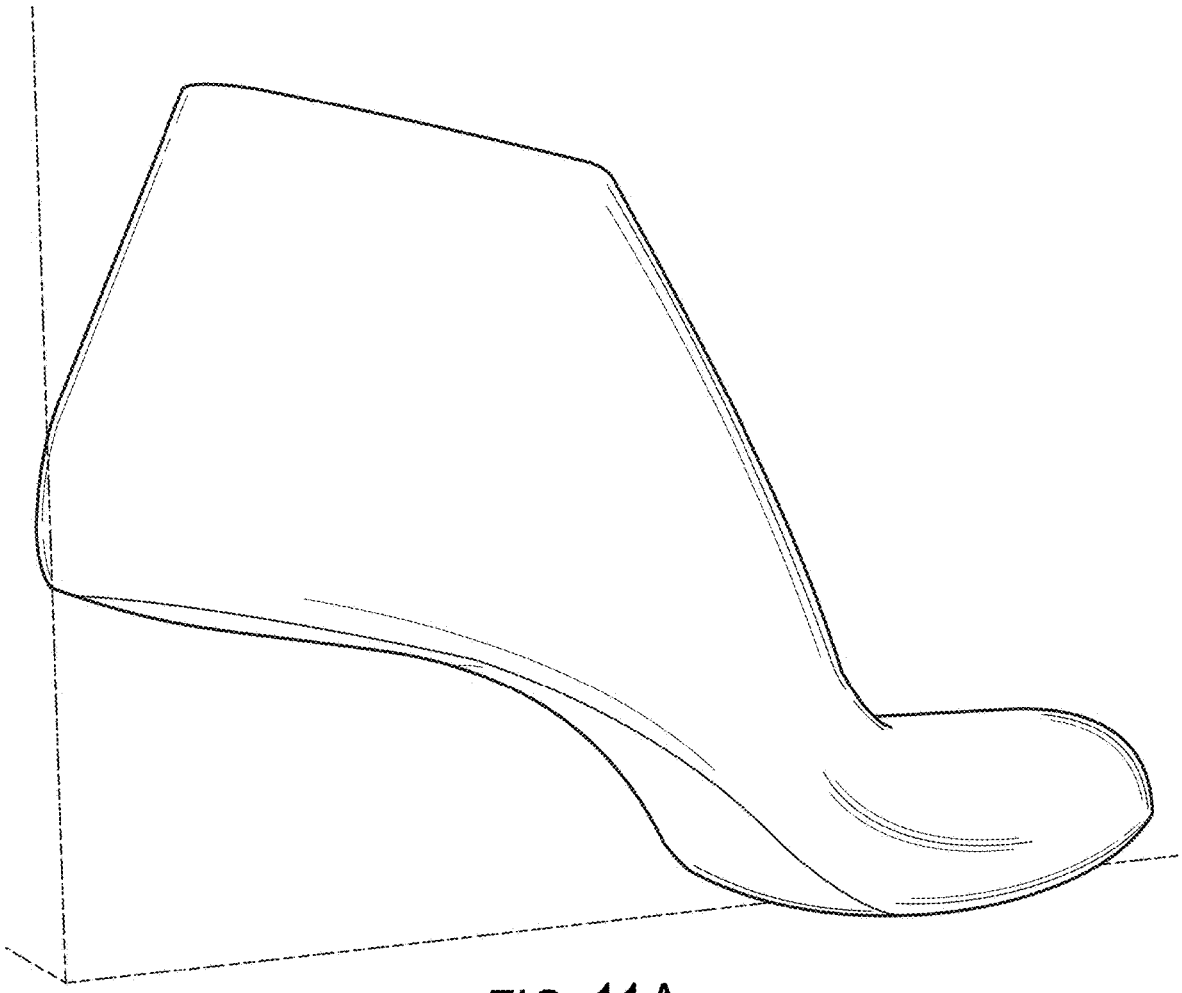
FIGS. 11A-11B show a schematic of an exemplary footwear last (FIG. 11A) in one aspect and a standard last having a substantially identical predetermined size and a substantially identical heel height (FIG. 11B) in a different aspect.
Figure 11B:
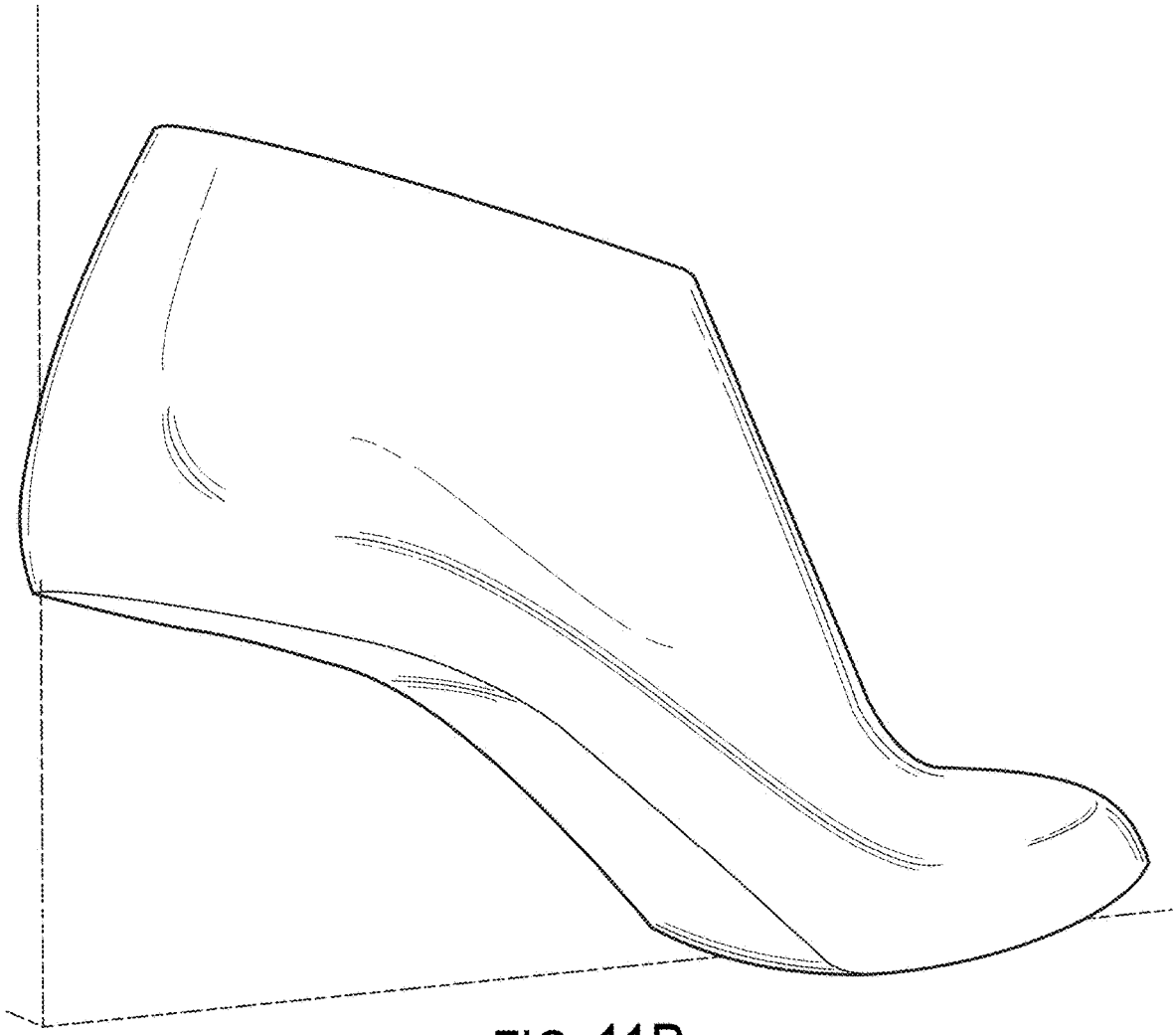

FIGS. 11A and 11B show a footwear last that is a solid cast made to resemble the human foot. FIG. 11A shows an exemplary and unlimiting footwear last, described in this disclosure that is used to make a footwear article, size 7, having a 65 mm heel. FIG. 11B shows a standard last commonly used in the industry to make a footwear article, size 7, also having a 65 mm heel. An inventive last and a standard last can be made of different materials, but their construction is based on the same principles. It is further understood that the last shown herein for size 7 are only exemplary, and the grading system can be applied to form any predetermined size of the footwear article.

FIGS. 12A-12H show various portions of the exemplary footwear last in comparison with the standard last. The footwear last for a predetermined size described herein and shown in FIG. 12A comprises a) a hindfoot section (1000), b) a forefoot section (1200), and c) a midfoot section (1100). In certain aspects, a distal bottom portion of the hindfoot section defines a heel seat (1002). The heel seat of the footwear last is configured to form a heel seat in a footwear article built onto the disclosed last. In yet still further aspects, the forefoot section (1200) has a distal portion (1204) and a proximal portion (1202). The proximal portion of the forefoot defines a feather line of a toe portion of the footwear last, where the distal portion (1204) of the forefoot section connects the forefoot section with the midfoot section (1100). It is understood that the midfoot section (1100) connects the hindfoot section (1000) and the forefoot sections (1200) of the footwear last described herein.

Figure 12A:
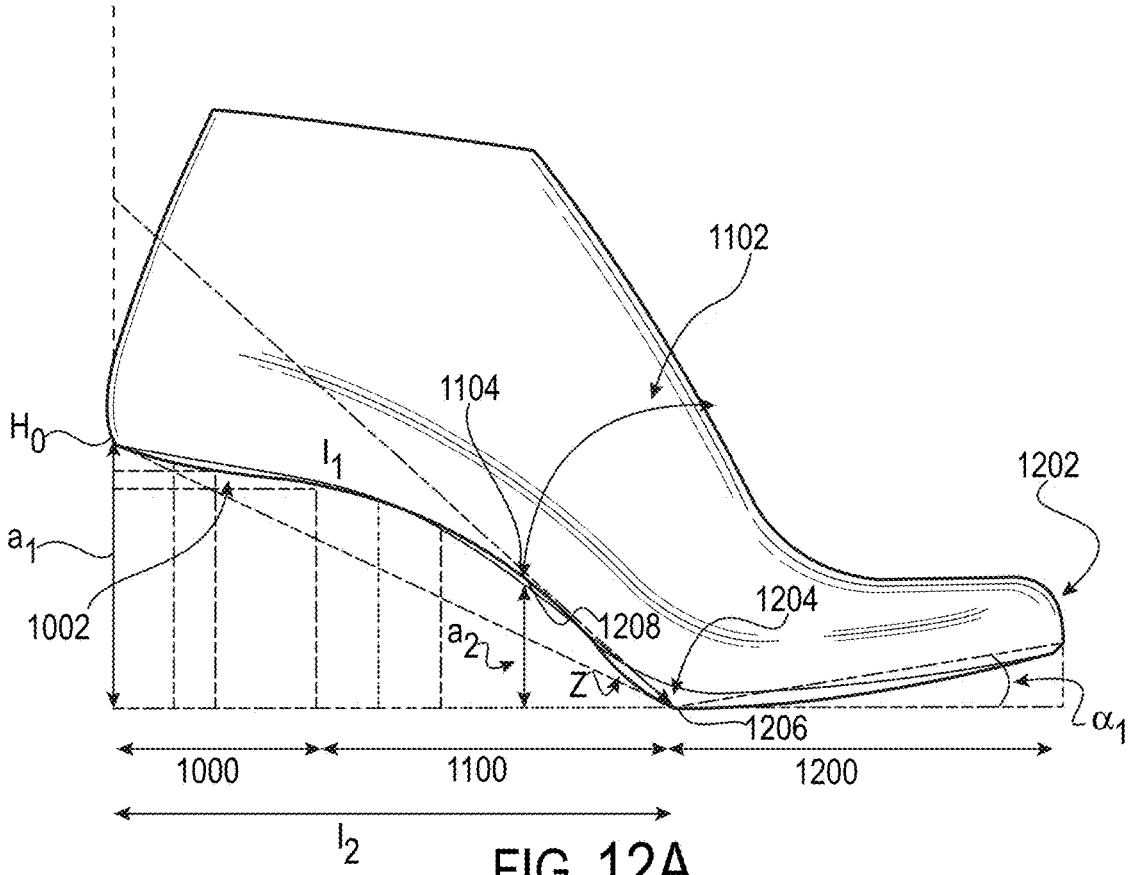
FIGS. 12A-12H show various portions of an exemplary footwear last in one aspect (FIGS. 12A, 12C, 12E-12G) and a standard last having a substantially identical predetermined size and a substantially identical heel height (FIGS. 12B, 12D, and 12H) in a different aspect.
Figure 12B:
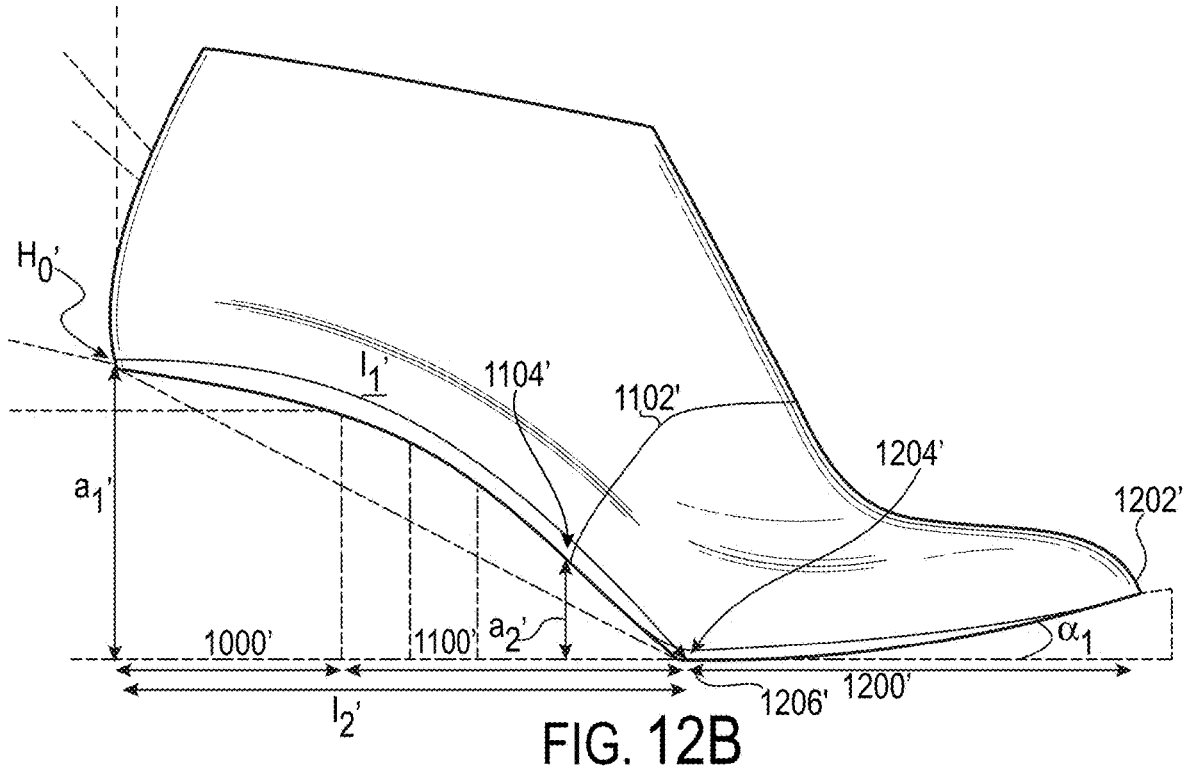

The standard footwear last, as shown in FIG. 12B has sections comprising the hindfoot (1000'), midfoot (1100'), and forefoot (1200') that are similar to the sections of the exemplary footwear last of FIG. 12A, except that the exemplary footwear last has certain modified features that produce an improved footwear article as will be described further below. It is understood that the standard footwear last as described herein is a standard last used by last manufacturers for a specific size and a generic design prior to any specific design modifications being applied for a specific shoe.

In certain aspects, the disclosed herein footwear last is defined by a length $l_1$ measured from a heel point ($H_o$) of the hindfoot section to a footwear last ball break point (1206) along a footwear last bottom center line curve. In yet still further aspects, when this length is projected to a ground plane, the length is defined as $l_2$. It is understood that $l_1$ and $l_2$ are not the same: $l_2$ is measured as a projection to the ground plane, while $l_1$ is measured along the bottom center line curve. In still further aspects, $l_1$ is at least about 3%, at least about 3.5%, at least about 4%, at least about 4.5%, at least about 5%, at least about 5.5%, at least about 6%, at least about 6.5%, at least about 7%, at least about 7.5%, at least about 8%, at least about 8.5%, at least about 9%, at least about 9.5%, or at least about 10% longer than an analogous $l_1'$ (FIG. 12B), as measured from the heel point ($H_o'$) of the hindfoot section to a footwear last ball break point (1206') along a footwear last bottom center line curve of a standard footwear last having a size substantially identical to the predetermined size, and a substantially identical heel height. In yet still further aspects, $l_1$ is about 15% longer, about 14% longer, about 13% longer, about 12% longer, about 11% longer, about 10% longer, about 9% longer, about 8% longer, about 7% longer, about 6% longer, about 5% longer, about 4% longer, about 3% longer, or about 2% longer than $l_1'$.

In still further aspects, the length $l_1$ is substantially identical to or greater than a length $l_1''$ from a heel point ($H_o''$) of the hindfoot section to a footwear last ball break point measured along a footwear last bottom center line curve of a standard footwear last having a substantially identical heel height and at least one size larger than the predetermined size of the exemplary footwear last. For example, and without limitations, the length $l_1$ for an exemplary footwear last of size 7 can be substantially identical to or greater than $l_1''$ (measured identically to $l_1$) of a standard footwear last having the same heel size and size 8. Yet in some aspects, the $l_1$ of an exemplary footwear last of size 7 can be substantially identical to or greater than $l_1''$ (measured identically to $l_1$) of a standard footwear last having the same heel size and size 9.

In still further aspects, $l_1$ is at least 3 mm longer, at least about 4 mm longer, at least about 5 mm longer, at least about 6 mm longer, at least about 7 mm longer, at least about 8 mm longer, at least about 9 mm longer, at least about 10 mm longer, at least about 11 mm longer, at least about 12 mm longer, at least about 13 mm longer, at least about 14 mm longer, or at least about 15 mm longer that $l_1'$ of a standard footwear last having a size substantially identical to the predetermined size, and a substantially identical heel height.

In still further aspects, a height measured from a heel point ($H_o$) (or $H_o'$ for a standard last) to a ground plane defines a heel height $a_1$ (or $a_1'$ for the standard last) of a footwear article that is built onto the disclosed (or standard, for a comparison) last. In still further aspects, $a_1$ (or analogous $a_1'$) is from about 50 mm to about 110 mm, including exemplary values of about 55 mm, about 60 mm, about 65 mm, about 70 mm, about 75 mm, about 80 mm, about 85 mm, about 90 mm, about 95 mm, about 100 mm, and about 105 mm. It is understood that $a_1$ (or $a_1'$ for analogous standard last) can have any value within the described range. For example, and without limitations, the heel can be about 52 mm in height, or it can be about 67 mm in height, or it can be about 86 mm, and so on. As used herein, the heel point ($H_o$) of the exemplary last (and by analogy $H_o'$ for a standard last) is the point on the heel that lies along the previously described bottom centerline curve, and that is farthest from the toe section of the forefoot section. Moreover, as used herein, the ground plane is the horizontal plane defined by a portion of the forefoot section that touches the ground and a distal portion of the heel when it is attached.

In still further aspects, the footwear last can be defined by a mid-instep girth (1102). As discussed herein, the mid-instep girth can also be referred to as a waist girth. It is understood that the terms mid-instep girth and waist girth can be used interchangeably. In some aspects, an arch height $a_2$ can be measured as a straight line projected to a ground plane from a lateral mid-instep point (1104) of the footwear last, where the mid-instep girth is measured. It is understood that the lateral mid-instep point can be determined by the skilled practitioner and is measured on a lateral side of the last. In such aspects, the arch height $a_2$ can be at least about 5% higher than an analogous height $a_2'$ (FIG. 12B) at mid-instep as measured relative to the ground plane of the standard footwear last at a size substantially identical to the predetermined size and a substantially identical heel height. In yet still further aspects, $a_2$ can be at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, at least about 20%, at least about 21%, at least about 22%, at least about 23%, at least about 24%, at least about 25%, at least about 26%, at least about 27%, at least about 28%, at least about 29%, at least about 30%, at least about 31%, at least about 32%, at least about 33%, at least about 34%, at least about 35%, at least about 36%, at least about 37%, at least about 38%, at least about 39%, at least about 40%, at least about 41%, at least about 42%, at least about 43%, at least about 44%, at least about 45%, at least about 46%, at least about 47%, at least about 48%, at least about 49%, at least about 50%, at least about 51%, at least about 52%, at least about 53%, at least about 54%, at least about 55%, at least about 56%, at least about 57%, at least about 58%, at least about 59%, or at least about 60% higher than an analogous height $a_2'$ (FIG. 12B) at the mid-instep as measured relative to the ground plane of the standard footwear last a size substantially identical to the predetermined size and a substantially identical heel height.

In yet still in further aspects, the arch height $a_2$ is about 5% higher, about 10%, about 15% higher, about 20% higher, about 25% higher, about 30% higher, about 35% higher, about 40% higher, about 45% higher, about 50% higher, about 55% higher, or about 60% higher than an analogous height $a_2'$ (FIG. 12B) at the mid-instep as measured relative to the ground plane of the standard footwear last a size substantially identical to the predetermined size and a substantially identical heel height.

In yet still further exemplary and unlimiting aspects, the arch height $a_2$ is at least about 1 mm, at least about 2 mm, at least about 3 mm, at least about 4 mm, at least about 5 mm, at least about 6 mm, at least about 7 mm, at least about 8 mm, at least about 9 mm, at least about 10 mm, at least about 11 mm, at least about 12 mm, at least about 13 mm, at least about 14 mm, or at least about 15 mm higher than an analogous height $a_2'$ at mid-instep as measured relative to the ground plane of the standard footwear last a size substantially identical to the predetermined size and a substantially identical heel height. In yet other aspects, the arch height $a_2$ about 15 mm, about 14 mm, about 13 mm, about 12 mm, about 11 mm, about 10 mm, about 9 mm, about 8 mm, about 7 mm, about 6 mm, about 5 mm, about 4 mm, about 3 mm, about 2 mm, or about 1 mm higher than an analogous height $a_2'$ at mid-instep as measured relative to the ground plane of the standard footwear last a size substantially identical to the predetermined size and a substantially identical heel height.

It is understood that in standard last manufacturing, some last makers can create a "short-coupled" last in which the arch curve is increased along with the shortening of the length up to the ball break to create the "short-coupling" between the ball break point and the heel. In the aspects disclosed herein, an increase in the arch height $a_2$ is accompanied by an increase in $l_1$ as compared to the standard last, having a size substantially identical to the predetermined size and a substantially identical heel height.

In still further aspects, a forefoot section extends proximally and upwardly from the footwear last ball break point at an angle $a_1$ (FIG. 12A) (or $a_1'$ in FIG. 12B) relative to the ground plane towards a toe point of the footwear last. This angle $a_1$ also is known as the toe spring. In certain aspects, the $a_1$ can be substantially identical to $a_1'$ of the standard last, having a size substantially identical to the predetermined size and a substantially identical heel height. Yet, in other aspects, the $a_1$ can be greater than $a_1'$ of the standard last, having a size substantially identical to the predetermined size and a substantially identical heel height. While in still further aspects, the $a_1$ can be smaller than $a_1'$ of the standard last, having a size substantially identical to the predetermined size and a substantially identical heel height. It is understood that the toe spring can be calculated and adjusted depending on the heel height, rigidity of the sole for the footwear article, the thickness of the sole of the footwear article, and the like.

Figure 12C:
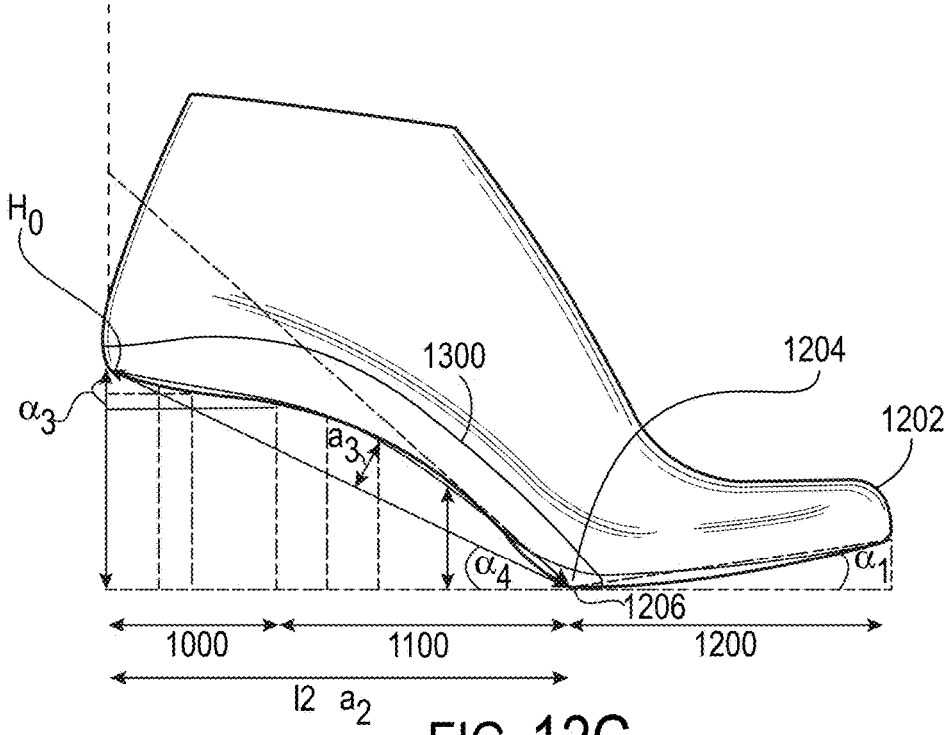
Figure 12D:
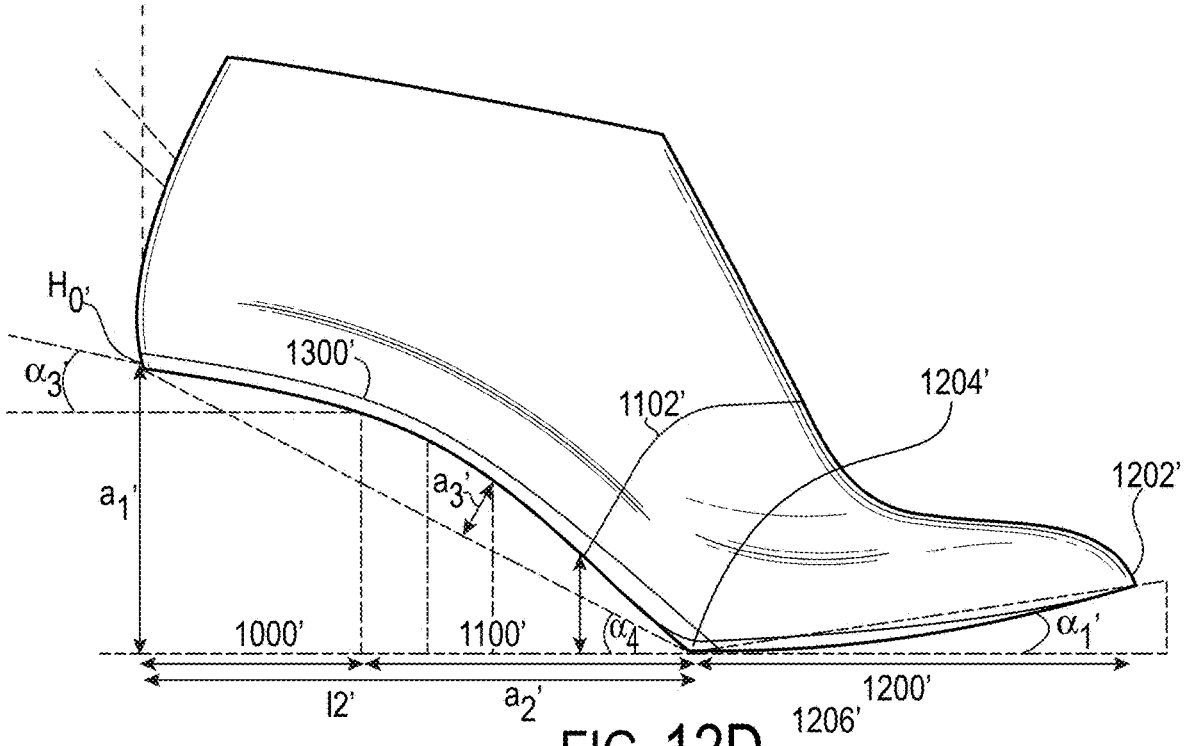
Figure 12E:
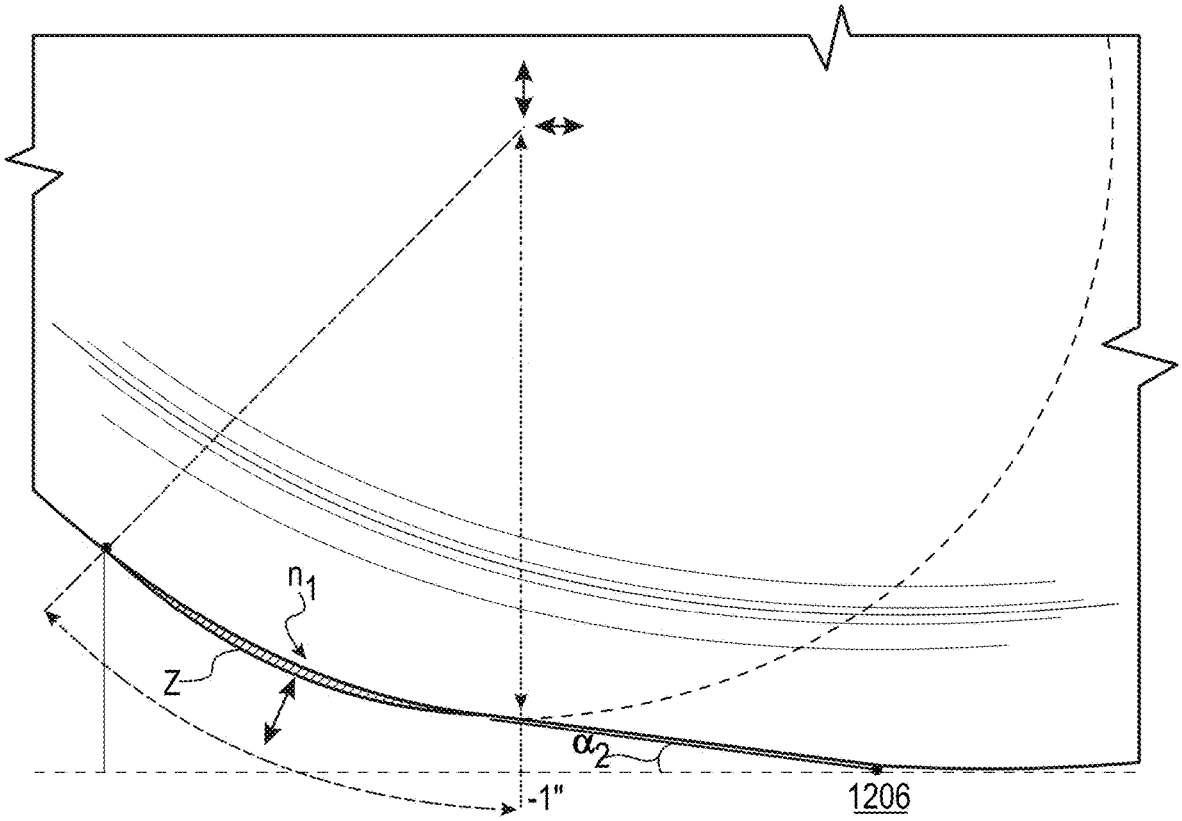
Figure 16A:
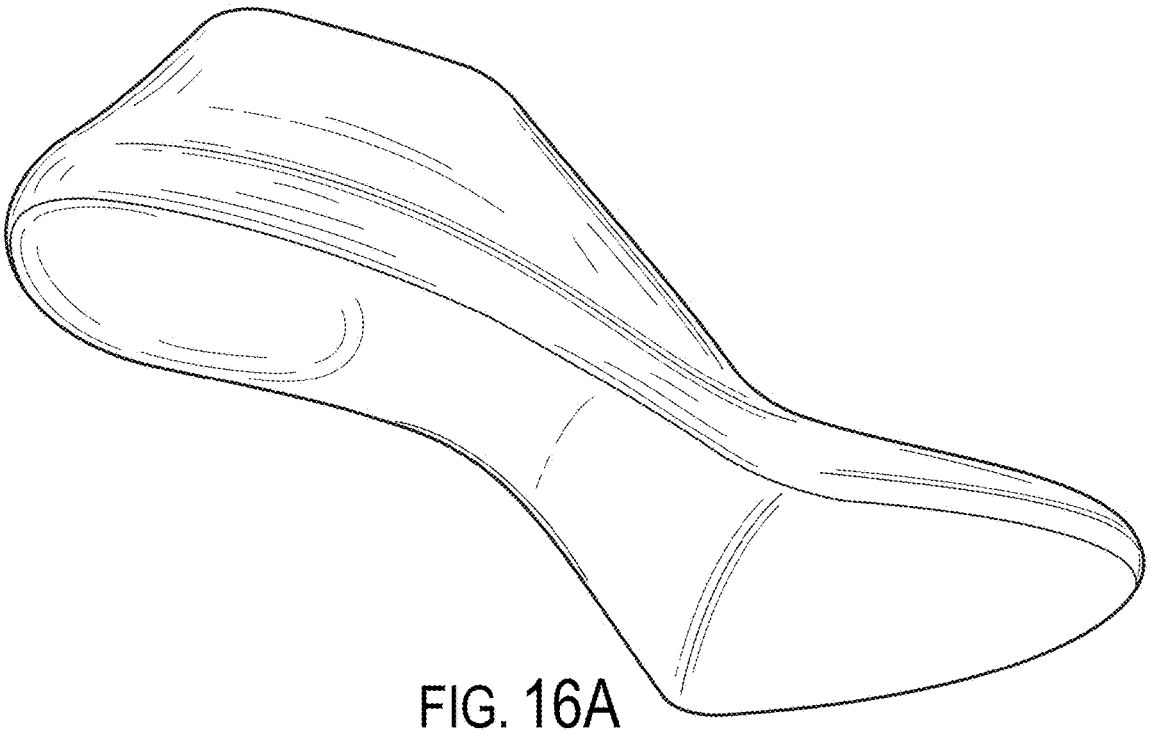
FIGS. 16A-16D show an exemplary last (FIGS. 16A and 16C) in one aspect and a standard last (FIGS. 16B and 16D) having a substantially identical predetermined size and a substantially identical heel height in a different aspect.
Figure 16B:
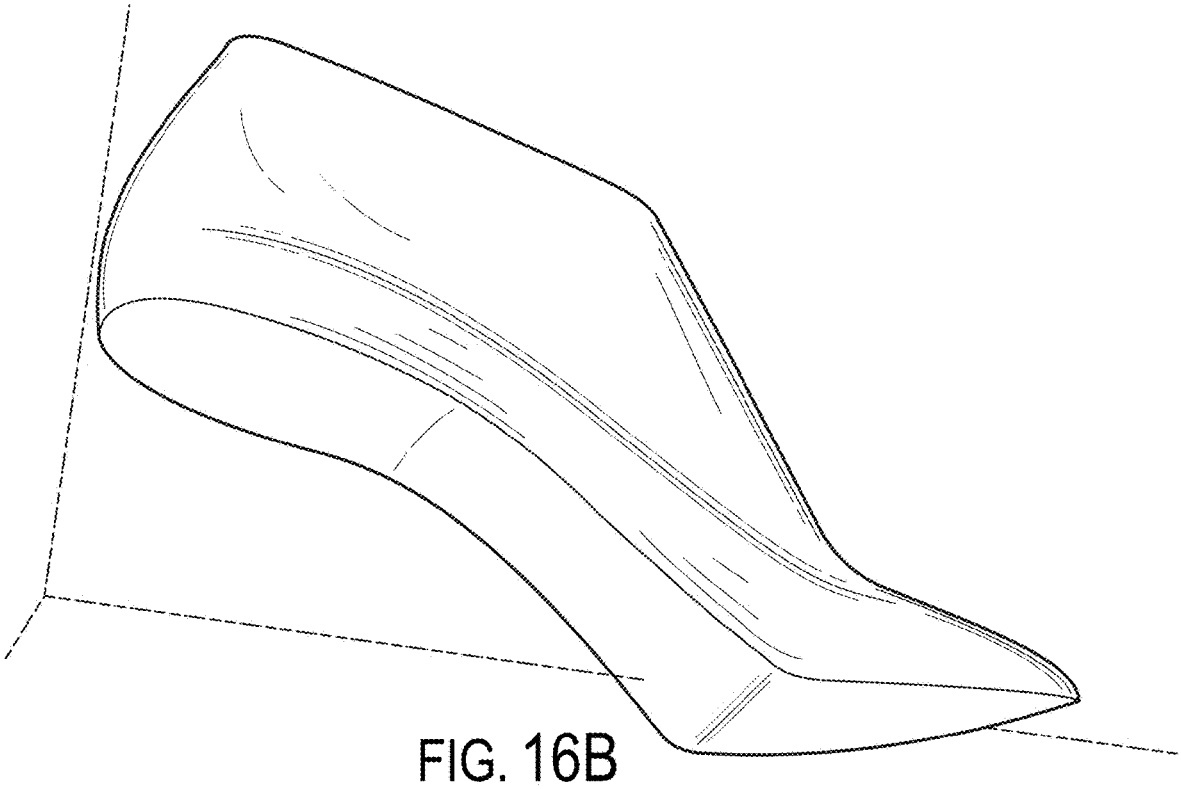
Figure 16C:
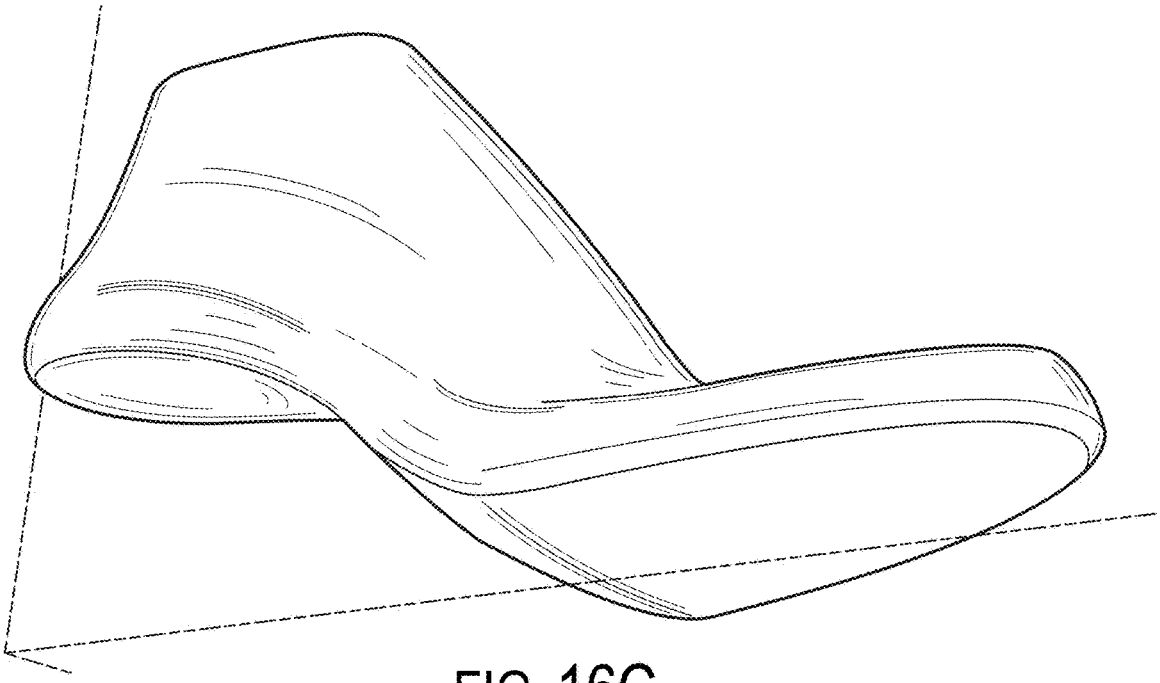
Figure 16D:
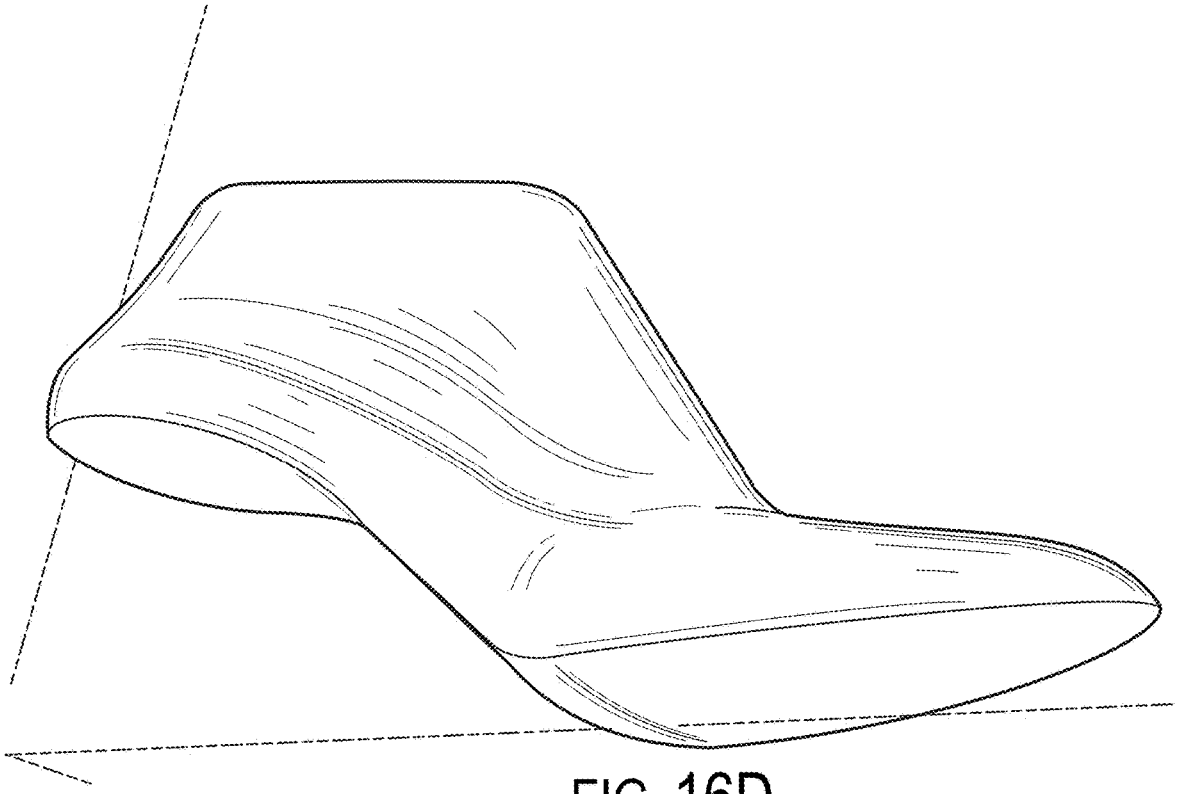

In still further aspects, the footwear last described herein can have a portion of the forefoot section distal to the footwear last ball break point that curves distally and upwardly at an angle $a_2$ to form a convex shaped portion Z along a bottom surface of the footwear last (FIGS. 12A and 12D). In such aspects, the convex-shaped portion is positioned between the footwear last ball break and a proximal end of the midfoot portion and is defined by an arc length $n_1$. This curved portion can also be observed in FIG. 16A. The generic standard last does not exhibit the curved convex-shaped portion (FIG. 16B).

In still further aspects, the disclosed herein footwear last can also form a wedge angle $a_3$ (FIG. 12C). In such aspects, a wedge angle $a_3$ is substantially identical to a wedge angle $a_3'$ (FIG. 12D) of the standard footwear last having a size substantially identical to the predetermined size and a substantially identical heel height. Yet it is understood that other aspects, where $a_3$ is greater than $a_3'$ or where $a_3$ is smaller than $a_3'$, are also contemplated and considered. It is understood that the wedge angle can also be adjusted to accommodate the disclosed lengths to the ball break point and the arch height.

In still further aspects, a projection angle $a_4$ (FIG. 12C) measured from the heel point to the ball break point is smaller than a projection angle $a_{4'}$ (FIG. 12D) measured from the heel point to the ball break point of the standard footwear last having a size substantially identical to the predetermined size and a substantially identical heel height. Yet, in still further aspects, the angle $a_4$ can be at least about 1% smaller, at least about 2% smaller, at least about 3% smaller, at least about 4% smaller, at least about 5% smaller, at least about 6% smaller, at least about 7% smaller, at least about 8% smaller, at least about 9% smaller, or at least about 10% smaller than $a_4'$.

In yet still further aspects, the disclosed herein footwear last can have an arch length (1300) (FIG. 12C) that is at least about 3%, at least about 4%, at least about 5%, at least about 6%, at least about 7%, at least about 8%, at least about 9%, or at least about 10% larger than an arch length (1300') (FIG. 12D) of the standard footwear last having a size substantially identical to the predetermined size and a substantially identical heel height. It is understood that the arch length is measured from the heel point $H_o$(or $H_o'$, for comparison) to a tread point of the last.

In yet other aspects, the arch length (1300) can be substantially identical to or greater than an arch length (1300') of the standard last having a substantially identical heel height and at least one size larger than the predetermined size. For example, the arch length (1300) of the disclosed footwear last for size 7 can be the same or greater than the arch length (1300) of the standard footwear last having a substantially same heel size but a size 8 or even 9.

In still further aspects, the disclosed herein footwear last can also be defined by a plantar arch height $a_3$ (FIG. 12C). In such aspects, the plantar arch height $a_3$ can be defined by a perpendicular distance from the highest point of the arch curve to a straight line connecting the heel point and the ball break. In some aspects, the plantar arch height as can be greater than a plantar arch height $a_3'$ (FIG. 12D) similarly measured for the standard footwear last having a substantially identical predetermined size and a substantially identical heel height. In certain aspects, as is about 3% greater, about 4% greater, about 5% greater, about 6% greater, about 7% greater, about 8% greater, about 9% greater, about 10% greater, about 11% greater, about 12% greater, about 13% greater, about 14% greater, about 15% greater, about 16% greater, about 17% greater, about 18% greater, about 19% greater, about 20% greater, about 21% greater, about 22% greater, about 23% greater, about 24% greater, or about 25% greater than $a_3'$ measured similarly for the standard last.

In still further aspects, the footwear last described herein can have a ratio of $a_2/a_3$ from about 1.6 to about 3, including exemplary values of about 1.7, about 1.8, about 1.9, about 2.0, about 2.1, about 2.2, about 2.3, about 2.4, about 2.5, about 2.6, about 2.7, about 2.8, and about 2.9 for a heel height between about 50 to about 90 mm. In yet further aspects, the ratio of $a_2/a_3$ is about 5% greater, about 6% greater, about 7% greater, about 8% greater, about 9% greater, about 10% greater, about 11% greater, about 12% greater, about 13% greater, about 14% greater, about 15% greater, about 16% greater, about 17% greater, about 18% greater, about 19% greater, about 20% greater, about 21% greater, about 22% greater, about 23% greater, about 24% greater, or about 25% greater than a ratio $a_2'/a_3'$ of the standard footwear last having substantially same heel size and substantially the same predetermined size.

In still further aspects, a ratio between $a_1/a_2$ is from about 0.7 to about 2.6, including exemplary values of about 0.8, about 0.9, about 1.0, about 1.1, about 1.2, about 1.3, about 1.4, about 1.5, about 1.6, about 1.7, about 1.8, about 1.9, about 2.0, about 2.1, about 2.2, about 2.3, about 2.4, and about 2.5 for a heel height between about 50 to about 90 mm. In yet further aspects, the ratio of $a_1/a_2$ can be about 5% less, about 10% less, about 15% less, about 20% less, about 25% less, about 30% less, about 35% less, about 40% less, about 45% less, or about 50% less than a ratio of $a_1'/a_2'$ of the standard footwear last having substantially same heel size and substantially the same predetermined size.

Figure 12F:
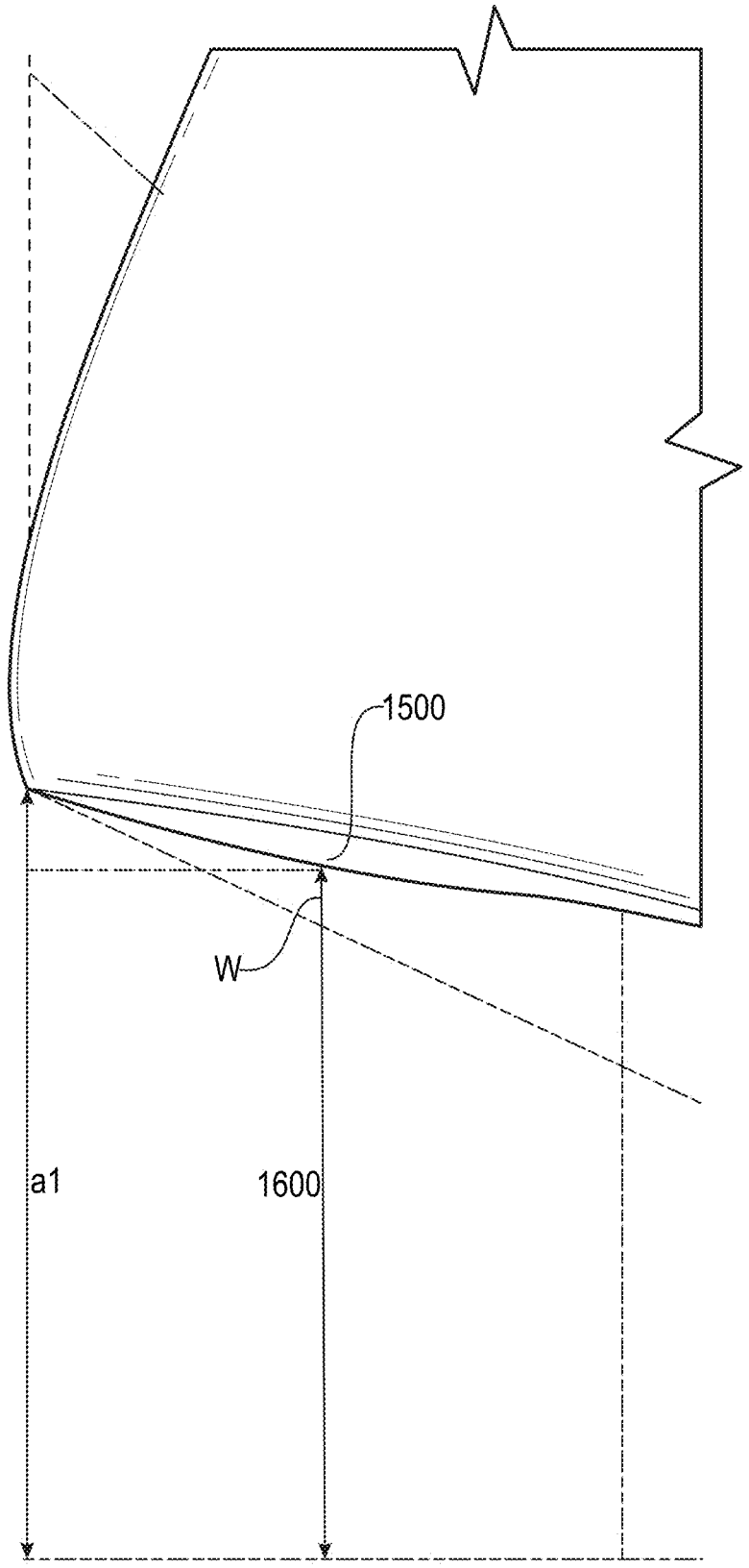
Figure 12G:
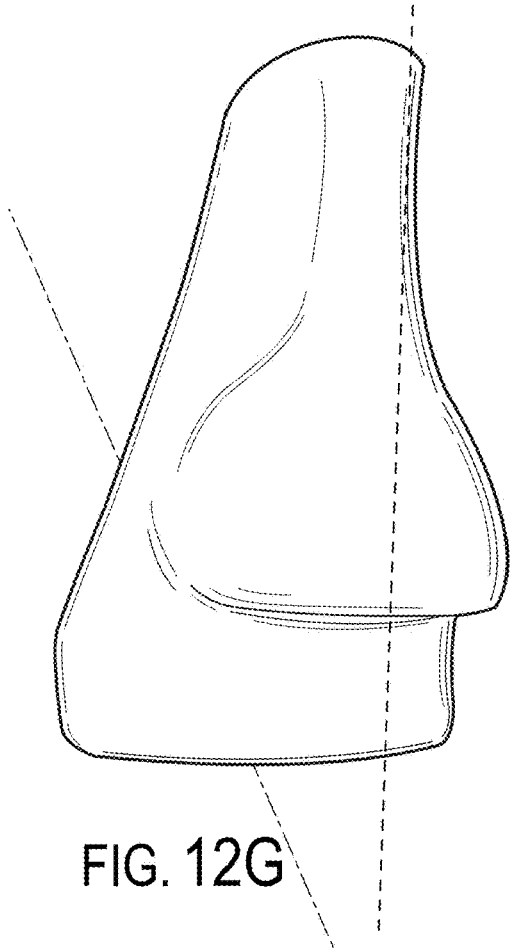

In still further aspects, the disclosed herein footwear last can have at least a portion of the hindfoot section that is convex-shaped (W) (FIG. 12F). This convex-shaped portion can be specifically incorporated to form a cradle-like arrangement in a footwear article formed upon the disclosed herein footwear last that would allow receipt of a wearer's heel. In yet still further aspects, the convex-shaped portion of the hindfoot section of the last is configured to form a concave portion in a hindfoot section of a footwear article formed upon the footwear last. This convex-shaped portion of the hindfoot section can also be seen in FIG. 12G.

Figure 12H:
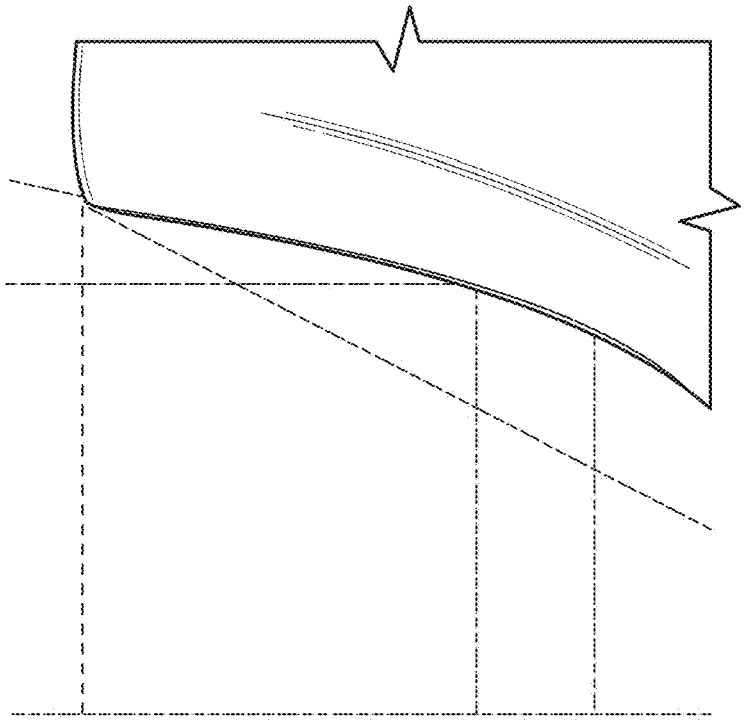

In some aspects, an apex (1500) of at least a portion of the hindfoot section having the convex-shaped portion is a midportion of the hindfoot section. In still further aspects, a length (1600) from the apex (1500) of the convex-shaped portion to the ground plane is from about 2 mm to about 10 mm, including exemplary values of about 3 mm, about 4 mm, about 5 mm, about 6 mm, about 7 mm, about 8 mm, and about 9 mm shorter than $a_1$. In still further aspects, the length (1600) from the apex of the convex-shaped portion to the ground plane is from about 1 mm, about 2 mm, about 3 mm, about 4 mm, or even about 5 mm lower than a length (1600') between a midportion of a hindfoot section of the standard footwear last having a substantially identical predetermined size, and a substantially identical heel height (FIGS. 12F and 12H).

Figure 13:
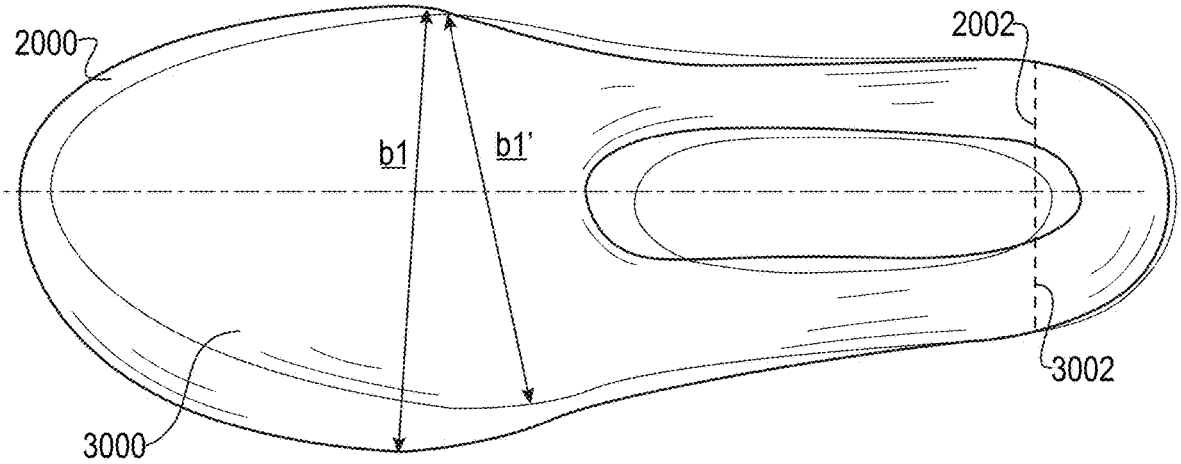
FIG. 13 shows a bottom portion of an exemplary last (2000) in one aspect and a standard last (3000) having a substantially identical predetermined size and a substantially identical heel height in a different aspect.

In still further aspects, a bottom portion of the forefoot section, as shown in FIG. 13, can be defined by a first point representing the first metatarsophalangeal joint of a foot and a second point representing the fifth rnetatarsophalangeal joint of a foot. An imaginary line on the base of the last between the first and second points is known as the bottom support surface or tread point and corresponds to the ball of a foot, FIG. 13 shows the overlapping images of the disclosed herein last (2000) and a standard last (3000).

In some aspects, this imaginary line can be drawn between the widest portions of the footwear last. In some aspects, this imaginary line can also define a ball width. In certain aspects, the ball width $b_1$ of the disclosed herein footwear last is at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, or at least about 20% greater than a ball width $b_1'$ in the standard footwear last having a substantially identical predetermined size and a substantially identical heel height.

In yet still further aspects, the ball width $b_1$ can be from about 85 mm to about 95 mm, including exemplary values of about 86 mm, about 87 mm, about 88 mm, about 89 mm, about 90 mm, about 91 mm, about 92 mm, about 93 mm, and about 94 mm.

In yet still further aspects, the hindfoot section of the disclosed herein footwear last can have a heel width (2002) substantially identical to a heel width (3002) of the standard footwear last having a substantially identical predetermined size and a substantially identical heel height (FIG. 13).

Figure 14:
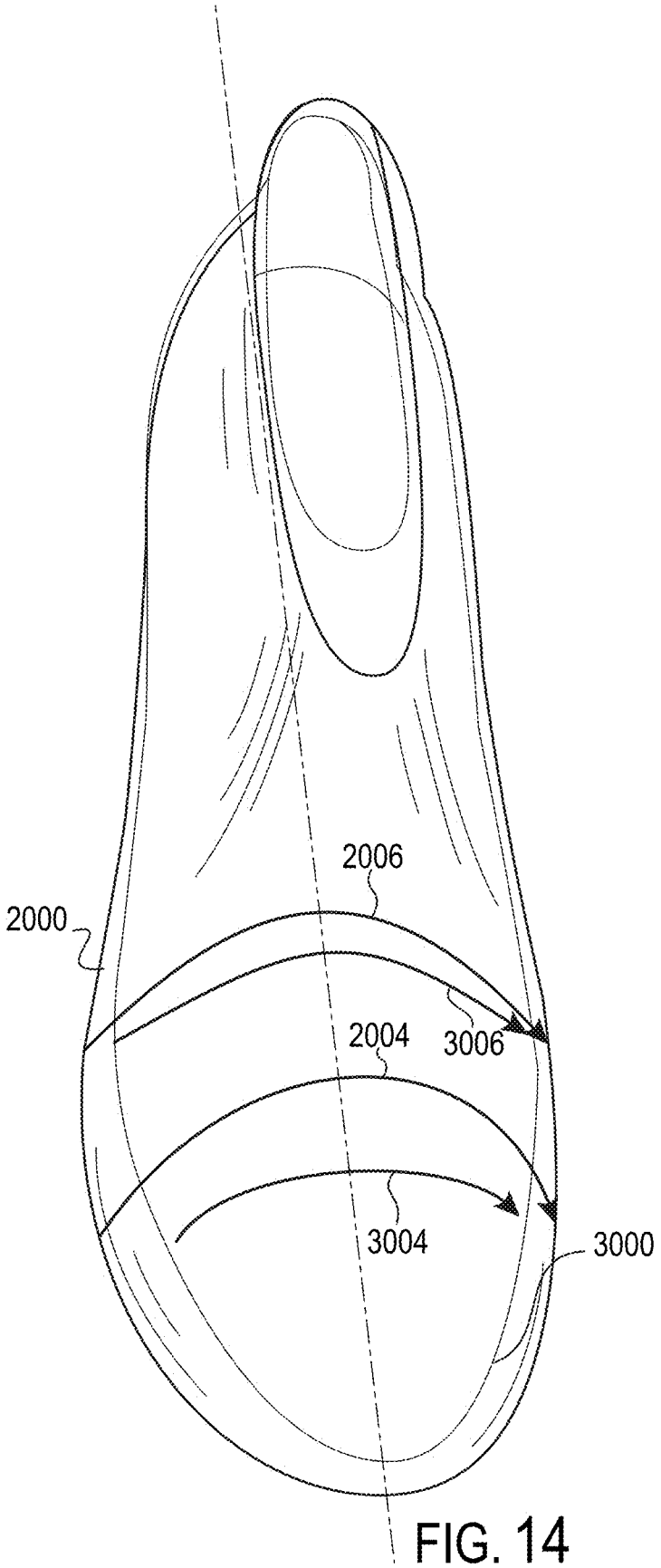
FIG. 14 shows a top portion of an exemplary last (2000) in one aspect and a standard last (3000) having a substantially identical predetermined size and a substantially identical heel height in a different aspect.

In still further aspects, the circumference of the last between these first and fifth metatarsophalangeal joints of a foot is known to define the ball girth (2006) for the disclosed last or (3006) for the standard footwear last having a substantially identical predetermined size and a substantially identical heel height (FIG. 14). In still further aspects, the ball girth of the disclosed herein footwear last is at least about 2%, at least about 3%, at least about 4%, at least about 5%, at least about 6%, at least about 7%, at least about 8%, at least about 9%, at least about 10%, at least about 11%, at least about 12%, at least about 13%, at least about 14%, or at least about 15% greater than a ball girth of the standard footwear last having a substantially identical predetermined size and a substantially identical heel height.

In still other aspects, the ball girth (2006) and toe girth (2004) are larger than those ((3006) and (3004)) used in standard lasts having a substantially identical predetermined size and a substantially identical heel height.

It is understood that in the aspects disclosed herein, the mid-instep girth and waist girth can be used interchangeably. In certain aspects, the mid-instep girth of the disclosed herein footwear last is smaller than the mid-instep girth of a standard last having a substantially identical predetermined size and a substantially identical heel height. In such aspects, a more snuggling arrangement for the wearer's foot can be achieved. In certain aspects, the mid-instep girth of the disclosed herein footwear last is substantially the same as the mid-instep girth of a standard last having a substantially identical predetermined size and a substantially identical heel height. Yet, in still further aspects, the mid-instep girth of the disclosed herein footwear last is greater than the mid-instep girth of a standard last having a substantially identical predetermined size and a substantially identical heel height.

Figure 15:
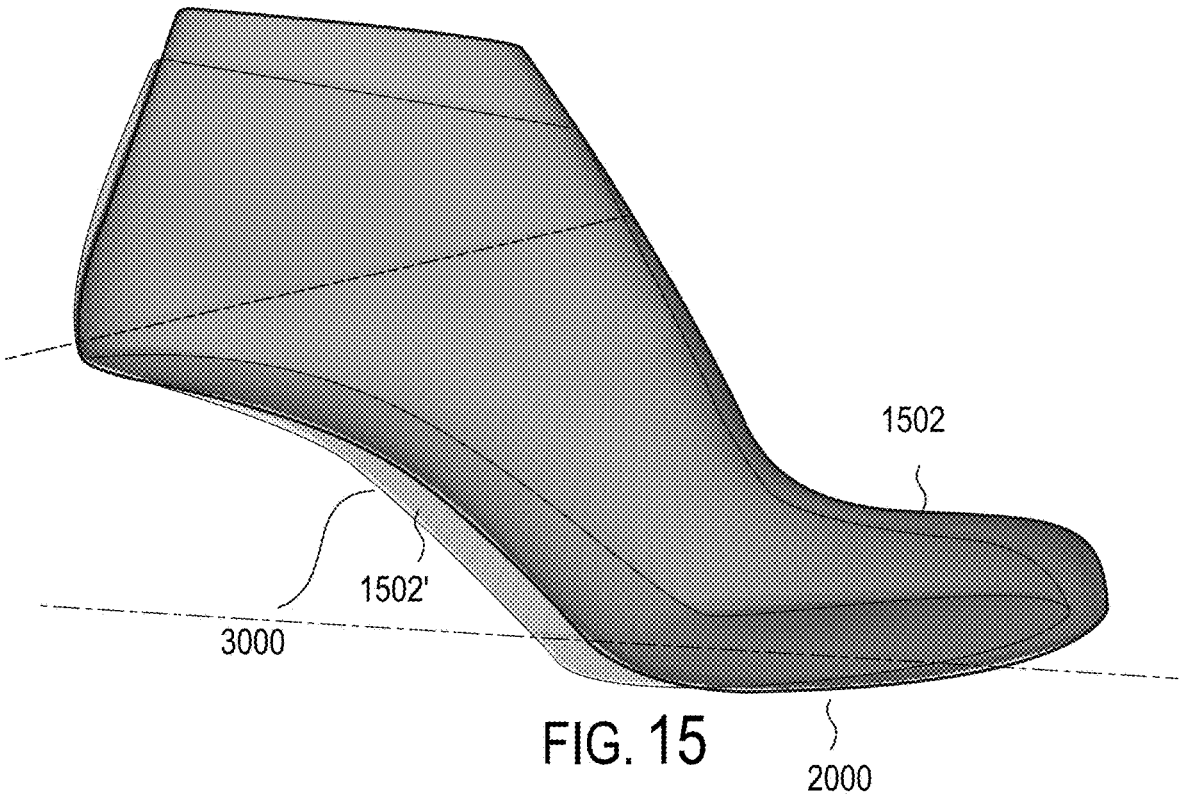
FIG. 15 shows an overlapping schematic of an exemplary last (2000) in one aspect and a standard last (3000) having a substantially identical predetermined size and a substantially identical heel height in a different aspect.

FIG. 15 shows a schematic of overlapping lasts (the disclosed herein last (1502) and the standard last (1502')) that even further highlights the differences in the last construction.

Figure 17:
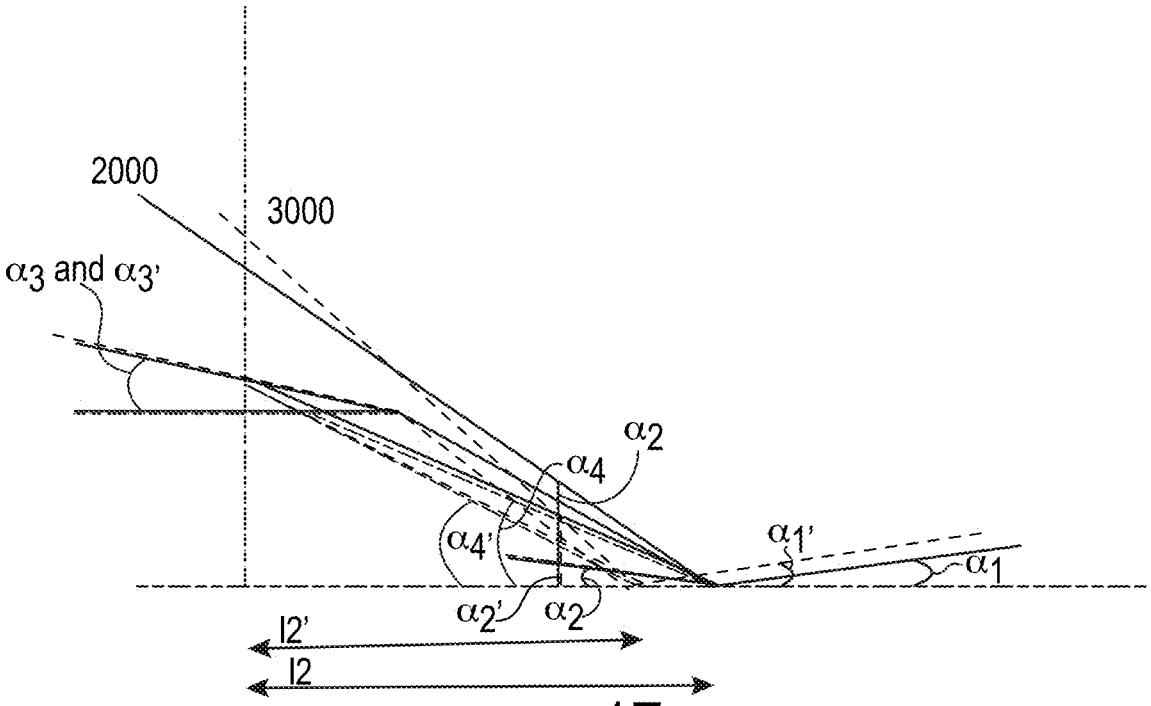
FIG. 17 shows differences between an exemplary last (2000) (solid line) in one aspect and a standard last (3000) (dashed line), having a substantially identical predetermined size and a substantially identical heel height in a different aspect.

Additional comparisons of the two lasts can be seen in FIGS. 16A-16D. FIG. 17 shows the line projection of the disclosed above differences between the two lasts.

In still further aspects, the footwear last disclosed herein can have a future insole insert thickness incorporated within the various last proportions. In yet other aspects, the footwear last does not comprise a future insole insert incorporated in the various last proportions.

In certain aspects, the footwear last described herein results in a footwear article that provides for improved comfort when compared to footwear resulting from a standard last having a substantially identical predetermined size and a substantially identical heel height. In certain aspects, the footwear last is configured to form a footwear article where when a foot is inserted in the footwear article, substantially no space is formed between behind a ball of the foot and a footbed of the footwear article. Yet, in other aspects, the footwear last is configured to form a footwear article where when a foot is inserted in the footwear article, substantially no space is formed along a lateral length of the foot. These features allow additional comfort for the wearer's foot by reducing pressure and strain behind the ball of the foot.

In still further aspects, the footwear last is configured to be graded to a standard shoe size between 5 and 11.

Shoe Structure

Also disclosed herein is a footwear article that is formed with the disclosed herein footwear last. In some aspects, the footwear article comprises a) a lasting board, b) an upper, and c) an outsole. In yet still further aspects, the footwear article further comprises a heel having a heel height of at least 50 mm. In still further aspects, the lasting board and the upper of the footwear article are formed directly onto the footwear last disclosed herein.

In still further aspects, the heel height can be about 50 mm to about 110 mm, including exemplary values of about 55 mm, about 60 mm, about 65 mm, about 70 mm, about 75 mm, about 80 mm, about 85 mm, about 90 mm, about 95 mm, about 100 mm, and about 105 mm.

Figure 1B:
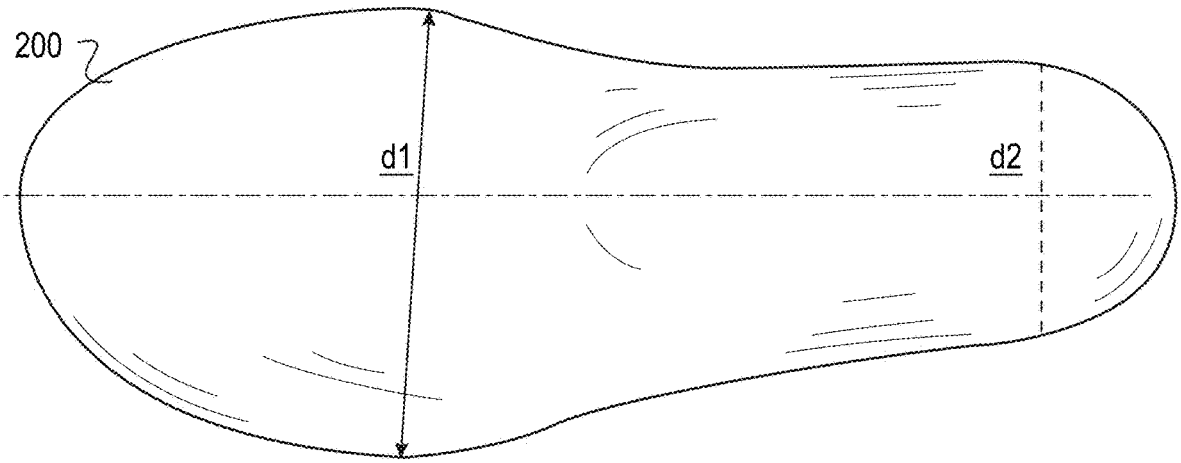

In still further aspects, a toe-box portion of the footwear article is defined from a ball width to a toe point of the footwear article. In some aspects, the toe-box portion width is substantially identical to the ball width of the last. In yet other aspects, the toe-box portion width is greater than the ball width of the last. In some aspects, the toe-box (200) width $d_1$ (FIG. 1B) is at least about 5% greater than a length $d_1'$ of a reference footwear article (not shown) formed onto the standard footwear last having a substantially identical predetermined size and a substantially identical heel height. In yet still further aspects, $d_1$ is at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, or at least about 20% greater than a ball width of a reference footwear article formed onto the standard footwear last having a substantially identical predetermined size and a substantially identical heel height.

In still further aspects, a heel portion of the footwear article is defined by the hindfoot section of the footwear last and comprises a concave portion configured to receive a heel of the wearer in a cradle-like arrangement. In still further aspects, the heel portion has a heel width $d_2$ that is substantially identical to a heel width $d_2'$ of the reference footwear article formed onto the standard footwear last having a substantially identical size and a heel height.

In some aspects, a ratio of the $d_1$ to $d_2$ is greater than about 1.5 to about 1.8, including exemplary values of about 1.55, about 1.6, about 1.65, about 1.7, and about 1.75 for a standard width shoe size.

In still further aspects, the $d_1$ is substantially independent of a toe-box shape, wherein the toe-box shape is selected from a round shape, a square shape, or a pointed shape. It is understood that the ratio of the width $d_1$ of the toe box to the width of the heel portion $d_2$ falls within the disclosed range regardless of whether the shoe has a round shape, a square shape, or a pointed shape.

In still further aspects, when a foot is inserted in the footwear article disclosed herein, substantially no space is formed between behind a ball of the foot and a footbed of the footwear article.

In still further aspects, the width $d_1$ is effective to provide substantially free movement of proximal and intermediate phalanges of the wearer's toes during normal wear. Yet, in still further aspects, the width $d_1$ is effective to accommodate a change in a foot shape due to prolonged wear or a temperature change.

In aspects disclosed herein, the heel of the footwear article can have any shape known in the art. For example, and without limitations, the heel can have a shape of a wedge, stiletto, Louis, Spanish, Dutch, Hooked, Cuban, and the like.

In some aspects, the footwear article is a high-heel or pump. In other aspects, the footwear article is a shoe, sandal, mule, or boot.

In still further aspects, the toe box portion of the disclosed herein footwear article is substantially identical to a toe box portion of a standard athletic shoe having a substantially identical foot size. In yet still further aspects, the footwear article disclosed herein is a hybrid between an athletic shoe and a high-heel shoe.

In one aspect disclosed herein, the footwear article is a hybrid shoe providing a comfortable and stylish nexus between athletic and high-heel shoes. In other words, the disclosed herein hybrid shoe combines comfort with style.

The disclosed herein footwear article is a stylish hybrid shoe comprising a) an upper structure, b) an insole board, c) a midsole, and d) an outsole. Again, it is emphasized that the terms "insole board" and "lasting board" can be used interchangeably. In still further aspects, the disclosed herein hybrid shoe can also comprise an insole.

In certain aspects, the upper can comprise one or more layers of a material. In still further aspects, each of the one or more layers comprises the material that is the same or different. In still further aspects, the material used to form the upper can comprise natural or synthetic leather, a polymeric material, natural material, a mesh, a rigid material, bamboo, silicone, or any combinations thereof. In yet still further aspects, the upper can be the same or different along various portions of the footwear article.

In some aspects, the upper of the disclosed herein shoe can be formed from any material suitable for the desired application. In certain aspects, the upper can be formed from a plastic, fabric, knit, mesh, leather, or a combination thereof. It is understood that if the upper comprises a textile material, it can comprise natural fibers, synthetic fibers, or any combination thereof. It is further understood that the leather, if used, can also be naturally sourced leather or synthetic leather, or any combination thereof, depending on the desired design, performance, etc. Any known in the art materials that are applicable to the desired design can be utilized. Again, the specific materials can be chosen depending on the desired application. For example, if needed, the designed shoe can be adjusted to a specific environment (warm or cold). In some aspects, the upper material can be designed to provide the desired comfort, breathability, sweat absorption, cooling, and/or heating effects. In still further aspects, the upper structure is a performance upper structure. In such exemplary and unlimiting aspects, the materials chosen to form this exemplary upper structure are fitted to the desired performance to adjust for a shoe weight, breathability, and the like.

In still further aspects, the upper can possess a degree of stretchability that allows the material to stretch when the wearer's foot is inserted and return to the original design shape when the foot is fully inserted. In still further aspects, the upper material can be a material configured to adapt to some of the foot changes during prolonged wear without visuals of the diminished quality. In still further aspects, the upper material is configured to return to the original shape/stretch when the foot is removed. In still further aspects, the desired stretchability can be balanced by the desired resistance of the fabric (or any other material that is used to form the upper) to allow the upper part to snuggle around the foot without losing fit from prolonged use. In still further aspects, the desired resistance of the fabric can also ensure the desired durability of the shoe.

In still further aspects, the upper can be any known in the art fabrics suitable for the desired performance or application. While in still further aspects, the fabric can comprise synthetic fibers, natural fibers, or a combination thereof. In yet further aspects, the upper can have portions that are not comprised of the fabric. In still further aspects, the upper can comprise leather, plastic material, etc.

In still further aspects, the upper can comprise one or more layers. In such aspects, each layer can be chosen depending on the specific performance and its positioning on the shoe. For example, in some portions of the upper, the material can comprise one or more layers, wherein each of the layers can comprise the same or different material. For example, some layers can comprise resilient materials, mesh, stretchable materials, water-resistant materials, shock preventive materials, paddings, and the like, as further discussed below.

In some exemplary and unlimiting aspects, the one or more layers of the upper comprise padding layers. In such aspects, the padding can be made from a foam, a rubber, or any other soft material. In exemplary aspects, where the padding exists, the padding can be selectively placed in various portions of the upper. The padding can be disposed in portions of the upper that correspond with predetermined portions of the foot. The selective placement of the padding can provide protection for certain portions of the foot and increase the strength and durability of the upper.

In still other aspects, the padding can be added in the toe box portion of the shoe or around the lining to ensure comfort in places where the shoe is in contact with the skin of the wearer, around the heel of the wearer, on the side portions of the shoe, and the like, or any combination thereof.

In yet other aspects, the upper can be formed as a unitary construction comprising, for example, a textile material. In such aspects, the textile material is formed or otherwise shaped to extend around the foot. It is understood that a unitary construction can be referred to as construction where various portions of the upper are not joined together by seams or other connections. It is understood, however, that various edges of the upper and/or when additional layers are present, those can be joined together with the seams. In still further aspects, the upper can be formed on a wide-tube circular knitting machine. In certain aspects, the upper can be any upper having a 3D knit. In certain aspects, the upper can be a material sold under the tradename of Flyknit.

In certain aspects, the upper has an outer surface and an inner surface. The outer surface of the upper represents the visible portion of the shoe. In still further aspects, a lining can be coupled to the inner surface of the upper. In still further aspects, the inner surface of the upper and/or lining, if attached to it, defines, together with the insole board, an inner compartment of the shoe that is configured to receive the foot. In certain aspects, the lining can be comprised of any known in the art materials suitable for the desired application. In still further aspects, the lining can also comprise one or more layers. In still further aspects, the lining can be disposed along the entire inner surface of the upper. Yet, in other aspects, the lining can only be positioned on the predetermined portions of the inner surface of the upper, depending on the desired shoe performance. For example, and without limitations, the lining in various portions of the inner portion of the shoe can be comprised of different materials depending on the function of the specific portion. For example, the side portions of the lining can comprise stretchable, breathable materials that can be water-resistant, antimicrobial, and configured to adjust to different levels of sweat. While in other aspects, the lining that is positioned on the edges of the shoe, for example, on a topline portion of the shoe that provides the finishing to the shoe's internal compartment, can be made of a material that is soft and non-irritating, especially if this portion of the shoe is in frequent contact with the wearer' skin. In still further exemplary aspects, the padding added along the topline of the back of the shoe can provide an increased comfort along the edge of the shoe and increase the support of the heel of the foot in the shoe to reduce the heel from sliding and/or lifting.

In certain aspects, the lining can be a stretch lining that allows for no center back seam, which is sometimes a high impact/irritation point. In still further aspects, a topline seam can be dropped to the external portion of the shoe to allow the lining to run seamlessly along the topline of the shoe to reduce irritation. In some exemplary aspects, a cut shape can give more lateral and medial support. In still further aspects, the finishing of the topline can be done such that the padded lining extends to at least a portion of the outer surface of the upper to allow better cushioning along the topline of the shoe.

In still further aspects, the upper of the disclosed herein footwear article can have additional design features. In such aspects, for example, the design features can be configured to provide an illusion of a narrower toe box than it actually is. It is understood that the toe box of the disclosed herein footwear article is wider than a standard toe box of the high-heel footwear article and, in some aspects, is configured to substantially resemble a toe box of the athletic shoe. Therefore, in some aspects, it is desirable to provide an illusion that the toe box is not as wide. In such exemplary aspects, additional design features, including material, seams, and edges, can be oriented longitudinally in the direction from toe to heel along the upper in the area of the toe box to create an illusion of a narrower foot without compromising comfort. In still further aspects, an additional hidden internal insert that can be activated by a hot melt/heat transfer can protect the foot from feeling bar tacks while also helping secure the stitch that is necessary to hold the webbing in place. In certain aspects, webbing can be used to help create structure and secure the laces for a better fit. Without wishing to be bound by any theory, it is assumed that this additional stabilizer can protect the foot from feeling the rough texture of the stitching while also reinforcing the stitch from being pulled out when the wearer tugs on their laces.

In still further aspects, the upper can comprise additional layers that can have aesthetic and/or branding purposes. In yet other aspects, the upper can comprise safety features. For example, the upper can comprise a feature that can provide reflective effects and be seen in the dark and/or at night.

In still further aspects, the various layers and components of the upper can be attached to each other by any known in the art and suitable methods. For example, the various layer and components can be stitched, adhesive bonded, embossed, molded, cemented, welded, or otherwise formed to define together with the insole board the inner compartment configured to receive the foot.

Figure 2:
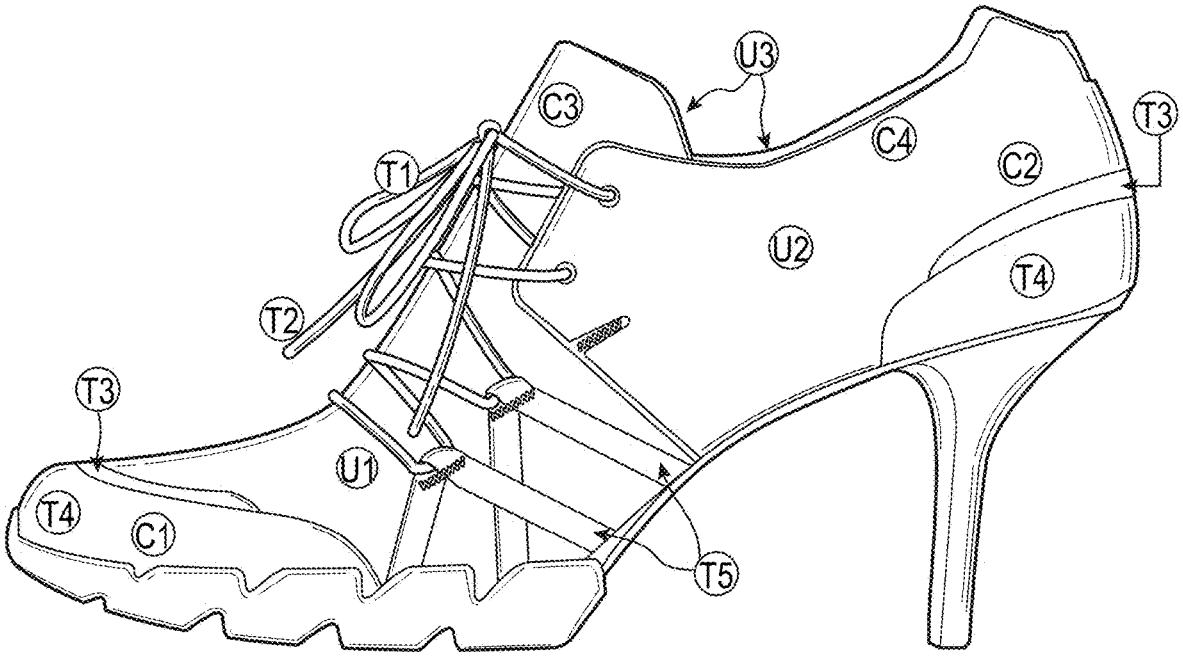
FIG. 2 depicts an exemplary design of the disclosed herein hybrid shoe in another aspect.
Figure 3:
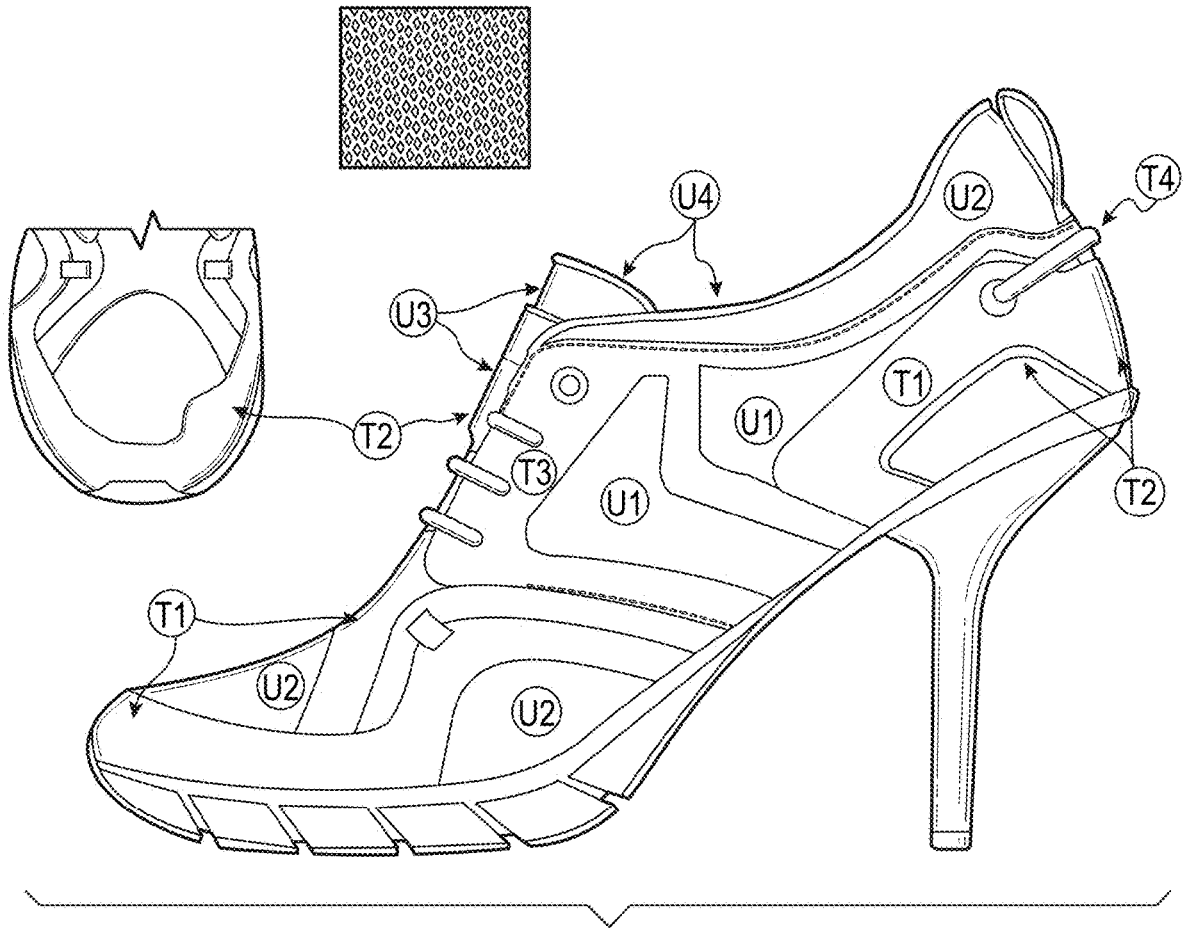
FIG. 3 depicts an exemplary design of the disclosed herein hybrid shoe in another aspect.

Some exemplary upper portions are shown in FIGS. 1A and 2-4. It is understood that the specific material can be placed in various portions of the upper, depending on the desired design. For example, as shown in FIGS. 2 and 3, different portions of the upper can have different materials. The upper shown in FIG. 2 has U2 material placed on the side back portions of the shoe, wherein U2 can comprise, for example, and without limitation, 1.35 mm thick polyurethane with microfiber back, and U1 can comprise, for example, and without limitation, a 3 mm or less space mesh material. Again, it is understood that these specific materials are only exemplary and can be chosen depending on the desired performance of the shoe. Again, as discussed in detail herein, the specific positioning of the materials can be dependent on the desired performance. For example, in some aspects, the use of thermoplastic polyurethane (TPU) can provide for increased resistance to scuffing and increased durability at high wear points.

It is further understood that any desired finishing can be applied to the upper. The finishing can provide utility or can be done for branding or aesthetic purposes only. The utility can include water-resistant coating, anti-scratch coatings, reflective coatings, antimicrobial coating, spotting-resistant coating, and the like. In still further aspects, the specific finishing can also be dependent on the desired performance of the shoe component. In some aspects, for example, and without limitations, the materials having reflective properties can be positioned on the front of the shoe and a heel portion of the shoe for increased visibility.

In still further aspects, the upper can comprise one or more materials that are configured to provide additional stability to the shoe. In some aspects, the upper can comprise a heel counter. In such aspects, the heel counter can comprise a plastic material that can be molded to provide rigidity to the heel portion of the shoe and thus to improve the stability of the shoe. In yet other aspects, the heel counter can be positioned between the inner and outer layers of the upper. In still further aspects, the heel counter can extend to side portions of the shoe adjacent to the heel portion of the shoe. It is understood that the heel counter can provide the desired lateral and back stability of the shoe and prevent ankle rolling and twisting. In still further aspects, the front portion of the shoe can also comprise a toe puff or, as it can be sometimes referred to as, a toe box counter. In such aspects, the toe puff or the toe box counter can have a predetermined rigidity. However, it is understood that in the stylish hybrid shoe described herein, the toe puff or the toe box counter exhibits rigidity that is less than the rigidity of the heel counter. In further aspects, the toe box counter or the toe puff can be positioned between the outer and inner layers of the upper. Various positioning and types of heel counters and toe box puffs (or toe box counters) are discussed below. In some exemplary and unlimiting aspects, the heel counters and toe box puffs can comprise polymeric materials or any other materials that can be thermally activated and have the desired rigidity. In such aspects, these materials having a predetermined shape can be inserted between the upper and the lining and then thermally activated and molded or cemented within the shoe when the shoe is positioned on the last to obtain the desired rigidity. It is understood that the predetermined shape can be selected based on the desired design and performance, such as the desired flexibility and comfort. It is understood, and as discussed below, that the heel counter materials can be thicker and have higher rigidity than the toe box puffs materials. In still further aspects, the heel counter materials and the toe box puff materials can be the same or different.

The exemplary upper, as shown in FIG. 3, has U1 positioned on the side portions of the shoe, while U2 is positioned in the toe box and the heel counter portion of the shoe. U1 and U2 in FIG. 3, for example, and without limitation, can comprise a performance textile. In some aspects, the performance textile can comprise mesh fabrics. In still further aspects, the textiles used to form the upper can comprise nylon, polyester, spandex, cotton, or a combination thereof. In still further aspects, the upper can comprise one or more of natural fibers or recycled fibers. For example, and without limitations, the natural fibers can comprise leather, cotton, organic cotton, wool, bamboo, and fibers obtained from pineapple, cactus, grapes, apple, vegetables, corn, or other bio-sourced compounds. In yet other aspects, the recycled fibers can comprise recycled polyesters, for example, such as PET, recycled nylon, polyester, Lycra (polyether-polyurea based copolymer), cotton, and the like. In still further aspects, the upper can comprise polyethersulfone (PES), polyethylene terephthalate (PET), polyamides, polyurethane, various adhesives, bio-based polyurethane leather, various dyes, and the like.

U3, as shown both in FIGS. 2 and 3, identifies a lining portion of the upper. The lining portion of the upper can comprise, for example, and without limitation, a brushed polyester interlock, 200 gm with a permanent antimicrobial finish. In still further aspects, the lining can also comprise spandex fibers, nylon, cotton, leather, any suitable synthetic materials, or any combination thereof. It is further understood that the desired fabric can be selected based on the desired application. In still further aspects, the desired fibers can be selected based on breathability, style, lightweight, water repellence, water adsorption, and/or performance. It is also understood that the degree of breathability, lightweight, water repellence, water adsorption, and/or performance can be varied along various portions of the upper of the shoe. The upper can also have various structures. For example, and without limitations, the upper can have a twill material.

In still further aspects, the lining can provide moisture management properties. For example, and without limitation, the lining can be formed of a moisture-absorbent material. In such exemplary aspects, the lining can wick sweat away from a wearer's foot, while in other exemplary aspects, the lining can be water repellant. In yet still further aspects, the lining can be smooth, non-irritative, and non-abrasive. In yet further aspects, the lining can also comprise some padding if, for example, more comfort around the wearer's foot is desired. In still further aspects, the lining material can comprise antimicrobial agents, antiperspirant agents, smell-reducing agents, and the like.

Also shown in FIGS. 2-3 are additional components of the shoe. For example, U4 in FIG. 3 relates to a tongue fabric. As shown in FIG. 2, the tongue can also be padded (C3). In this exemplary and unlimiting aspect, the padding can comprise an open-cell polyurethane (PU) foam of various thicknesses. In some aspects, the padding foam can be about 4-5 mm. FIG. 2 also shows a possibility of additional paddings on the side portion of the shoe (C4). In this exemplary aspect, the padding C4 can also comprise open-cell PU foam padding having a thickness of about 7-8 mm. C2, as shown in FIG. 2, relates to a heel counter and can also comprise any of the disclosed herein paddings. It is understood that the padding on the tongue can be added to increase the wearer's comfort. In yet other aspects, the padding of the tongue can soften the tension from the straps, laces, or any other fasteners used in the shoe.

In yet still further aspects, instead of a traditional shoe tongue, the disclosed herein footwear article can have an elastic fabric that is configured to provide enough pressure on the foot to allow it to stay in place and to move within the shoe. In yet still further aspects, the footwear article can comprise a strap, going across the tongue fabric or across the described herein elastic fabric to further assist in holding the shoe in place. It is understood that the strap can be provided as an elastic or flexible material and as one piece. In such aspects, in order to insert the foot, the wearer of the shoe can just pull the strap aside. Yet, in other aspects, the strap or any other fastener can be added to be removably attached to one or both sides of the shoe. In such aspects, the strap can be a Velcro® strap or a strap with hooks and loops and the like. In yet other aspects, the footwear article can have one or more straps. In still further aspects, the strap can be positioned on the tongue of the shoe. It is understood that this positioning of the strap is exemplary, and the strap can also be positioned in other locations on the shoe to ensure a comfortable fit.

The shoes disclosed herein can also have various trims. Again, the trims disclosed below and shown in the figures are exemplary only and are not limiting. It is understood that the specific trims can be chosen based on the desired design and application. The trims and finishes shown in FIG. 2 comprise lace T1, matte silicone dipped lace top T2, a reflective heat transfer thermoplastic polyurethane (TPU) (T2) having any desired thickness (for example, 0.8 mm); a 1.2-1.4 mm heat transfer TPU with matter leather grain texture (T4), an 8 mm wide smooth nylon webbing with a twill finish. The exemplary shoe shown in FIG. 2 further comprises a toe puff (C1) made with a substantially thin TPU material with a skived edge. In such exemplary and unlimiting aspects, the TPU material can have a thickness from about 1 mm to about 3 mm, including exemplary values of about 1.2 mm, about 1.5 mm, about 1.8 mm, about 2 mm, about 2.2 mm, about 2.5 mm, and about 2.8 mm.

The exemplary shoe shown in FIG. 3 can have trims as disclosed below: T1 can be a heat embossed TPU material; T2 can be a reflective embossed material, such as, for example, a reflective TPU; and T3 and T4 can also comprise various embossed materials, such as embossed TPU. It is further understood that the embossing can be done with heat or without heat.

It is further understood that the disclosed above details and trims are exemplary only, and the positioning of the various components can be dependent on the specific design and application. It is also understood that the shoe can have any known in the art lace configurations and designs. It is also understood that in some aspects, the shoe does not comprise laces. In some exemplary aspects, the laces can have only a decorative purpose.

In still further aspects, the footwear article can comprise a member configured to hold a foot of the wearer in place and prevent sliding of the foot.

In still further aspects, other fasteners can be utilized, such as, for example, hooks, buttons, knobs, buckles, snap fasteners, hook-and-loop fasteners, zippers, elastic strips, magnets, Velcro, or any combination thereof. In still some other aspects, the footwear article described herein can comprise straps that allow the shoe to stay in place. In still further aspects, the straps and other fasteners can be made of any known in the art materials, for example, and without limitation, fabric, leather, elastic, nonwoven, or any combination thereof.

In some exemplary aspects, the embossed edge and eyelet detail help reinforce potential tear areas and give a textural difference between the matte PU and the semi-shine due to the embossing processes. In some exemplary aspects, the perforated medial quarter can allow for breathability in the highest sweat. In yet still further aspects, the mesh vamp panel can allow for breathability for the largest portion of the foot. In some aspects, the PU padding along the top of the tongue can help soften the tension from the laces and help insert the foot into the shoe. Yet, in some aspects, the PU padding along the topline of the back of the shoe can provide an increased comfort along the edge of the shoe and help increase the support of the heel of the foot in the shoe.

In still further aspects, the toe box of the shoe disclosed herein is designed to provide comfort to the wearer's toes and upper portion of the foot, similar to an athletic shoe, without the pressure and squeeze commonly present in a high-heel shoe. In some aspects, the toe box is defined by a height and a width. In certain aspects, the desired ratio can be determined based on the specific application. It is understood that the toe box of the current hybrid shoe is bigger and more spacious than the toe box of the common high-heel shoe. In aspects described herein, the toe box of the shoe is designed to allow the toes to move and wiggle and provide enough space for a possible change in the toe shape due to prolonged wear or temperature change (for example, swollenness due to hot weather, prolonged standing or sitting). In still further aspects, the toe box is designed such that the toes are substantially not in contact with the upper. While in other aspects, the toe box is designed to have the toes substantially in contact with the upper. In yet further aspects, the toe box is designed to provide the desired ratio between the toe box's height and width and provide the comfort usually not present in the common high-heel shoe.

In still further aspects, the upper of the toe box portion of the disclosed herein footwear article, whether it is the hybrid shoe or any other shoe that can be formed on the disclosed last can be substantially different from the upper of the heel portion. Yet, in other aspects, the upper can be substantially the same on the toe box portion and the heel portion of the footwear articles. In certain aspects, a toe point area of the toe box portion can comprise a toe box counter.

Figure 4:
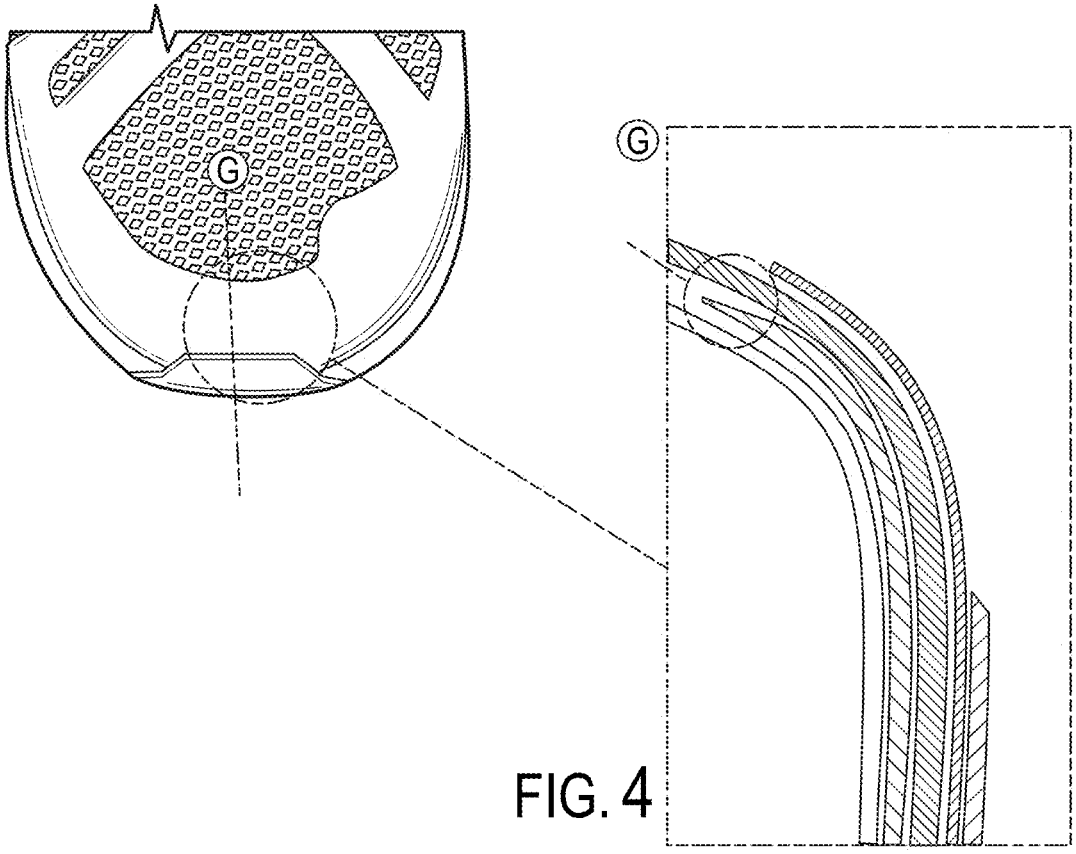
FIG. 4 depicts a close-up and more detailed description of an exemplary toe-puff in one aspect.

FIG. 4 shows a schematic for the upper in the toe puff portion and for the toe puff portion itself. The upper of the toe puff portion, for example, can comprise a polyester interlock liner, poly air mesh, and the like. For example, the toe puff portion can further comprise polyester, polyurethane, nylon, mesh, leather, cotton, rayon, bamboo, modal, injection-molded or die-cut TPR materials (or any other types of TPR materials known in the art and suitable for the desired application), composite material, metals, or metal alloys, or any combination thereof. The thickness of the mesh can be, for example, around 3 mm. The toe puff portion can also comprise no-sew TPU hotmelt, for example, with a thickness of about 0.8 mm to about 1.2 mm. However, these values are exemplary only, and in certain aspects, the thickness of the layers can be greater or lower than the disclosed above values. For example, the thickness of the poly air mesh or any other compatible material can be less than 3 mm, less than 2.5 mm, or less than 2 mm. While in still further aspects, the thickness of the poly air mesh or any other compatible material can be about 2 mm or less. In yet further aspects, the thickness of the TPU hot melt can also be different, and for example, it can be less than 0.8 mm or more than 1.2 mm, if desired. It is understood that while FIG. 4 shows a no-sew (or seam-free or bonded technology) toe puff design; this construction is exemplary only, and sew toe puffs are also included in the scope of this disclosure. It is further understood that any known in the art methods of attachments of toe puff can also be utilized. In certain aspects, the term "no-sew technology," as used herein, refers to any known in the art bonding technologies. In still other aspects, the toe puff can comprise a metal, a rubberized material, a vulcanized material, and a mesh that is the same or different from other portions of the shoe. It is understood that all these materials can be attached through any known in the art attachment methods, such as the use of adhesive, stitching, bonding, welding, and the like. In still further aspects, and as disclosed above, the toe puff provides rigidity to the shoe, where this rigidity is smaller than the rigidity provided by the heel counter. In still further aspects, the heel counter can be glued and sandwiched between the layers of the heel area and also pinched between the insole board and the outsole.

In certain aspects, and as disclosed herein and shown in FIG. 4, the disclosed thinner toe puff gives added stability to the front of the shoe without squeezing the wearer's foot with the hardness that a traditional high heel does. In such exemplary aspects, the disclosed toe puff provides the aforementioned benefits of comfort and avoids any pain normally associated with high heels. As one of ordinary skill in the art would readily understand, harder toe puffs are normally used on high heels made of leather to conceal, for example, toenails from showing through the top. In some aspects disclosed herein, the toe puff is softer and shorter as compared to conventional high-heel shoes. Yet, in other aspects, the material selected for the toe counter can also be substantially identical to the one used in a traditional pump toe counter. The inset of FIG. 4 also shows that the toe puff can have a skive top edge.

In still further aspects, the footwear article further can comprise a heel seat comprising a bottom portion defined by the lasting board and a counter portion, wherein an inner surface of the bottom portion supports a posterior area of a wearer's heel, an outer surface of the bottom portion supports the heel of the footwear article and the counter portion extends above the calcaneus bone of the wearer's foot, wherein the heel seat is configured to receive the wearer's heel in a cradle-like arrangement.

In yet still further aspects, at least a portion of the counter portion of the heel seat can comprise a heel counter insert disposed between the one or more layers of the upper and extending laterally and medially to a corresponding longitudinal arch to stabilize the footwear article and to preserve a shape of the counter portion. In some aspects, the heel counter insert can comprise cardboard, leather, a polymeric material, a silicone-based material, or any combination thereof. In some aspects, any known in the art polymeric materials suitable for the desired application can be used. In still further aspects, the polymeric materials can comprise rubber, thermoplastic, chemi-sheet, and the like. In still further aspects, the heel counter insert can be moldable.

In yet still further aspects, the toe box counter can be less rigid than the heel counter.

Figure 5A:
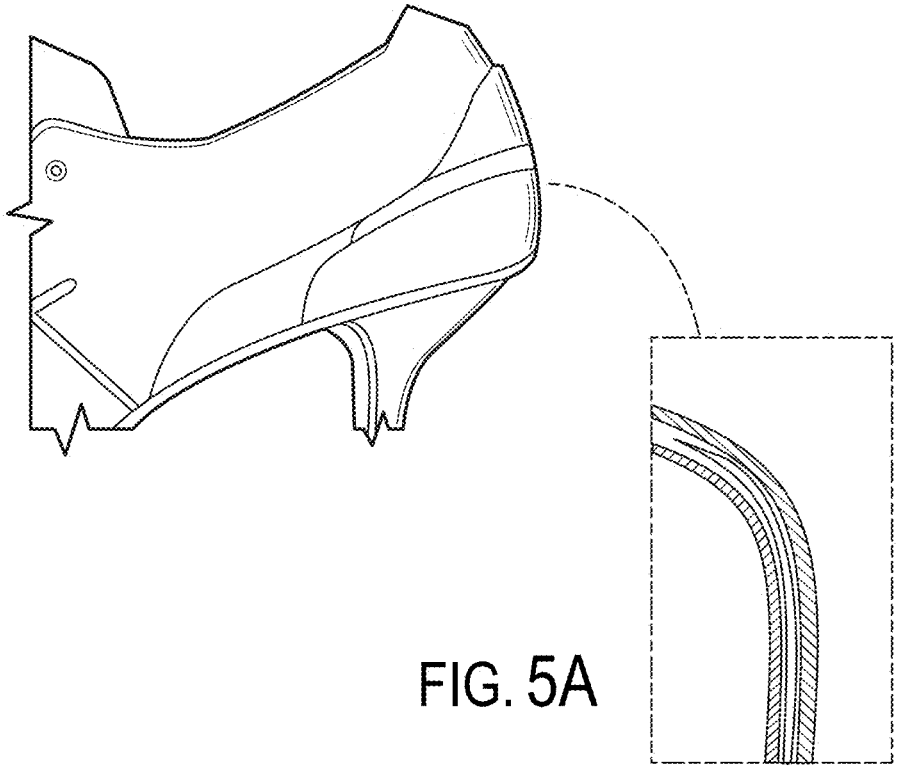
FIGS. 5A-5B depict a close-up and more detailed description of the various components of the disclosed herein hybrid shoe in one aspect.
Figure 5B:
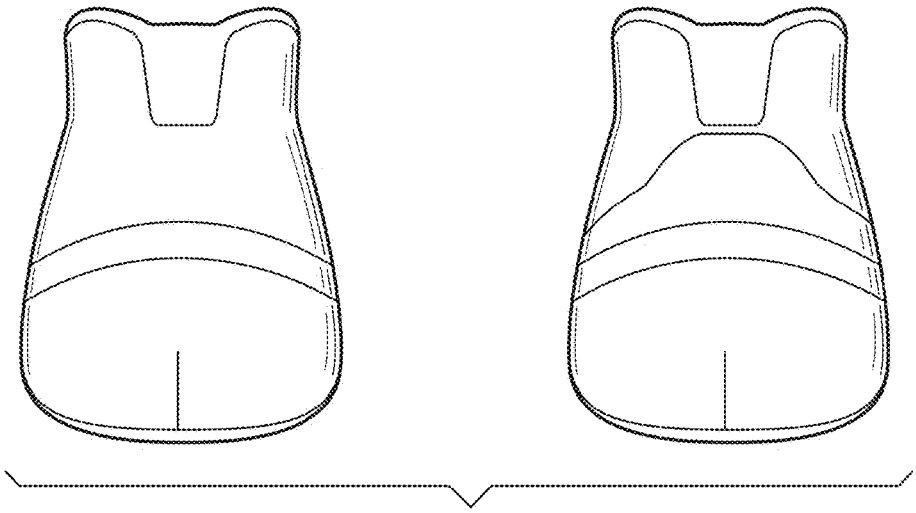

FIGS. 5A and 5B show different exemplary and unlimiting construction options for the heel counter. It is understood that the heel counter can provide stability needed in the hybrid shoe and ensure the desired stylish design. For example, the standard athletic shoe either does not have a heel counter, or the heel counter is not rigid. This construction allows for the movement of the foot during the exercise. In aspects where the footwear article is the hybrid shoe disclosed herein, the heel counter provides the comfort and the style of the conventional high-heel shoe, while the toe box allows the comfort of the athletic shoe. In certain aspects, the hardness of the heel counter described herein can have a thickness anywhere between about 0.5 to about 2.5 mm, including exemplary values of about 0.6 mm, about 0.7 mm, about 0.8 mm, about 0.9 mm, about 1.0 mm, about 1.1 mm, about 1.2 mm, about 1.3 mm, about 1.4 mm, about 1.5 mm, about 1.6 mm, about 1.7 mm, about 1.8 mm, about 1.9 mm, about 2.0 mm, about 2.1 mm, about 2.2 mm, about 2.3 mm, and about 2.4 mm. In certain aspects, the footwear article can have various options for the construction with a seam or without a seam, as desired.

It is understood that the size of the heel counter can be dependent on the specific design of the shoe. In certain aspects, the counter can be extended when compared to standard high-heel shoe design. As discussed in detail above, the heel counter can be positioned only within the back portion of the shoe to support the wearer's heel, or it can extend from the heel portion of the shoe to its side portions. Two exemplary and unlimiting designs of the heel counter are shown in FIG. 5B. In some aspects, combining the two or more materials can be used in the upper. FIG. 5B shows only an exemplary heel counter; however, it is understood that similar combinations or different combinations of the various materials can be applied along the entire portion of the upper or any portion thereof. In still further aspects, the heel counter can be made of leather, natural fibers, and compounded materials comprising natural and synthetic materials. For example, it can be a compound material comprising, for example, one or more of rice husks, wood fibers, palm residues combined with and one or more of EVA, TPU, PU, polylactic-based polymers (PL), polyester, and the like. The heel counters can further include adhesives, antimicrobial and antifungal agents, moisture adsorbing agents, and odor-eliminating agents. The heel counters can also be made of recycled materials, such as recycled compact disks.

Different materials also can be used in the heel portion of the shoe. For example, the upper liner can be lined with neoprene. The upper mesh can be lined with a foam, etc.

In some aspects, materials can be chosen based on the desired design. For example, in some aspects, a combination of a top fine mesh with a closer knit can be chosen. This material allows debossing and embossing of the desired components, such as padding, for example. In other aspects, an EVA padding with different thicknesses in the desired positions can be used. In further aspects, such combinations allow designs without these components being see-through. In certain aspects, the padding material can be foam. In certain aspects, the foam is configured to receive and retain the compression during the embossing/debossing process, for example. In this exemplary and unlimiting aspect, the bottom portion is selected from a performance mesh. In some aspects, the use of the performance mesh on top of the EVA allows a more aesthetic design of the shoe while retaining the compression properties of the EVA foam. In still further aspects, the use of the mesh can increase abrasion resistance without negatively impacting the fidelity of the embossing/debossing processes. Without wishing to be bound by any theory, it was hypothesized that the use of EVA/mesh combination can increase the strength of the upper. In still further aspects, it would also allow for the back of the shoe to have a more rigid construction. In yet further aspects, the toe portion and the waist portion of the shoe can be constructed from the performance mesh to increase the shoe's breathability.

In still further aspects, the heel counter of the disclosed hybrid shoe can comprise a raw edge, as again shown in FIG. 5B. This exemplary raw edge can be obtained, for example, and without limitation, after embossing. It is understood that common athletic shoes are typically lighter weight as they are often designed for athletic activities. However, the disclosed hybrid shoe is combined with a high-heel, and therefore the heel counter can require higher stability for a wearer's foot and therefore, in certain aspects, the heel counter of the disclosed hybrid shoe can be heavier and longer as compared to a traditional athletic shoe. In still further aspects, to obtain the desired stability, the disclosed herein shoe can have a heel counter extending toward the front of the shoe (almost at the middle), whereas a traditional athletic shoe usually has a shorter length. In still further aspects, the heel counter of the disclosed shoe is shorter when compared to the traditional high-heel shoe. In still further aspects, the heel counter is longer than a heel counter of the traditional athletic shoe but shorter than a heel counter of the traditional high-heel shoe.

In still further aspects, the upper of the disclosed herein shoe can comprise a heel collar and heel cuff. In such exemplary aspects, and depending on the desired design, the heel collar and heel cuff can be snaggled or wrapped around the ankle to provide additional stability and avoid undesired ankle rotation that can lead to an injury. In certain aspects, the heel collar and heel cuff can also be padded and/or cushioned. Yet still in further aspects, and as disclosed above, this portion can be a simple lining.

In still further aspects, at least a portion of the material used in the upper is substantially similar to the materials commonly used in athletic shoes. In still further aspects, the upper portion of the shoe can comprise additional components added to rigidness for stability. In certain aspects, the rigidity can also be added by the use of no-sew technology.

In still further aspects, the disclosed herein hybrid shoe comprises a sole structure that allows for a nexus of the athletic and high-heel shoes and provides the desired comfort of the athletic shoe and fashionable aesthetics of the high-heel shoe. It is understood that the sole structure disclosed herein comprises an insole board or lasting board, a midsole, and an outsole.

In some aspects, the insole board of the disclosed herein hybrid shoe can comprise one or more layers disposed on each other. In certain aspects, and as defined above, the insole board is a core portion (or a skeleton) of the shoe that other components such as the upper, the midsole, the outsole, and the high-heel are attached to and built around. It is understood, and as disclosed above, that the insole board and the upper can be built onto the disclosed herein last.

In some aspects, the insole board (or the lasting board) can comprise at least two portions: a front portion and a back portion. In yet other aspects, the insole board can also comprise a mid-portion. In certain aspects, the back portion, the front portion, and the mid-portion, if present, can be different from each other. In still further aspects, each portion of the lasting board can have the same or a different number of layers. In still further aspects, the layers in the different portions of the lasting board can be the same or different. In still further aspects, some of the layers in the back portion of the shoe, for example, can be similar to some of the layers in the front portion and/or mid-portion, if present.

In certain aspects, the back portion of the insole board starts from the heel end of the insole board and can extend up to below the ball of the foot. In such exemplary aspects, the portion from below the foot's ball to the front end of the insole board is considered as the front portion of the insole board. In still further aspects, the back portion that starts from the heel end of the insole board can end anywhere before the ball of the foot. For example, it can end abut the waist of the shoe. In such exemplary aspects, the back portion would extend into the mid-portion positioned along the arch or waist of the shoe up to about the foot's ball and then extend to the front portion of the insole board.

In some aspects, the front portion of the insole board defines the bottom of the toe box and can extend under the ball of the foot. In yet other aspects, the back portion extends from under the ball of the foot through the arch to the heel of the foot. While in still further aspects, the arch of the foot can represent the mid-portion of the insole board.

In aspects of the current disclosure, the front portion of the insole board is less rigid and more flexible than the back portion and/or mid-portion of the lasting board. In still further aspects, the front portion can have one or more layers having an average thickness that is greater than an average thickness of one or more layers present in the back portion. In certain aspects, the front and the back portions (and the mid-portion if present) of the insole board can be made as one integral piece. In other aspects, the front and the back portions (and/or mid-portion if present) of the insole board can be created separately and then coupled together using any known in the art methods that are suitable for the desired application. In certain aspects, the front, the back, and/or mid-portions of the insole board can be glued together, bonded together, welded, etc.

Figure 6A:
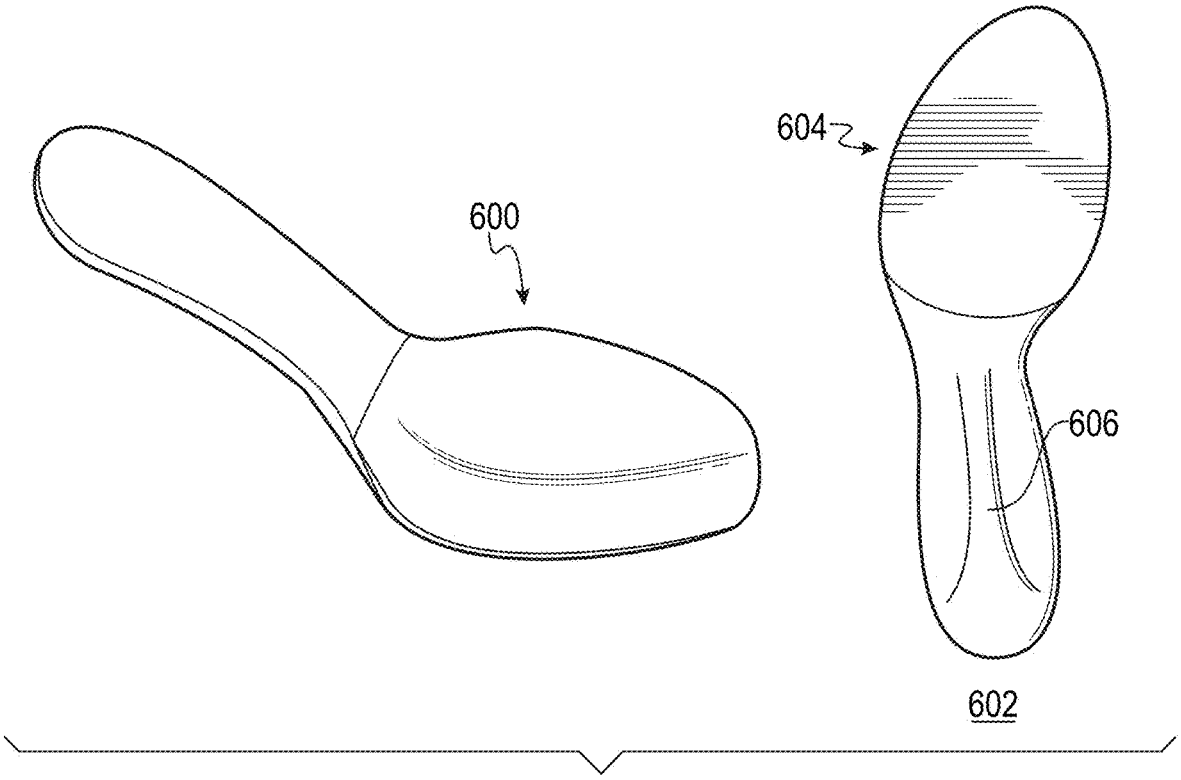
FIGS. 6A-6C disclose an exemplary design of an insole component of the disclosed herein hybrid shoe in one aspect.

In certain aspects, and as disclosed above, the rigidity of the insole board can vary from the front portion to the back portion. In certain aspects, the insole board can be made of natural fibers or synthetic fibers, or it can be made of plastic, cork, leather, or any other known in the art materials depending on the desired application. In some aspects, the front portion is more flexible, while the back portion is more rigid. In certain aspects, the back portion (and/or mid-portion) of the insole board can comprise a Krafton board. Yet, in other aspects, the front portion of the insole board can comprise a Texon board. It is understood that the Texon board is a fiberboard made of a compressed cellulose particle board that has a dense, firm composition and is much tougher and more durable than typical cardboard. In some aspects, if needed, these Texon fiberboard insole boards can be substantially flat. An exemplary insole board is shown in FIG. 6A.

In still further aspects, to accommodate the presence of the high-heel and to stabilize the shoe, a shank stabilizer can be introduced. In such aspects, the footwear article can comprise a shank stabilizer positioned in a mid-portion of the footwear article. In still further aspects, the shank is made of a metal, plastic, cardboard, or any combination thereof. In yet still further aspects, the shank stabilizer can be separately inserted into the lasting board or wherein the mid-portion of the lasting board is configured to behave as the shank.

In certain aspects, the shank stabilizer can be embedded within the lasting board. Yet, in other aspects, such a shank stabilizer can be positioned within the arch portion of the shoe. In yet other aspects, the shank stabilizer can have a substantially similar length to a length of the back portion of the insole board. Yet, in still further aspects, the shank stabilizer can be positioned to abut the end portion of the back portion (close to the heel) and have a length extending through the portion of the insole board that would correspond to the arch of the foot. In certain aspects, such a portion can be referred to as a waist of the shoe. In certain aspects, the shank stabilizer can be embedded within the lasting board. In yet other aspects, the shank stabilizer can be positioned between various layers of the back and/or mid portions of the insole board. In some aspects, the shank stabilizer can be affixed to the insole board by any known in the art method. It can be glued or attached by nails or any other known in the art fasteners. In still further aspects, the shank stabilizer can be embedded within the bottom portion of the lasting board during the manufacturing of that portion.

It is understood that the shank stabilizer in the bottom portion of the insole board provides the shoe with the desired stability needed for a high-heel shoe. In still further aspects, the shank stabilizer can be a metal, a composite material, a carbon fiber, or any other rigid material that has high rigidity and durability. It is also understood that the shank stabilizer present in the back and/or mid-portion of the insole board can have any desired shape that is suitable for the desired application/heel height, heel positioning, presence or absence of the midsole, and the like.

In some exemplary and unlimiting aspects, the back portion of the insole board can be constructed such that it has a gradual rigidity across the width and length. In such exemplary aspects, the back portion of the insole board can be made as a unitary unit having gradual rigidity. In some exemplary aspects, the highest rigidity can be provided along the waist of the insole board. In some exemplary and unlimiting aspects, if the back portion of the insole layer has a gradual rigidity with the highest rigidity and hardness matching the conventional shank stabilizer, no additional shank stabilizer needs be added. In yet other aspects, at least a portion of the back portion of the insole board can have the desired rigidity obtained during the manufacturing process. In such aspects, the insole board can also be free of an additional shank stabilizer.

In still further aspects, and if needed, an additional stabilizer can be positioned in the front portion of the insole board. It is understood that this stabilizer is optional. In yet other aspects, if the stabilizer is present in the front portion of the insole board, such a stabilizer can have a shape or pattern that allows stabilization or added rigidity in some portion of the front portion of the insole board while keeping other portions flexible and less rigid. In certain aspects, the optional stabilizer of the front portion can be made of a metal or metal alloys, a rigid plastic or a polymer, a composite material, a cardboard, a carbon fiber, and the like. In yet still further aspects, the stabilizer, if present in the front portion of the insole board, does not comprise a metal or metal alloy.

An exemplary structure of the insole board (or lasting board) is shown in FIG. 6A, with a top view of the insole board on the left and a bottom view of the insole board on the right in FIG. 6A. The insole board (600) can have various portions. For example, the toe-box portion (604) of the insole board can be less rigid than the rest of the insole board (602), where the shank stabilizer (606) is incorporated within the mid-portion of the shoe, including some of the heel portions of the shoe.

In certain aspects, and as disclosed above, the insole board can comprise an additional layer. In some aspects, these layers can be added as desired to achieve predetermined shoe performance. In some aspects, one of the additional layers can comprise a layer known as a Strobel layer. (See FIGS. 6B-6C). In such aspects, the Strobel layer can define the innermost surface of the insole board that defines a bottom portion of the inner compartment configured to receive the wearer's foot. In yet other aspects, additional layers can be positioned on the Strobel layer. However, it is understood that when the Strobel layer is present, the upper is stitched to the Strobel layer to form the inner compartment. In some aspects, the Strobel layer is disposed along the entire length of the insole board. In yet other aspects, the Strobel layer (680) is disposed only in the front portion of the insole board ((660) shows a toe box portion and (650) the remaining portion of the lasting board). In still further aspects, the Strobel layer is not disposed on the back and/or mid-portion of the insole board. Without wishing to be bound by any theory, it is hypothesized that having a Strobel layer in the back portion can potentially take away some of the structure and the stability in the heel area. It is understood that the stability in the heel area is provided by a heel counter in combination with a traditional insole board.

In yet still further aspects, the Strobel layer can be along the whole foot bed of the footwear article. In yet still further aspects, the Strobel layer can be in the heel portion and mid-portion of the shoe but not in the forefoot portion of the footwear article.

In still further aspects, the Strobel layer can be made from any materials known in the art. In some aspects, the Strobel layer can comprise fiber paper or a textile material comprising synthetic and/or natural fibers.

Figure 6B:
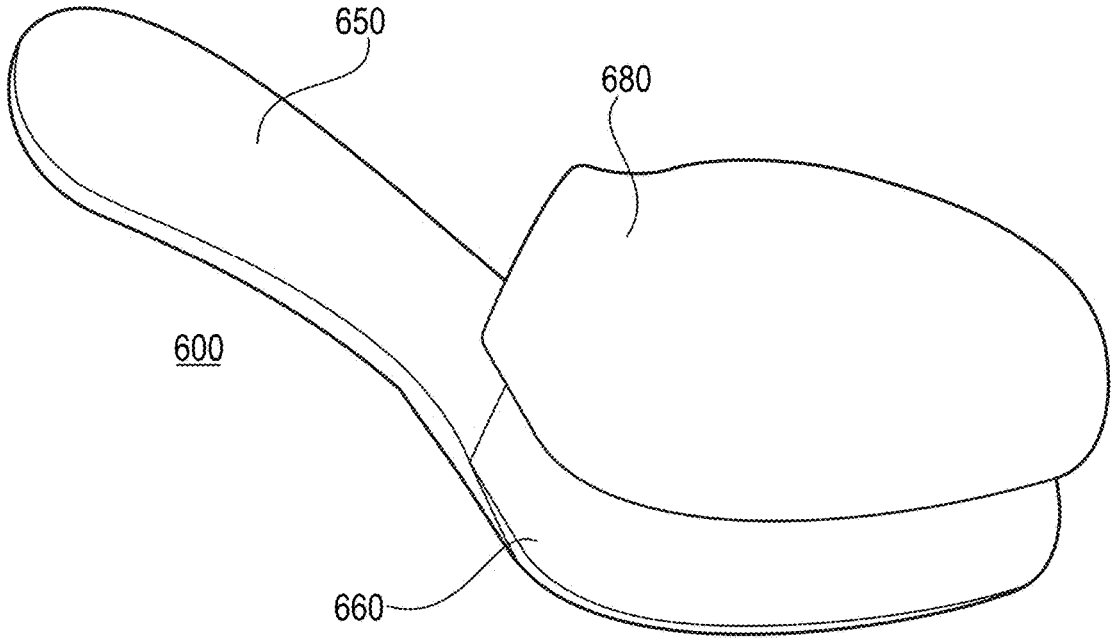
Figure 6C:
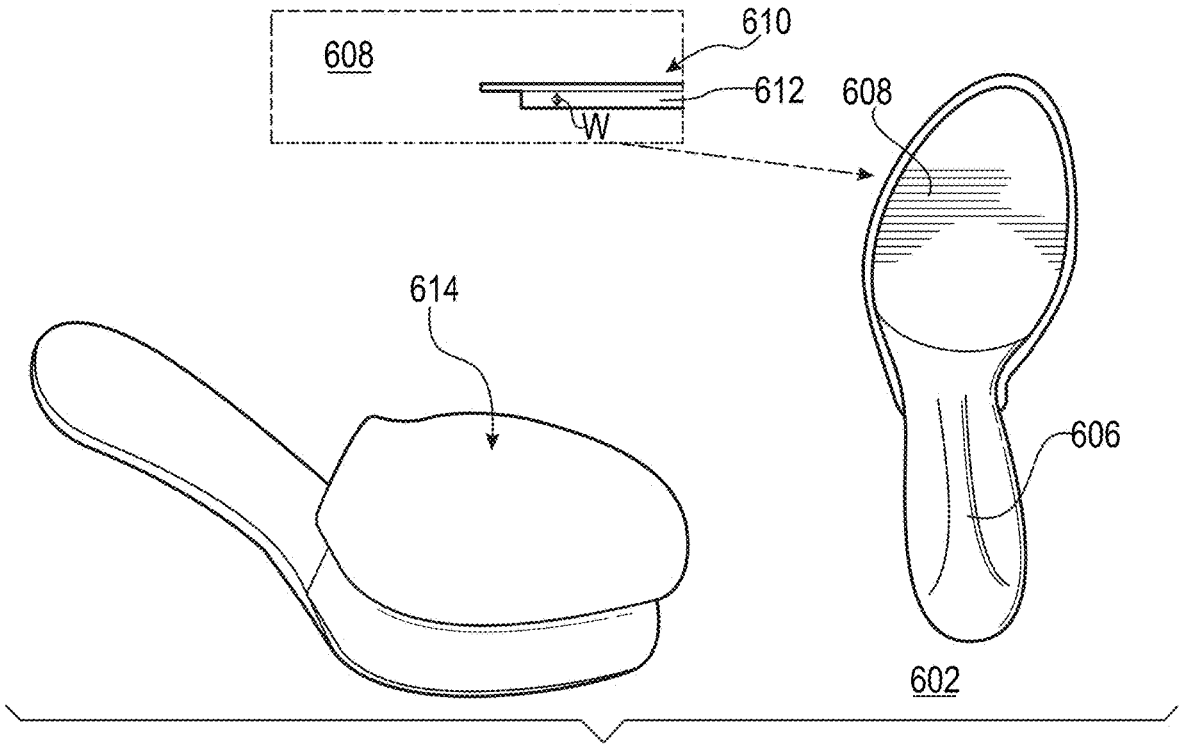

An exemplary insole board with the Strobel layer is shown in FIG. 6B, where (650) is a back portion of the lasting board, including a shank stabilizer embedded therein. In such aspects, this board can be skived/graded out to zero at the ball of the foot, in a half moon shape. (660) is a lasting board ball pad or the front portion of the lasting board. In such aspects, (660) can be, for example, a 5 mm thick Pouron grading to zero at waist/lasting board overlap. It is understood that in some aspects, this portion of the insole layer is not skive-edged at the toe area. (680) is a Strobel layer having a thickness of about 0.8-1.2 mm, including exemplary values of about 0.9 mm, about 1.0 mm, and about 1.1 mm. In such aspects, as illustrated in the top view on the left and the bottom view on the right in FIG. 6C, the Strobel layer (614) can be cut larger (610) than a ball pad (612) (or front portion (608) of the insole board), but only enough such that the Strobel stitch does not perforate the ball pad (the front portion) during stitching. In such exemplary and unlimiting aspects, the Strobel layer can be about 5 mm wider than the front portion on either side. It is, however, understood that the dimensions provided herein are only exemplary and unlimiting. In aspects disclosed herein, the Strobel layer is designed to provide enough stitch allowance. In still further aspects, the Strobel layer can be glued or otherwise attached to the topmost surface of the insole board. It is understood that the attachment can be done by any known in the art methods.

In still further aspects, the Strobel layer can have a curved c-shape. While in other aspects, the Strobel layer can have a straight shape. However, it is understood that these shapes are only exemplary and not limiting, and any other shapes can be utilized. The straight-shape Strobel layers can provide more support under the arch if needed. In yet other aspects, semi-curved Strobel layers or hybrid Strobel layers can be utilized.

In still further aspects, at least a portion of the upper can be stitched to the Strobel layer.

In some exemplary aspects disclosed herein, the front portion of the insole board comprises the Strobel layer, while the back portion and mid-portion, if present, do not comprise the Strobel layer. In some of such exemplary aspects, during the shoe construction, the upper is first stitched to the Strobel layer in the front portion of the shoe, the last is then inserted to provide desired final shape, and the upper of the back portion of the shoe is pulled around the last and the back portion of the insole board. It is understood that the disclosed herein construction of the shoe is different from the high-heel shoe where the entire upper is pulled around the last and the insole board. In still further aspects, the disclosed herein construction allows the materials of the upper to provide the desired performance to the front portion of the shoe. For example, in such construction, if the performance mesh is used as the front portion of the upper, such mesh retains its 3D structure, as it is first stitched to the Strobel layer and is not pulled. The disclosed herein constructions also allow the upper to retain its desirable features such as breathability, lightweight, vapor/water transfer, and the like. Yet, in other aspects, the back portion of the shoe obtained the desired rigidity through being pulled around the lasting board, along with other elements previously mentioned on the upper.

In some aspects, the lasting board can have a variable density. In such aspects, the variable density lasting board allows for increased padding at the ball of the foot. This construction can also allow the rear upper fabric to be pulled around to secure it between the lasting board and the outsole. As discussed in detail above, conventional high-heel construction requires having a rigid board, for example, a stiff composite fiber board. In still further aspects, an additional padding layer can be positioned on the insole board below the Strobel layer or above the Strobel layer if additional cushioning is desired.

In still further aspects, the presence of the Strobel layer-on a top of the ball pad (front portion) of the lasting board (insole board) is used to Strobel stitch the upper fabric to the Strobel layer before lasting as disclosed above. These manufacturing steps can ensure that a mesh vamp panel is not pulled tight or is out of shape when it is lasted. The Strobel stitch allows the upper fabric to have room to move, thus providing increased comfort and flexibility to the shoe. In still further aspects, it is understood that the presence of the Strobel layer and the Strobel stitch in the front portion of the shoe, as disclosed herein, can provide additional comfort and movement to the wearer's toes do not present in the conventional high-heel shoe. In still further aspects, additional layers can be added on the top of the Strobel layer if desired.

In still further aspects, the front portion of the insole board can be substantially flat to form a bottom surface of the desired toe box shape. In such aspects, the bottom surface of the formed toe box is substantially flat, ensuring that a substantial portion of the toe box in the full shoe construction is in contact with the ground. It is understood that such a shoe's construction improves stability and comfort for the wearer and the wearer's foot. In still further aspects, the final shape of the toe box can be defined by the last that is engineered specifically to form the disclosed herein shoe. The last is inserted into the constructed shoe to provide the shoe with the desired shape. The toe box shape is retained after the last is removed by the use of a toe puff. It is understood that the width of the toe box is defined by the last. It is further understood that the last has a greater width than the width of the common high-heel shoe. In still further aspects, the last can have a width substantially similar to the one used in the athletic shoe. In yet still further aspects, the last can have a width that is configured to balance the presence of the high heel and the comfort of the desired wide toe box.

In still further aspects, the back portion of the insole board can comprise one or more apertures. It is understood that these apertures can be useful in attaching the heel to the shoe. In yet other aspects, the insole board can be manufactured to have confined spaces that can be used to hold inserted materials if desired.

In certain aspects, also disclosed herein is a footwear support system. In such aspects, the footwear support system can comprise an insole insert or insole. It is understood that the insole or insole insert described herein is different from the insole board (or lasting board) described above.

Figure 9A:
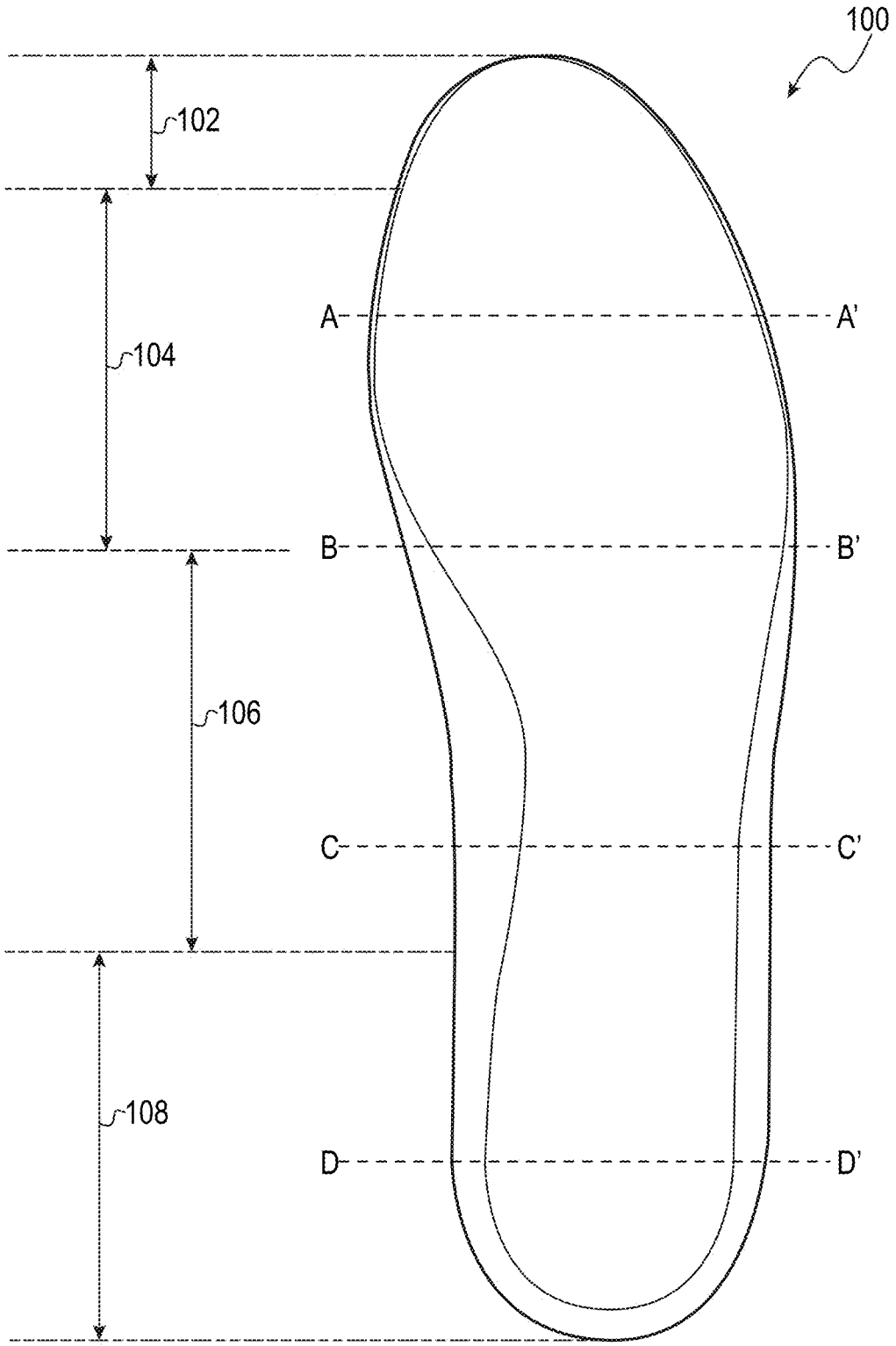
FIGS. 9A-9B depict an exemplary design of an insole in one aspect.
Figure 9B:
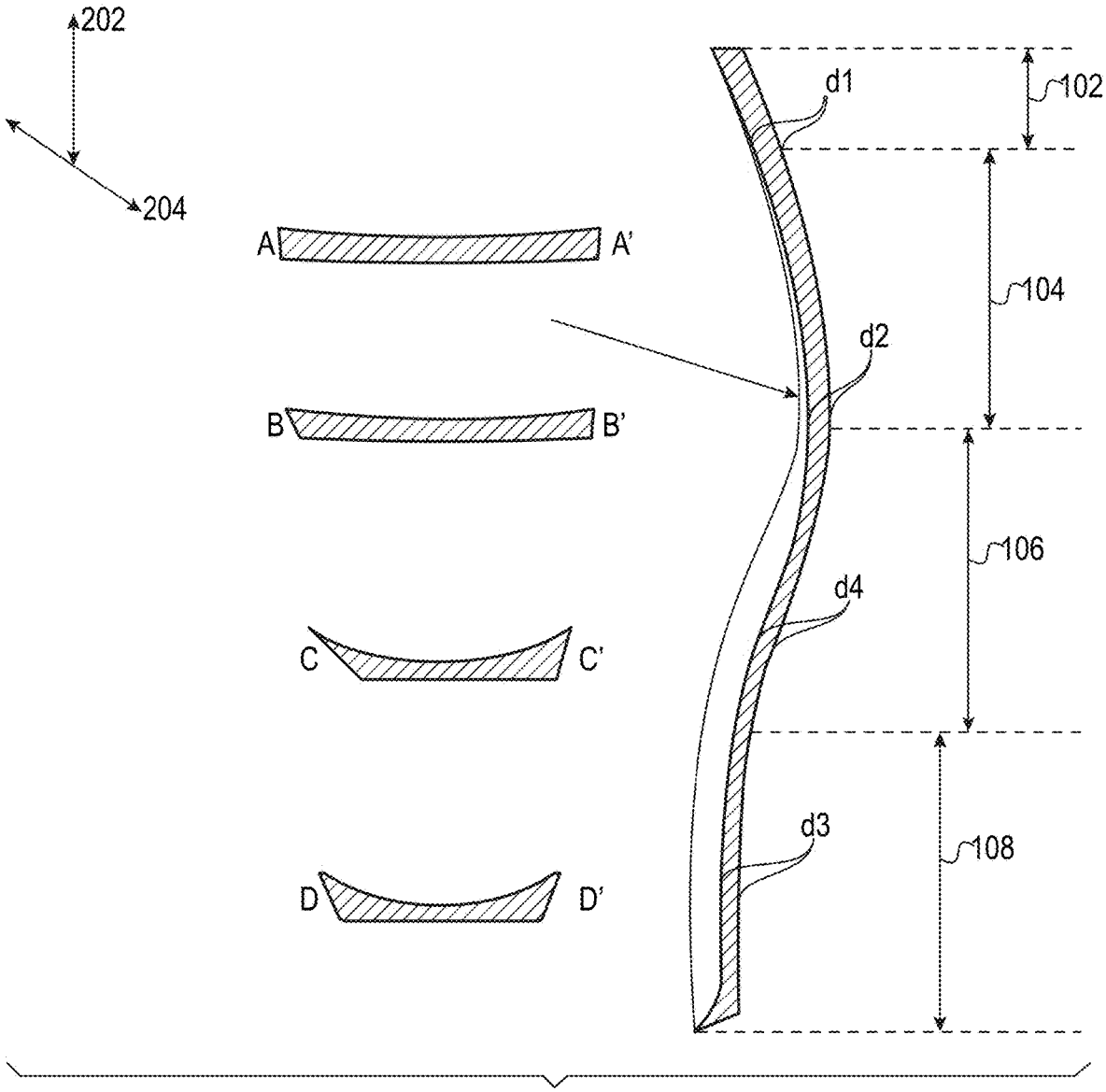

In one aspect, the insole described herein is shown in FIGS. 9A-9B. FIG. 9A shows a top view of the insole and FIG. 9B shows multiple cross section views from the points indicated in FIG. 9A, as well as and a side view of the insole. In certain aspects, the insert (100) comprises a toe portion (102), a forefoot portion (104), and a hindfoot portion (108). In certain aspects, the toe portion (102) can have a first thickness $d_1$. In yet further aspects, the forefoot portion (104) can have a second thickness $d_2$. Yet, in still further aspects, a hindfoot portion can have a third thickness $d_3$. It is understood that, in the aspects disclosed herein, the first thickness $d_1$ is greater than the third thickness $d_3$ of the insole insert.

In yet other aspects, the first thickness $d_1$ can be the same as or smaller than the third thickness $d_3$ at least across some portions.

Also disclosed are aspects where the first thickness $d_1$ is greater than the second thickness $d_2$. However, disclosed herein are also aspects where the first thickness $d_1$ and the second thickness $d_2$ are the same. In yet still further aspects, the second thickness $d_2$ can be greater than the first thickness $d_1$ if desired. In still further aspects, $d_4$ can be thicker than $d_2$. Without wishing to be bound by any theory, it is assumed that such constructions may assist with filling the gap behind the ball of the foot as needed.

The insole insert disclosed herein can also comprise a midfoot portion (106) that is disposed between the forefoot portion (104) and the hindfoot portion (108). It is understood that the midfoot portion (106) can have a fourth thickness $d_4$. In certain aspects, the third thickness $d_3$ and the fourth thickness $d_4$ can be the same. In other aspects, the third thickness $d_3$ is greater than the fourth thickness $d_4$. Yet, in still further aspects, the third thickness $d_3$ is smaller than the fourth thickness $d_4$. In yet still further aspects, the fourth thickness $d_4$ can be adjusted in any way as desired to ensure a wearer's foot comfort. In still further aspects, the fourth thickness $d_4$ can be adjusted in any way as desired to ensure a smooth and anatomically correct transition from the forefoot portion of the insole to the hindfoot portion of the insole.

In still further aspects, the first thickness $d_1$ can be uniform along the toe portion 102. However, in certain aspects, the first thickness $d_1$ can vary along a longitudinal axis 202 that is parallel to a length of the insole insert. In still further aspects, the first thickness $d_1$ can vary along a transverse axis (204) that is parallel with the width of the insole insert within the toe portion. In still further aspects, the first thickness $d_1$ can vary both along the length and the width of the toe portion of the insole insert. In yet still further aspects, the first thickness $d_1$ can be thicker along the lateral and/or medial side of the toe portion and thinner in the middle of the toe portion. Yet, in still further aspects, the first thickness $d_1$ can be thicker in the middle of the toe portion and thinner along the lateral and/or medial side of the toe portion. It is also understood that in some aspects, the medial and lateral sides of the toe portion can have the same thickness $d_1$, or it can be greater or smaller on each side. In still further aspects, the first thickness $d_1$ can be in a range of about 2 mm to about 8 mm, including exemplary values of about 2.1 mm, about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, about 3.7 mm, about 3.8 mm, about 3.9 mm, about 4.0 mm, about 4.1 mm, about 4.2 mm, about 4.3 mm, about 4.4 mm, about 4.5 mm, about 4.6 mm, about 4.7 mm, about 4.8 mm, about 4.9 mm, about 5.0 mm about 5.1 mm, about 5.2 mm, about 5.3 mm, about 5.4 mm, about 5.5 mm, about 5.6 mm, about 5.8 mm, about 5.9 mm, about 6.0 mm, about 6.1 mm, about 6.2 mm, about 6.3 mm, about 6.4 mm, about 6.5 mm, about 6.6 mm, about 6.8 mm, about 6.9 mm, about 7.0 mm, about 7.1 mm, about 7.2 mm, about 7.3 mm, about 7.4 mm, about 7.5 mm, about 7.6 mm, about 7.8 mm, and about 7.9 mm.

In some aspects, the second thickness $d_2$ can be the same along the whole forefoot portion. In yet other aspects, the second thickness $d_2$ can vary along the longitudinal axis (202) and transverse axis (204). In still further aspects, the second thickness $d_2$ of a portion of the forefoot portion (104) that is abutted to the toe portion (102) can be thicker than the second thickness $d_2$ of a middle portion of the forefoot portion (104) or a portion abutting the midfoot portion of the insole (106). For example, the second thickness $d_2$ along lines A-A' can be greater than the second thickness $d_2$ along a line B-B'. In still further aspects, the insole along a line B-B' can have a concaved portion in the middle to cradle the ball of the wearer's foot for more comfort. In still further aspects, the second thickness $d_2$ can be in a range from about 2 mm to about 8 mm, including exemplary values of about 2.1 mm, about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, about 3.7 mm, about 3.8 mm, about 3.9 mm, about 4.0 mm, about 4.1 mm, about 4.2 mm, about 4.3 mm, about 4.4 mm, about 4.5 mm, about 4.6 mm, about 4.7 mm, about 4.8 mm, about 4.9 mm, about 5.0 mm, about 5.1 mm, about 5.2 mm, about 5.3 mm, about 5.4 mm, about 5.5 mm, about 5.6 mm, about 5.7 mm, about 5.8 mm, about 5.9 mm, about 6.0 mm, about 6.1 mm, about 6.2 mm, about 6.3 mm, about 6.4 mm, about 6.5 mm, about 6.6 mm, about 6.7 mm, about 6.8 mm, about 6.9 mm, about 7.0 mm, about 7.1 mm, about 7.2 mm, about 7.3 mm, about 7.4 mm, about 7.5 mm, about 7.6 mm, about 7.7 mm, about 7.8 mm, and about 7.9 mm.

In yet still further aspects, the second thickness $d_2$ abutting the ball of the wearer's foot, especially just behind the ball, can be thicker than $d_2$ in other locations of the forefoot. An additional thickness can fill any space that forms by a natural curve of the wearer's foot and increase the contact between the foot and the insole for better weight distribution.

In still further aspects, the third thickness $d_3$ can be the same or different along a longitudinal axis (202) or transverse axis (204) in the hindfoot portion (108). In some aspects, to other portions, the third thickness $d_3$ can vary along the medial and lateral sides of the hindfoot's insole and/or middle portion. Yet, in other aspects, the third thickness $d_3$ is substantially the same along the medial and lateral sides of the hindfoot's insole and/or middle portion. In still further aspects, the third thickness $d_3$ can be in a range from about 2.0 mm to about 5 mm, including exemplary values of about 2.1 mm, about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, about 3.7 mm, about 3.8 mm, about 3.9 mm, about 4.0 mm, about 4.1 mm, about 4.2 mm, about 4.3 mm, about 4.4 mm, about 4.5 mm, about 4.6 mm, about 4.7 mm, about 4.8 mm, and about 4.9 mm.

In yet still further aspects, the fourth thickness $d_4$ can be the same or different along a longitudinal axis (202) or transverse axis (204) in the midfoot portion (106). Similar to other portions, the fourth thickness $d_4$ can vary along the medial and lateral sides of the insole and/or middle portion of the midfoot. In still further aspects, the fourth thickness $d_4$ can be in a range from about 2.5 mm to about 8 mm, including exemplary values of about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, about 3.7 mm, about 3.8 mm, about 3.9 mm, about 4.0 mm, about 4.1 mm, about 4.2 mm, about 4.3 mm, about 4.4 mm, about 4.5 mm, about 4.6 mm, about 4.7 mm, about 4.8 mm, about 4.9 mm, about 5.1 mm, about 5.2 mm, about 5.3 mm, about 5.4 mm, about 5.5 mm, about 5.6 mm, about 5.8 mm, about 5.9 mm, about 6.0 mm, about 6.1 mm, about 6.2 mm, about 6.3 mm, about 6.4 mm, about 6.5 mm, about 6.6 mm, about 6.8 mm, about 6.9 mm, about 7.0 mm, about 7.1 mm, about 7.2 mm, about 7.3 mm, about 7.4 mm, about 7.5 mm, about 7.6 mm, about 7.8 mm, and about 7.9 mm.

It is understood that the midfoot portion (106) of the insole can be sized and shaped to have a height sufficient to contact and support at least a portion of the midfoot area of the wearer's foot. In yet still further aspects, the midfoot portion (106) can have a concave or convex shape to more comfortably accommodate the wearer's foot.

In still further aspects, the first, second, third, and/or fourth thicknesses are uniform across the toe portion, forefoot portion, hindfoot portion, or midfoot portion, respectively. In still further aspects, the first, second, third, and/or fourth thicknesses can vary across the toe portion, forefoot portion, hindfoot portion, or midfoot portion, respectively.

In still further aspects, the insole disclosed herein can have a wider forefoot portion (104) than standard insoles used in the industry. In still further aspects, the insole disclosed herein can have a width around the ball of the foot that is greater than the width of the standard insole. This additional width can extend into the upper of the footwear article along the medial and lateral portions to create additional support behind the ball of the foot. In yet still further aspects, the insole insert disclosed herein can also be wider than the forefoot section of the disclosed herein last. In such exemplary and unlimiting aspects, such a wide insole insert would provide additional support under the ball of the foot on the medial side when incorporated into the footwear article.

Figure 10:
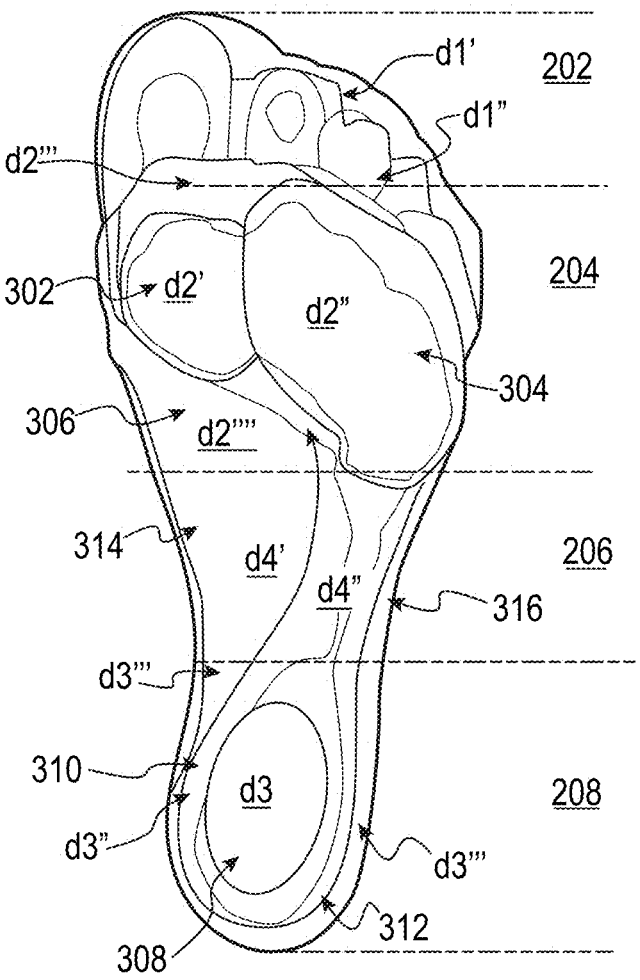
FIG. 10 depicts an exemplary design of an insole in another aspect.

An additional aspect of the insole, as described herein, can be seen in FIG. 10. The insole is shown with a projection of the wearer's foot. It can be seen that the insole is designed to comport with the anatomical structure of the shoe. For example, the first thickness $d_1$ of the toe portion (202) can have different portions $d_1'$ and $d_1''$. In such aspects, for example, and without limitation, the thickness $d_1''$ that is within the toe portion that cradles the wearer's toes can be smaller than thickness $d_1$ allowing a better comfort and better distribution of the weight. In yet other aspects, the insole can be made from a resiliently deformable material that can be compressed under the pressure of the wearer's foot and change its shape to more comfortably snuggle the wearer's foot anatomy.

In still further aspects, the forefoot portion (204) that abuts a ball of the foot can comprise a first concave portion (302) configured to receive a portion of the ball of the foot around a base of a big toe. In such aspects, for example, this portion can have a thickness $d_2'$ that can be smaller than the second thickness $d_2$ in all other portions of the forefoot portion (204). It is understood that $d_2$ in the remaining portion of the forefoot portion (204) can be the same or also vary depending on the specific design. In some aspects, the forefoot portion (204) abutting a portion of the ball of the foot around a base of a pinky toe (304) can have a thickness $d_2''$ that can be greater than the thickness $d_2'$ of the first concave portion (302). In certain aspects, $d_2''$ can be the same as every other portion of the forefoot portion (204) except the first concave portion. Yet in still further aspects, $d_2''$ can be still smaller than, for example, $d_2'''$ or $d_2''''$, which are positioned just below the ball of the foot or just below the toes, respectively. While yet in still further aspects, $d_2''$, $d_2'''$, and $d_2''''$ can be the same. While in still further aspects, $d_2''$ can be greater than either $d_2'''$ or $d_2''''$. In still further aspects, $d_2'''$ and $d_2''''$ can be the same or different. In some aspects, $d_2'''$ can be greater than $d_2''''$. While in other aspects, $d_2'''$ can be smaller than $d_{2''''}$.

In yet other aspects, a portion (304) can be seen as rising above portion (302), providing a convex shape and allowing the lateral portion of the ball of the foot to rest on the insole.

In still further aspects, the insole described herein can have a second concave portion (308) positioned with the heel portion (208) and configured to receive and support the calcaneus bone of a wearer's foot. In such aspects, the second concave portion (308) can have a thickness $d_3'$ smaller than the third thickness $d_3$ in all other portions of the hindfoot. It is understood, however, that the third thickness $d_3$ does not have to be uniform in the remaining portions of the hindfoot. For example, and without limitations, the medial (310) and lateral sides (312) of the hindfoot portion can have thicknesses, such as $d_3''$ and $d_3'''$, respectively, that can be the same or different. It is understood that the hindfoot can have a portion just below the midfoot portion on the medial side of the insole that can have an additional thickness $d_3''''$ that can be the same or different from $d_3'$, $d_3''$, and/or $d_3'''$. It is further understood that these thickness variations are provided to further comport the wearer's foot anatomy and shape and provide comfort. The wearer of high-heeled shoes can appreciate this additional comfort to help with equal weight distribution.

It is understood that in aspects where the heel is received in the cradle-like accommodation due to the second concave portion, the insole provides additional comfort by allowing grounding of the heel and lodging it in place to prevent the foot from sliding during wear.

In still further aspects, the midfoot portion (206) can also comprise a third concave portion (314) configured to receive a medial midfoot portion of a wearer's foot, such that a fourth thickness $d_4$ can vary across a width of midfoot, as shown by thicknesses $d_4'$ and $d_4''$. In such aspects, $d_4''$ along a lateral portion of the midfoot portion (206) can be greater than $d_4'$ that is positioned in the medial up to the mid-portion of the midfoot. In yet other aspects, the medial portion (314) of the lateral midfoot portion (206) can have a rising convex shape to adapt to the natural anatomy of the wearer's foot and to fill in any empty space that can be formed between the foot and the footwear articles. In yet other aspects, $d_4'$ and $d_4''$ can be the same. While in yet other aspects, $d_4'$ can be greater than $d_4''$, forming a convex shape of (314), while (316) is either planar with a smaller thickness or concaved. In still further aspects, it is understood that the $d_4$ thickness along various portions of the midfoot can be adjusted to allow a smooth transition from the forefoot portion to the hindfoot portion and provide maximum support under the arch of the wearer's foot.

In still further aspects, and as described above, the insole insert can be formed from a resiliently deformable material. In some aspects, the resiliently deformable material can have a variable density along the insole insert. In such aspects, the variable density can provide additional comfort and the ability of the insole to adjust appropriately for the applied pressure by the wearer. In still further aspects, variable density can also be obtained when the foam is compressed to make it thinner in some areas. In yet still further aspects, multiple foams with different densities can be combined and achieve the same, keeping it all at the same thickness.

In still further aspects, the density can be anywhere in a range of about 90-200 kg/m$^3$, including exemplary values of about 100 kg/m$^3$, about 110 kg/m$^3$, about 120 kg/m$^3$, about 130 kg/m$^3$, about 140 kg/m$^3$, about 150 kg/m$^3$, about 160 kg/m$^3$, about 170 kg/m$^3$, about 180 kg/m$^3$, and about 190 kg/m$^3$.

In still further aspects, the first, the second, the third, and the fourth thicknesses are formed by varying compression of the resiliently deformable material.

In yet still further aspects, the insole is made of the material that has a compression set as determined according to UNE-EN ISO 3386-1:1998/A1:2010 from about 45 kPa to about 60 kPa, including exemplary values of about 46 kPa, about 47 kPa, about 48 kPa, about 49 kPa, about 50 kPa, about 51 kPa, about 52 kPa, about 53 kPa, about 54 kPa, about 55 kPa, about 56 kPa, about 57 kPa, about 58 kPa, and about 59 kPa.

In still further aspects, the insole can be made from one or more layers. In such aspects, the layers can be made from the same material or different materials. For example, some additional layers, such as cushioning, gel, or padding, can also be added to the insole.

In certain aspects, the concave or convex portions of the insole, as described above, can have padding, gel, or cushion. In yet still further aspects, at least a portion of the insole insert comprises a perforated layer configured to provide breathability. In yet still further aspects, the entire insole insert can be made of the material that provides breathability.

In still further aspects, the insole insert can be made from, for example, and without limitations, closed-cell ethylene-vinyl acetate (EVA) foam, ethylene-vinyl acetate, polyurethane, polyethylene, thermoplastic polyurethane, leather, bamboo, cork, hemp, cotton, wool, any other plant or bio-sourced materials, canvas, rubber, polyester, nylon, It is understood that the materials used to create the disclosed herein insoles can be recyclable. In yet other aspects, the insoles described herein can be formed from recycled materials. Any of the disclosed above materials can be used as recycled materials to form the insoles. These unique features also allow more sustainable manufacturing of the insole insert and reduce the industry's carbon footprint.

In still further aspects, the insole can comprise materials or additives that are antifungal, antibacterial, antiperspirant, configured to prevent smell, and the like. It is understood that these materials and additives can be incorporated within the resiliently deformable material during its manufacturing, or they can be provided as coatings or separated layers.

In still further aspects, the materials disclosed herein and used to form the described insole insert can exhibit absorption and water elimination properties. For example, the water absorption as measured according to UNE-EN ISO 20345:2012 for insoles can be about 85 mg/cm$^2$ to about 120 mg/cm$^2$ including exemplary values of about 86 mg/cm$^2$, about 87 mg/cm$^2$, about 88 mg/cm$^2$, about 89 mg/cm$^2$, about 90 mg/cm$^2$, about 91 mg/cm$^2$, about 92 mg/cm$^2$, about 93 mg/cm$^2$, about 94 mg/cm$^2$, about 95 mg/cm$^2$, about 96 mg/cm$^2$, about 97 mg/cm$^2$, about 98 mg/cm$^2$, about 99 mg/cm$^2$, about 100 mg/cm$^2$, about 101 mg/cm$^2$, about 102 mg/cm$^2$, about 103 mg/cm$^2$, about 104 mg/cm$^2$, about 105 mg/cm$^2$, about 106 mg/cm$^2$, about 107 mg/cm$^2$, about 108 mg/cm$^2$, about 109 mg/cm$^2$, about 110 mg/cm$^2$, about 111 mg/cm$^2$, about 112 mg/cm$^2$, about 113 mg/cm$^2$, about 114 mg/cm$^2$, about 115 mg/cm$^2$, about 116 mg/cm$^2$, about 117 mg/cm$^2$, about 118 mg/cm$^2$, and about 119 mg/cm$^2$.

In yet still further aspects, the insoles described herein exhibit water elimination after 24 hours as measured according to UNE-EN ISO 20345:2012 for insoles from about 95% to 100%, including exemplary values of about 96%, about 97%, about 98%, about 99%, about 99.9%, about 99.95%, and about 99.9999%.

In still further aspects, the insole disclosed herein can be molded, injection-molded, 3D printed, die-cut, laser-cut, or any combination thereof. In yet still further aspects, the insoles described herein can be permanently attached to the footwear article or can be removed and replaced if needed. In still further aspects, the insoles described herein can be provided and be available to the consumer separately from the footwear article. In yet still further aspects, the insoles described herein can be fitted to different types of footwear articles. The insoles described herein can be used in closed-back high-heeled shoes, such as pumps, stilettoes, or wedges. However, it is understood that these insoles can also be applicable for an open-back shoe such as the slide shoe, an open-toe shoe, or any other shoe design. In yet still further aspects, the insole insert disclosed herein can be used in any shoe. In still further aspects, an insole can be positioned on the outmost top surface of the insole board. In such aspects, the insole is exposed to the bottom of the wearer's foot. In some aspects, the insole can comprise one or more layers. In certain aspects, the insole layers can have various density, rigidity, padding, and the like to achieve the desired comfort and compensate for the wearer's gait and posture. In still further aspects, the insole can comprise various materials. In some aspects, the outermost surface of the insole can comprise a fabric layer. In still further aspects, the outermost surface can be made of non-woven fabric, leather, or any combination thereof. In such an aspect, this fabric layer can be referred to as a "footsock." In such exemplary aspects, the footsock can comprise any materials known in the art that are breathable, lightweight, comfortable to the touch, and non-irritating to the wearer's foot. In certain aspects, the footsock layer can comprise a polyester fabric. In such exemplary and unlimiting aspects, the polyester can be a brushed polyester interlock, 220 gms. In certain aspects, the fabric can also comprise antibacterial agents or antiperspirant agents. For example, such agents can comprise silver or aluminum-based materials. In still further aspects, the footsock can be cut following a grain direction of the interlock texture to create grip. In still further aspects, the footsock does not comprise spandex. In still further aspects, the insole can comprise various cellulosic materials, for example, it can comprise materials that are known under the trade names of TEXON ECOSOLE™ 100, TECNOSINT SL8, and BARTOLLI. Yet, in other aspects, the insole can comprise foamed material that can be formed by introducing an intermediate layer of a gel, cork, or any other foam. In yet still further aspects, the insole can have an additional layer that covers a top surface of the insole insert and comprised, for example, and without limitations of linen, rayon (viscose), or any other natural or polymeric material. It is understood that this layer can be breathable and can have moisture adsorbing properties. In yet other aspects, this layer can further comprise additives such as odor-eliminating additives, antimicrobial or antifungal agents, and the like.

In still further aspects, the insole can comprise an additional layer disposed beneath the footsock comprising padding or foam. In some aspects, this padded layer can comprise EVA or PU foam. In yet other aspects, it can be a gel material. In still further aspects, the insole can be configured to provide the desired orthopedic support based on the specifics of the wearer's foot. In still further aspects, the layers of the insole can be at least partially perforated to allow additional breathability. As discussed above, the insole can be removable, or it can be permanently attached to the shoe.

In still further aspects, the insole can also comprise a gel material that is configured to improve the comfort of the foot and is shock absorbent. It is understood that in the disclosed innovative hybrid shoe, the insole can be the same along the entire length of the shoe, or it can have different portions. In some aspects, the front portion of the insole is thicker than the back portion. In such exemplary aspects, the front portion can extend under the ball of the foot. In still further aspects, the front portion can gradually extend towards the back portion of the insole under the ball of the foot. In yet other aspects, a back portion of the insole can be thicker than its front portion.

Figure 8:
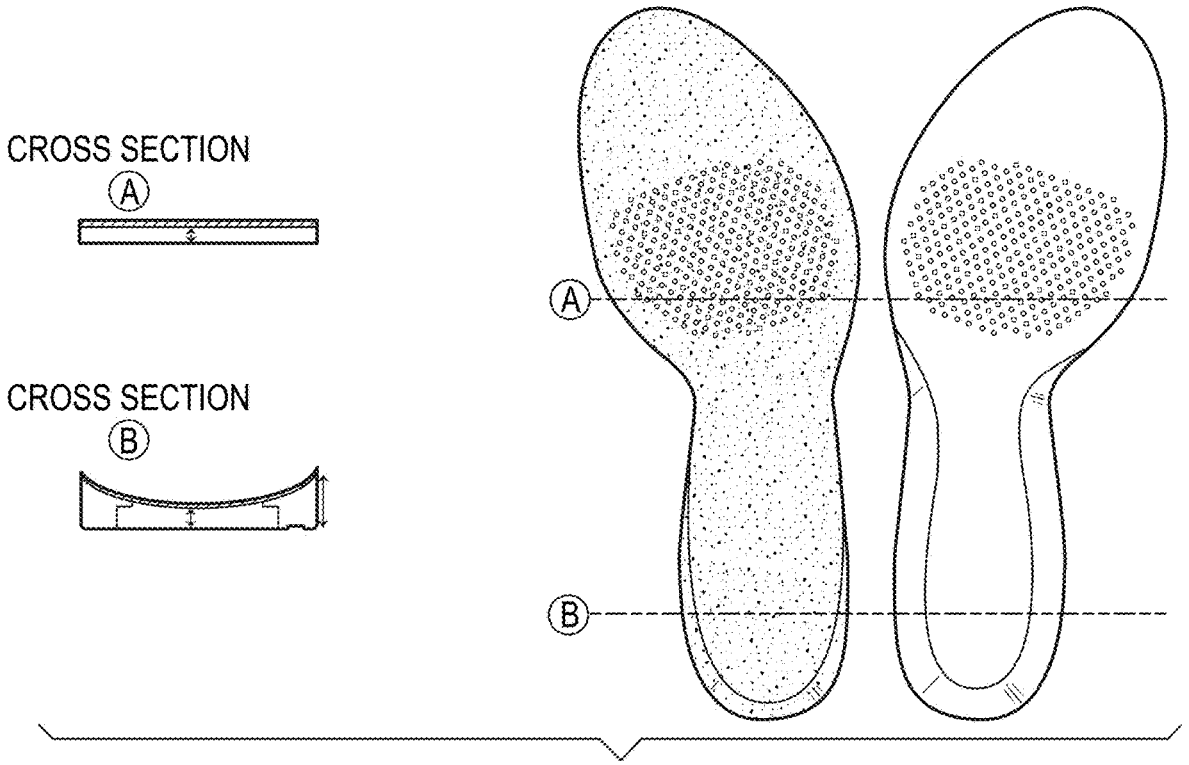
FIG. 8 shows an exemplary design of an insole of the disclosed herein hybrid shoe, with a bottom view of the insole provided on the extreme right, a top view of the insole provided to the left of the bottom view, and with cross-sectional views provided on the left side of FIG. 8.

In still further aspects, the top surface of the insole can further comprise branding and/or sizing information if desired. In aspects where the insole is not present or is removable, the branding and/or sizing information can be positioned on an outermost surface of the insole board. Some additional exemplary insoles are also shown in FIG. 8.

In still further aspects, the insole is compression molded. Selection of molding for the insole helps ensure a better fit and functionality of the shoe, reduce abrasion at the back of the foot, and increase stability both laterally and medially, which this construction requires due to the use of a high heel. In still further aspects, micro-perforations can be added at the front portion of the insole (at the ball of the foot) to allow added air circulation. In still further aspects, such a construction allows a reduction in the amount of material used and an increase in the softness of the material. In additional or alternative aspects, the insole can be honeycombed at the center point of the heel for added "squish" or softness when the wearer puts on the shoes.

In still further aspects, the disclosed herein shoe can comprise a midsole.

In still further aspects, at least a portion of the footwear article can comprise a midsole. In still further aspect, at least a portion of the midsole has a corrugated, grid, honeycomb, or a combination thereof construction.

Figure 7:
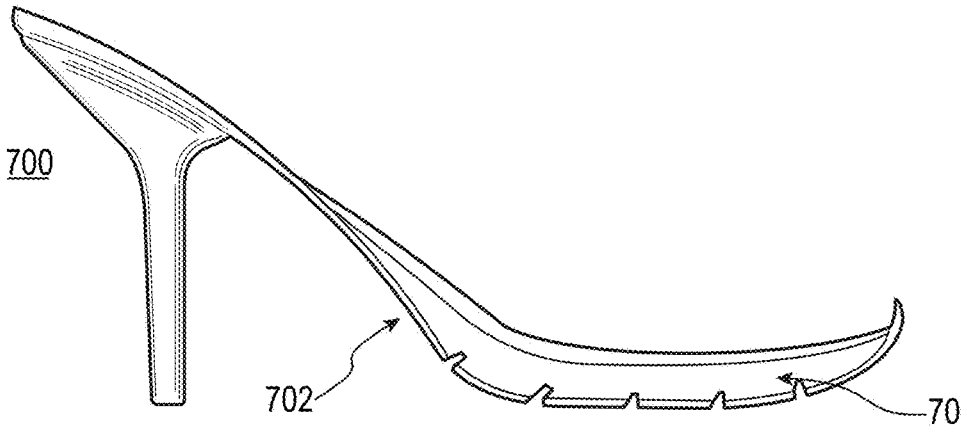
FIG. 7 shows an exemplary midsole and outsole of the disclosed herein hybrid shoe.

The midsole of the shoe is generally sandwiched between the insole board of the shoe and the outsole. In some aspects, the midsole is positioned along the entire length of the shoe. In other aspects, the midsole is positioned along a portion of a length of the shoe. In still further aspects, the midsole is positioned along a predetermined portion of a length of the shoe. In such exemplary aspects, the midsole can be posited between a distal end of the toe box and a predetermined endpoint along an arch of the foot. In still further aspects, the midsole is disposed on the front portion of the shoe and along the arch of the shoe. In still further aspects, the midsole is positioned between the front edge of the shoe up to a root of the high-heel. In yet other aspects, the midsole occupies between about 10% to about 90%, including exemplary values of about 15%, about 20%, about 30%, about 40%, about 50%, about 60%, about 70%, and about 80% of the shoe from the front edge of the shoe. In still further aspects, the heel portion of the shoe does not comprise a midsole. An exemplary and unlimiting design of the midsole is shown in FIG. 7. In yet further aspects, the midsole can be disposed along the entire length of the shoe. In yet further aspects, the thickness along the length of the shoe can be different in various portions of the shoe. For example, and without limitations, the thickness of the midsole in the front portion of the shoe can be larger than the thickness in the waist of the shoe or in the back/heel portion of the shoe. It is also understood that the change in the thickness of the midsole can be gradual or sharp depending on the desired design or performance.

In some aspects, the midsole can comprise a foam. In such aspects, any known in the art foam materials can be used. For example, and without limitation, the foam can be made of a polyurethane (PU), thermoplastic polyurethane (TPU), or ethylene vinyl acetate (EVA). In certain aspects, the midsole can comprise cork, nylon, glass fibers, rubber, any known synthetic resins, or any combination thereof. In certain aspects, the midsole can further comprise a gel, airbags, fluid channels carrying liquids and/or gases, and the like, to allow extra protection, improved performance, and/or durability of the shoe. In still further aspects, the rigidity of the midsole can vary along its length. For example, the midsole in the front portion of the shoe can be more flexible and less rigid than other portions of the midsole. It is also understood that the thickness of the midsole can vary along its length and can depend both on the desired performance of the shoe and the design.

In certain aspects, the midsole in the front portion of the shoe can optionally comprise a stabilizer. It is understood that the disclosed shoe provides increased flexibility of the front portion of the shoe when compared to the conventional high-heel shoe. Thus, a balance in the stabilization of the front portion of the shoe needs to be controlled. In certain aspects, if the stabilizer is present in the midsole of the front portion of the shoe, such stabilizer can have a predetermined shape and/or pattern to provide the desired stability only in the desired portions of the shoe. In yet other aspects, the stabilizing material can also be incorporated in the arch (waist) area of the midsole if desired. In such exemplary aspects, this additional stabilizer can allow the shoe to bend at the toes instead of under the arch.

In still further aspects, additional layers can be added to a top surface of the midsole between the midsole and the insole. In such aspects, such layers can comprise TPU foam.

In still further aspects, the midsole can have a plurality of flex joints or grooves in the longitudinal and transversal directions. In still further aspects, the midsole can have a "corrugated" construction, allowing for increased flex during forward and backward movements. In such exemplary aspects, due to the horizontal construction, rather than a grid or honeycomb construction, the midsole retains increased lateral and medial stability. In still further aspects, the plurality of grooves on the top of the midsole allows the construction to further flex and warp internally and thus provide an increased flex and compression. In yet further aspects, a toe guard can be made from the midsole to increase adhesion to the upper. Such a construction of the toe guard also provides additional durability. In still further aspects, the midsole is constructed to have a high Asker hardness to ensure a reduced compression ratio. In still further aspects, the midsole can have an Asker hardness anywhere between about 30 to about 85, including exemplary values of about 35, about 40, about 45, about 50, about 55, about 60, about 65, about 70, about 75, and about 80. It is understood, however, that this compression needs to be controlled to ensure that the positioning of the heel is not affected while walking or moving. Without wishing to be bound by any theory, it is hypothesized that if the midsole compresses too much, the high heel can angle outwards, impacting walking or movement.

In still further aspects, the midsole can have any desired thickness. In certain aspects, where the midsole is disposed in the forefoot portion of the shoe, the midsole can have a thickness from about 5 mm to about 25 mm, including exemplary values of about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, and about 24 mm.

An exemplary and unlimiting midsole can be a compression molded EVA with an Asker hardness of about 60 to about 75, including exemplary values of about 61, about 62, about 63, about 64, about 65, about 66, about 67, about 68, about 69, about 70, about 71, about 72, about 73, and about 74. In some aspects, an optional compressional molded EVA with an Asker hardness of about 35 to about 50, including exemplary values of about 36, about 37, about 38, about 39, about 40, about 41, about 42, about 43, about 44, about 45, about 46, about 47, about 48, and about 49 can be present.

In yet other aspects, the footwear article can have an outsole that at a waist can have a thickness of about 2.5-3 mm, including exemplary values of about 2.6 mm, about 2.7 mm, about 2.8 mm, and about 2.9 mm with a skived edge. It is understood that due to the use of an injected TPU midsole and not a compressed TPU, the Asker rating needs to be higher. In still further aspects, since the injected TPU has a higher rebound ability and does not compress as quickly over time, it can present a more comfortable and newer alternative to the compression molded EVA. In still further aspects, the midsole can be an injection molded PU with an Asker hardness of about 40 to about 90, including exemplary values of about 45, about 50, about 55, about 60, about 65, about 70, about 75, about 80, and about 85. In yet still further aspects, the midsole can be formed of synthetic rubber, natural rubber, thermoplastic polyurethane, recycled thermoplastic polyurethane, cork, PET, recycled PET, EVA, any known in the art, and suitable thermoplastic rubbers (TPR), any known in the art and suitable thermoplastic elastomers (TPE), natural fibers, recycled waste (recycled vegetable tanned leather, recycled coffee beans, and ground coffee), algae, rice, palms, and the like.

In some aspects, the shoe further comprises an outsole. In some aspects, the outsole is provided as an integral piece. In yet other aspects, the outsole can have a plurality of elements that are coupled together to the midsole. In such exemplary aspects, the disclosed structure can allow the toes of the toot to act independently and to increase the stability of the shoe. In particular, the flex joints can be created in an isolated sole area for the hallux, hereby allowing flexor hallucis and extensor hallucis longus to play a greater role in the flexibility of the toes and general stability of the shoe.

Any known in the art materials that can be used in shoe outsoles can be utilized herein. For example, and without limitations, the outsole can comprise phylon (Ethylene Vinyl Acetate (EVA) foam), polyurethane (PU) foam, thermoplastic polyurethane (TPU), rubber (or other hard elastic), expanded polypropylene (ePP), polyamide (PA) resin, polyester (PES), polyether block amide (PEBA) foam, polystyrene (PS), Kevlar, Dyneema, or other ultra-high-molecular weight polyethylene (UHMWPE), or any combination thereof.

In still further aspects, at least a portion of the outsole of the disclosed herein shoe can also be vulcanized. In such aspects, the outsole can also comprise an affixing element that is configured to secure the coupling of the upper and the insole board. This affixing element can be applied or molded at the insole board and overlapped with the upper. In such aspects, the affixing element can substantially encircle the entire shoe.

In still further aspects, the disclosed stylish hybrid shoe has a high heel. In such aspects, the term "high heel" used in the disclosed herein fashionable and trendsetting shoe refers to shoes having a heel equal to or higher than about 1 inch, equal to or higher than about 1.5 inches, equal to or higher than about 2 inches, equal to or higher than about 3 inches, or even equal to or higher than about 4 inches. In certain aspects, the heel is a stiletto, pump, kitten heel, cone heel, block square, spool, and the like. In still further aspects, the heel can have any desired shape and thickness. In still further aspects, the heel can be manufactured from any known in the art materials. For example, it can be manufactured from an acrylonitrile butadiene styrene (ABS) plastic and the like materials. In still further aspects, the heel can comprise a pin inserted within the heel for increased stability and durability. It is understood that the pin can be made of any known in the art materials, for example, and without limitation, from a metal or metal alloys, composite materials, carbon fiber, and the like.

In certain aspects, the high heel can be positioned anywhere within the heel area of the shoe to compensate for the relatively large width, as compared to the conventional high heel shoe, of the toe box to add general stability to the shoe.

Also disclosed herein are methods for manufacturing of the disclosed above shoes.

Although several aspects of the disclosure have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the disclosure is not limited to the specific aspects disclosed hereinabove and that many modifications and other aspects are intended to be included within the scope of the disclosure. Moreover, although specific terms are employed herein, they are used only in a generic and descriptive sense and not for the purposes of limiting the described disclosure.

EXAMPLES

The following examples are put forth so as to provide those of ordinary skill in the art with a complete disclosure and description of how the compounds, compositions, articles, devices, and/or methods claimed herein are made and evaluated and are intended to be purely exemplary and are not intended to limit the disclosure. Efforts have been made to ensure accuracy with respect to numbers (e.g., amounts, temperature, etc.), but some errors and deviations should be accounted for.

Example 1

The following Table 1 shows a comparison of common standard last measurements vs. the last disclosed herein. Compared are the lasts of size 7 with a heel height of 65 mm.

TABLE 1

| Measurement | American Standard Last | European Standard Last | Inventive Last |
|---|---|---|---|
| Ball Girth | 210 mm-215 mm | 210 mm-216 mm | 225 mm-230 mm |
| Mid-instep Girth | 213 mm | 215 mm-217 mm | 210 mm-213 mm |
| Length to ball break point | 145 mm | 142 mm-145 mm | 148 mm-152 mm |

TABLE 1-continued

| Measurement | American Standard Last | European Standard Last | Inventive Last |
|---|---|---|---|
| Ball width | 79-84 | 77 mm-81 mm | 85 mm-95 mm |
| Arch height at mid-instep point | 22 mm | 24 mm | 32 mm-34 mm |

Aspects

In view of the described lasts, shoes, and insoles, herein below are described certain more particularly described aspects of the inventions. The particularly recited aspects should not, however, be interpreted to have any limiting effect on any different claims containing different or more general teachings described herein or that the "particular" aspects are somehow limited in some way other than the inherent meanings of the language used therein.

Aspect 1: A footwear last for a predetermined size comprising: a) a hindfoot section wherein a distal bottom portion of the hindfoot section defines a heel seat; b) a forefoot section, wherein the forefoot section has a distal portion and a proximal portion; and c) a midfoot section, wherein the midfoot section connects the hindfoot section and forefoot section, wherein a length $l_1$ from a heel point ($H_o$) of the hindfoot section to a footwear last ball break point measured along a footwear last bottom center line curve is at least about 3% longer than a length $l_1'$ from a heel point ($H_o'$) of the hindfoot section to a footwear last ball break point measured along a footwear last bottom center line curve of a standard footwear last having a size substantially identical to the predetermined size, and a substantially identical heel height; wherein a height measured from a heel point ($H_o$) to a ground plane defines a heel height $a_1$ of a footwear article manufactured using the footwear last and wherein $a_1$ is at least 50 mm; and wherein arch height $a_2$ at a mid-instep as measured relative to the ground plane is at least about 5% higher than a height $a_2'$ at mid instep as measured relative to the ground plane of the standard footwear last having the size substantially identical to the predetermined size and the substantially identical heel height.

Aspect 2: The footwear last of Aspect 1, wherein the length $l_1$ is substantially identical or greater than a length $l_1''$ from a heel point ($H_o''$) of a hindfoot section to a footwear last ball break point measured along a footwear last bottom center line curve of a standard footwear last having a substantially identical heel height and that is at least one size larger than the predetermined size.

Aspect 3: The footwear last of Aspect 1 or 2, wherein a forefoot section extends proximally and upwardly from the footwear last ball break point at an angle $a_1$ relative to the ground plane towards a toe point of the footwear last.

Aspect 4: The footwear last of any one of Aspects 1-3, wherein a portion of the forefoot section distal to the footwear last ball break point curves distally and upwardly at an angle $a_2$ to form a convex shaped portion Z along a bottom surface of the footwear last, wherein the convex-shaped portion is positioned between the footwear last ball break point and a proximal end of the midfoot section and is defined by an arc length $n_1$.

Aspect 5: The footwear last of any one of Aspects 1-4, wherein a wedge angle as of the footwear last is substantially identical to a wedge angle $a_3'$ of the standard footwear last having the size substantially identical to the predetermined size and the substantially identical heel height.

Aspect 6: The footwear last of any one of Aspects 1-5, wherein an arch length of the footwear last is at least 3% longer than an arch length of the standard footwear last having the size substantially identical to the predetermined size and the substantially identical heel height.

Aspect 7: The footwear last of any one of Aspects 1-6, wherein an arch length of the footwear last is greater than an arch length of the standard last having the substantially identical heel height and that is at least one size larger than the predetermined size.

Aspect 8: The footwear last of any one of Aspects 1-7, wherein a plantar arch height as of the footwear last defined by a distance from the highest point of an arch curve to a straight line connecting the heel point and a ball break point of the footwear last is greater than a plantar arch height $a_3'$ similarly measured for the standard footwear last having the substantially identical size and the substantially identical heel height.

Aspect 9: The footwear last of Aspect 8, wherein a ratio between $a_2/a_3$ is from about 1.6 to about 3 for the heel height between about 50 to about 90 mm.

Aspect 10: The footwear last of any one of Aspects 1-9, wherein a ratio between $a_1/a_2$ is from about 0.7 to about 2.6 for the heel height between about 50 to about 90 mm.

Aspect 11: The footwear last of any one of Aspects 1-10, wherein at least a portion of the hindfoot section of the footwear last has a convex-shaped portion (W).

Aspect 12: The footwear last of Aspect 11, wherein an apex of at least a portion of the hindfoot section of the footwear last having the convex-shaped portion is a mid-portion of the hindfoot section of the footwear last.

Aspect 13: The footwear last of Aspect 12, wherein a length from the apex of the convex-shaped portion to the ground plane is from about 2 mm to about 10 mm lower than $a_1$, and where the convex-shaped portion of the hindfoot section of the footwear last is configured to form a concave portion in a hindfoot section of a footwear article formed upon the footwear last.

Aspect 14: The footwear last of Aspects 12 or 13, wherein the length from the apex of the convex-shaped portion to the ground plane is from about 2 mm to 10 mm lower than a length between a midportion of a hindfoot section to the ground plane of the standard footwear last having the substantially identical size, and the substantially identical heel height.

Aspect 15: The footwear last of any one of Aspects 1-14, wherein a ball width $b_1$ is at least about 5% greater than a ball width $b_1'$ in the standard footwear last having the substantially identical size and the substantially identical heel height.

Aspect 16: The footwear last of Aspect 15, wherein the length $b_1$ is from about 85 mm to about 95 mm.

Aspect 17: The footwear last of Aspect 16, wherein the length $b_1$ is about 90 mm.

Aspect 18: The footwear last of any one of Aspects 1-17, wherein the hindfoot section has a heel width substantially identical to a heel width of the standard footwear last having the substantially identical size and the substantially identical heel height.

Aspect 19: The footwear last of any one of Aspects 1-18, wherein the footwear last is configured to form a footwear article where when a foot is inserted in the footwear article, substantially no space is formed between behind a ball of the foot and a footbed of the footwear article.

Aspect 20: The footwear last of any one of Aspects 1-19, wherein the footwear last is configured to form a footwear article where when a foot is inserted in the footwear article, substantially no space is formed along a lateral length of the foot.

Aspect 21: The footwear last of any one of Aspects 1-20, wherein the footwear last is configured to be graded to a standard shoe size between 5 and 11.

Aspect 22: A footwear article comprising: a) a lasting board; b) an upper comprising one or more layers of a material; c) an outsole, and d) a heel having a heel height of at least 50 mm; wherein the lasting board and the upper are formed onto the footwear last of any one of Aspects 1-21.

Aspect 23: The footwear article of Aspect 22 wherein a toe-box portion of the footwear article is defined from a ball width to a toe point of the footwear article, and wherein a toe-box width $d_1$ is at least about 5% greater than a toe box width $d_1$ of a reference footwear article formed onto the standard footwear last having the substantially identical size and the substantially identical heel height.

Aspect 24: The footwear article of any one of Aspects 22-23, wherein a heel portion of the footwear article is defined by the hindfoot section of the footwear last and comprises a concave portion configured to receive a heel of a wearer in a cradle-like arrangement.

Aspect 25: The footwear article of Aspect 24, wherein the heel portion has a heel width $d_2$ that is substantially identical to a heel width $d_2'$ of the reference footwear article formed onto the standard footwear last having the substantially identical size and the substantially identical heel height.

Aspect 26: The footwear article of Aspect 25, wherein a ratio of the toe box width $d_1$ to the heel width $d_2$ is greater than about 1.5 to about 1.8 for a standard width shoe size.

Aspect 27: The footwear article of any one of Aspects 24-26, wherein the toe box width $d_1$ is substantially independent of a toe-box shape, wherein the toe-box shape is selected from a round shape, a square shape, or a pointed shape.

Aspect 28: The footwear article of any one of Aspects 22-27, wherein when a foot is inserted in the footwear article substantially no space is formed between behind a ball of the foot and a footbed of the footwear article.

Aspect 29: The footwear article of any one of Aspects 24-28, wherein the toe box width $d_1$ is effective to provide a substantially free movement of proximal and intermediate phalanges of the wearer's toes during normal wear.

Aspect 30: The footwear article of any one of Aspects 24-29, wherein the toe box width $d_1$ is effective to accommodate a change in a foot shape due to prolonged wear or a temperature change.

Aspect 31: The footwear article of any one of Aspects 22-30, wherein the heel of the footwear article has a shape of a wedge, stiletto, Louis, Spanish, Dutch, Hooked, Cuban.

Aspect 32: The footwear article of any one of Aspects 22-31, wherein the footwear article is a high-heel or pumps.

Aspect 33: The footwear article of any one of Aspects 22-32, wherein the footwear article is a shoe, sandal, mule, or a boot.

Aspect 34: The footwear article of any one of Aspects 22-33, wherein the toe box portion of the footwear article is substantially identical to a toe box portion of a standard athletic shoe having a substantially identical foot size.

Aspect 35: The footwear article of Aspect 34, wherein the footwear article is a hybrid between an athletic shoe and a high-heel shoe.

Aspect 36: The footwear article of any one of Aspects 22-35, wherein the upper comprises one or more layers of a material.

Aspect 37: The footwear article of Aspects 36, wherein each of the one or more layers comprises a material that is the same or different.

Aspect 38: The footwear article of Aspects 36 or 37, wherein the material comprises natural or synthetic leather, a polymeric material, natural material, a mesh, a rigid material, bamboo, silicone, or any combinations thereof.

Aspect 39: The footwear article of any one of Aspects 22-38, wherein the upper is the same or different along various portions of the footwear article.

Aspect 40: The footwear article of any one of Aspects 22-39, wherein the footwear article further comprises a heel seat comprising a bottom portion defined by the lasting board and a counter portion, wherein an inner surface of the bottom portion supports a posterior area of a wearer's heel, an outer surface of the bottom portion supports the heel of the footwear article and the counter portion extends above the calcaneus bone of the wearer's foot, wherein the heel seat is configured to receive the wearer's heel in a cradle-like arrangement.

Aspect 41: The footwear article of Aspect 40, wherein at least a portion of the counter portion of the heel seat comprises a heel counter insert disposed between the one or more layers of the upper and extending laterally and medially to a corresponding longitudinal arch to stabilize the footwear article and to preserve a shape of the counter portion.

Aspect 42: The footwear article of Aspect 41, wherein the heel counter insert comprises cardboard, a polymeric material, a silicone-based material, or any combination thereof.

Aspect 43: The footwear article of Aspects 41 or 42, wherein the heel counter insert is moldable.

Aspect 44: The footwear article of any one of Aspects 22-43, further comprising a shank stabilizer positioned in a midportion of the footwear article.

Aspect 45: The footwear article of Aspect 44, wherein the shank stabilizer is made of a metal, plastic, cardboard, or any combination thereof.

Aspect 46: The footwear article of Aspects 44 or 45, wherein the shank stabilizer is separately inserted into the lasting board or wherein the midportion of the lasting board is configured to behave as the shank.

Aspect 47: The footwear article of any one of Aspects 22-46, wherein the upper of the toe box portion is substantially different from the upper of the heel portion.

Aspect 48: The footwear article of any one of Aspects 22-47, wherein a toe point area of a toe box portion comprises a toe box counter.

Aspect 49: The footwear article of Aspect 48, wherein the toe box counter is less rigid than the heel counter insert.

Aspect 50: The footwear article of any one of Aspects 22-49, wherein at least a portion of the upper is attached to a Strobel layer.

Aspect 51: The footwear article of Aspect 50, wherein the upper in the toe box portion comprises a performance mesh attached to the Strobel layer.

Aspect 52: The footwear article of any one of Aspects 22-51, wherein at least a portion of the footwear article comprises a midsole.

Aspect 53: The footwear article of Aspect 52, wherein at least a portion of the midsole has a corrugated, grid, honeycomb, or a combination thereof construction.

Aspect 54: The footwear article of any one of Aspects 22-53 wherein the footwear article further comprises an insole insert.

Aspect 55: The footwear article of any one of Aspects 22-54, further comprises a member configured to hold a foot of the wearer in place and prevent sliding of the foot.

Aspect 56: The footwear of Aspect 55, wherein the member comprises one or more of a strap, laces, buttons, snaps, hooks, or any combination thereof.

Aspect 57: A hybrid shoe having a heel height of at least 50 mm and defined by a) a toe box having a first width: b) a heel portion defining a heel seat having a second width; and c) a midportion connecting the toe box and the heel portion, wherein a ratio between the first width and the second width is greater than about 1.5 to about 1.8 for a standard width shoe size; wherein the toe box is configured to resemble an athletic shoe; the heel portion comprises a heel counter insert and is configured to resemble a standard high-heel shoe heel portion; wherein the shoe comprises a lasting board that is more rigid than a lasting board of a standard athletic shoe; and wherein the hybrid shoe further comprises a fastening member configured to hold a wearer's foot in place.

Aspect 58: A footwear support system comprising an insole insert comprising: a) a toe portion having a first thickness; b) a forefoot portion having a second thickness; c) a hindfoot portion having a third thickness; and wherein the first and/or second thickness of the insole insert are greater than the third thickness of the insole insert.

Aspect 59: The footwear support system of Aspect 58, wherein the first thickness is greater than the second thickness.

Aspect 60: The footwear support system of Aspect 58, wherein the first thickness is the same as the second thickness.

Aspect 61: The footwear support system of any one of Aspects 58-61, wherein the insole insert further comprises a midfoot portion disposed between the forefoot portion and the hindfoot portion and having a fourth thickness.

Aspect 62: The footwear support system of Aspect 61, wherein the third and the fourth thickness are the same.

Aspect 63: The footwear support system of any one of Aspects 61 or 62, wherein the third thickness is greater than the fourth thickness.

Aspect 64: The footwear support system of any one of Aspects 61 or 62, wherein the third thickness is smaller than the fourth thickness.

Aspect 65: The footwear support system of any one of Aspects 61-64, wherein the first, second, third, and/or fourth thickness are uniform across the toe portion, forefoot portion, hindfoot portion, or midfoot portion, respectively.

Aspect 66: The footwear support system of any one of Aspects 58-65, wherein the first, second, third, and/or fourth thickness are varied across the toe portion, forefoot portion, hindfoot portion, or midfoot portion, respectively.

Aspect 67: The footwear support system of any one of Aspects 58-66, wherein the forefoot portion that abuts a ball of a wearer's foot comprises a first concave portion configured to receive a portion of the ball of the foot around a base of a big toe.

Aspect 68: The footwear support system of Aspect 67, wherein the first concave portion has a smaller thickness than the second thickness.

Aspect 69: The footwear support system of Aspects 67 or 68, wherein the forefoot portion abutting a portion of the ball of the foot around a base of a pinky toe has a thickness greater than the first concave portion and equal to or smaller than the second thickness.

Aspect 70: The footwear support system of any one of Aspects 58-69, wherein the hindfoot portion comprises a second concave portion configured to receive and support the calcaneus bone of a wearer's foot.

Aspect 71: The footwear support system of any one of Aspects 61-70, wherein the midfoot portion comprises a third concave portion configured to receive a medial midfoot portion of a wearer's foot, such that the fourth thickness varies across a width of the midfoot portion having a higher thickness along a lateral midfoot portion and smaller thickness along a medial midfoot portion.

Aspect 72: The footwear support system of any one of Aspects 58-71, comprising a material configured to conform to a wearer's foot shape.

Aspect 73: The footwear support system of any one of Aspects 58-72, wherein the insole insert is formed from a resiliently deformable material.

Aspect 74: The footwear support system of Aspect 73, wherein the resiliently deformable material has a variable density along the insole insert.

Aspect 75: The footwear support system of Aspects 73 or 74, wherein the first, the second, the third, and the fourth thicknesses are formed by varying compression of the resiliently deformable material.

Aspect 76: The footwear support system of any one of Aspects 73-75, wherein the resiliently deformable material comprises thermoplastic polyurethane, polyurethane, polyethylene, or ethylene-vinyl acetate.

Aspect 77: The footwear support system of any one of Aspects 73-76, wherein the resiliently deformable material is recycled and recyclable.

Aspect 78: The footwear support system of any one of Aspects 73-77, wherein the resiliently deformable material is a bio-sourced material.

Aspect 79: The footwear support system of any one of Aspects 71-78, wherein the second concave portion comprises a padding, gel, or cushion.

Aspect 80: The footwear support system of any one of Aspects 58-79, wherein at least a portion of the forefoot portion comprises padding, gel, or cushion.

Aspect 81: The footwear support system of any one of Aspects 58-80, wherein at least a portion of the insole insert comprises a perforated layer configured to provide breathability.

Aspect 82: The footwear support system of any one of Aspects 58-81, wherein the insole insert comprises one or more layers.

Aspect 83: The footwear support system of any one of Aspects 58-82, wherein the insole insert is molded.

The invention claimed is:

1. A footwear last for a predetermined size comprising:

a) a hindfoot section wherein a distal bottom portion of the hindfoot section defines a heel seat;

b) a forefoot section, wherein the forefoot section has a distal portion and a proximal portion; and c) a midfoot section, wherein the midfoot section connects the hindfoot section and forefoot section, wherein the footwear last is defined by:

a length $l_1$ from a heel point ($H_o$) of the hindfoot section to a footwear last ball break point measured along a footwear last bottom center line curve;

a height measured from the heel point ($H_o$) to a ground plane that defines a heel height $a_1$ of a footwear article manufactured using the footwear last and wherein $a_1$ is at least 50 mm;

an arch height $a_2$ as measured at a mid-instep relative to the ground plane;

a plantar arch height $a_3$ of the footwear last that is defined by a distance from the highest point of an arch curve to a straight line connecting the heel point (Ho) and the ball break point of the footwear last;

wherein a ratio of $a_1/a_2$ is 0.7 to 2.6;

wherein a ratio of $a_2/a_3$ is 1.6 to 3; and wherein a ball width $b_1$ is from 85 mm to 95 mm.

2. The footwear last of claim 1, wherein a portion of the forefoot section distal to the footwear last ball break point curves distally and upwardly at an angle $\angle 2$ to form a convex shaped portion Z along a bottom surface of the footwear last, wherein the convex-shaped portion is positioned between the footwear last ball break point and a proximal end of the midfoot section and is defined by an arc length $n_1$.

3. The footwear last of claim 1, wherein at least a portion of the hindfoot section of the footwear last has a convex-shaped portion (W).

4. The footwear last of claim 1, wherein an increase in $a_2$ is correlated with an increase in $l_1$.

5. The footwear last of claim 3, wherein a length of an apex of the convex-shaped portion projected to the ground plane is 2 mm to 10 mm shorter than $a_1$.

6. The footwear last of claim 1, wherein a ball girth is 225 mm to 230 mm.

7. The footwear last of claim 1, wherein a mid-instep girth is 210 mm to 213 mm.

8. The footwear last of claim 1, wherein the $l_1$ is 148 mm to 152 mm.

9. The footwear last of claim 1, wherein the $a_2$ is 32 mm to 34 mm.

* * * * *